United States Patent [19]

Shimizu et al.

[11] Patent Number: 4,517,269

[45] Date of Patent: May 14, 1985

[54] PHOTOCONDUCTIVE MEMBER

[75] Inventors: Isamu Shimizu; Kozo Arao, both of Yokohama, Japan

[73] Assignee: Canon Kabushiki Kaisha, Tokyo, Japan

[21] Appl. No.: 486,940

[22] Filed: Apr. 20, 1983

[30] Foreign Application Priority Data

| | | | |
|---|---|---|---|
| Apr. 27, 1982 | [JP] | Japan | 57-70771 |
| Apr. 27, 1982 | [JP] | Japan | 57-70774 |
| Apr. 27, 1982 | [JP] | Japan | 57-70776 |
| Apr. 28, 1982 | [JP] | Japan | 57-71951 |
| Apr. 28, 1982 | [JP] | Japan | 57-71953 |
| Apr. 28, 1982 | [JP] | Japan | 57-71954 |
| Apr. 28, 1982 | [JP] | Japan | 57-71956 |
| Apr. 30, 1982 | [JP] | Japan | 57-73025 |

[51] Int. Cl.[3] ..... G03G 5/14

[52] U.S. Cl. ..... 430/57; 346/153.1; 313/386; 357/2

[58] Field of Search ..... 346/153.1; 313/386; 430/57; 357/2

[56] References Cited

U.S. PATENT DOCUMENTS

| | | | |
|---|---|---|---|
| 4,196,438 | 4/1980 | Carlson | 357/2 X |
| 4,255,686 | 3/1981 | Maruyama et al. | 313/386 X |
| 4,378,417 | 3/1983 | Maruyama et al. | 430/57 |

*Primary Examiner*—John D. Welsh

*Attorney, Agent, or Firm*—Fitzpatrick, Cella, Harper & Scinto

[57] ABSTRACT

A photoconductive member comprises a support for a photoconductive member, a first amorphous layer having a layer constitution comprising a first layer region comprising an amorphous material containing silicon atoms and germanium atoms and a second layer region comprising an amorphous material containing silicon atoms and exhibiting photoconductivity, said first and second layer regions being provided successively from the side of said support; and a second amorphous layer comprising an amorphous material containing silicon atoms and carbon atoms.

45 Claims, 27 Drawing Figures

PHOTOCONDUCTIVE MEMBER

BACKGROUND OF THE INVENTION

1. Field of the Invention

This invention relates to a photoconductive member having sensitivity to electromagnetic waves such as light (herein used in a broad sense, including ultraviolet rays, visible light, infrared rays, X-rays and gamma-rays).

2. Description of the Prior Art

Photoconductive materials, which constitute photoconductive layers in solid state image pick-up devices, in image forming members for electrophotography in the field of image formation, or in manuscript reading devices, are required to have a high sensitivity, a high SN ratio (Photocurrent ($I_p$)/Dark current ($I_d$)), spectral characteristics matching to those of electromagnetic waves to be irradiated, a rapid response to light, a desired dark resistance value as well as no harm to human bodies during usage. Further, in a solid state image pick-up device, it is also required that the residual image should easily be treated within a predetermined time. In particular, in case of an image forming member for electrophotography to be assembled in an electrophotographic device to be used in an office as office apparatus, the aforesaid harmless characteristic is very important.

From the standpoint as mentioned above, amorphous silicon (hereinafter referred to as a-Si) has recently attracted attention as a photoconductive material. For example, German Laid-Open Patent Publication Nos. 2746967 and 2855718 disclose applications of a-Si for use in image forming members for electrophotography, and German Laid-Open Patent Publication No. 2933411 an application of a-Si for use in a photoconverting reading device.

However, under the present situation, the photoconductive members having photoconductive layers constituted of a-Si are further required to be improved in a balance of overall characteristics including electrical, optical and photoconductive characteristics such as dark resistance value, photosensitivity and response the light, etc., and environmental characteristics during use such as humidity resistance, and further stability with lapse of time.

For instance, when applied in an image forming member for electrophotography, residual potential is frequently observed to remain during use thereof if improvements to higher photosensitivity and higher dark resistance are scheduled to be effected at the same time. When such a photoconductive member is repeatedly used for a long time, there will be caused various inconveniences such as accumulation of fatigues by repeated uses or so called ghost phenomenon wherein residual images are formed, or when it is used at a high speed repeatedly, response is gradually lowered.

Further, a-Si has a relatively smaller absorption coefficient in the wavelength region longer than the longer wavelength region side in the visible light region as compared with that on the shorter wavelength region side in the visible light region, and therefore in matching to the semiconductor laser practically used at the present time or when using a presently available halogen lamp or fluorescent lamp as the light source, there remains room for improvement in the drawback that the light on the longer wavelength side cannot effectively be used.

Besides, when the light irradiated cannot sufficiently be absorbed into the photoconductive layer, but the quantity of the light reaching the support is increased, if the support itself has a high reflectance with respect to the light permeating through the photoconductive layer, there will occur interference due to multiple reflections which may be a cause for formation of "unfocused image".

This effect becomes greater, when the spot irradiated is made smaller in order to enhance resolution, and it is a great problem particularly when using a semiconductor laser as light source.

Thus, it is required in designing of a photoconductive member to make efforts to overcome all of the problems as mentioned above along with the improvement of a-Si materials per se.

In view of the above points, the present invention contemplates the achievement obtained as a result of extensive studies made comprehensively from the standpoints of applicability and utility of a-Si as a photoconductive member for image forming members for electrophotography, solid state image pick-up devices, reading devices, etc. Now, a photoconductive member having a first amorphous layer exhibiting photoconductivity, which comprises a-Si, particularly an amorphous material containing at least one of hydrogen atom (H) and halogen atom (X) in a matrix of silicon atoms (hereinafter referred to comprehensively as a-Si(H,X)), so called hydrogenated amorphous silicon, halogenated amorphous silicon or halogen-containing hydrogenated amorphous silicon, said photoconductive member being prepared by designing so as to have a specific structure as described later, is found to exhibit not only practically extremely excellent characteristics but also surpass the photoconductive members of the prior art in substantially all respects, especially markedly excellent characteristics as a photoconductive member for electrophotography. The present invention is based on such finding.

SUMAMRY OF THE INVENTION

A primary object of the present invention is to provide a photoconductive member having constantly stable electrical, optical and photoconductive characteristics, which is all-environment type substantially without any limitation as to its use environment and markedly excellent in photosensitive characteristics on the longer wavelength side as well as in light fatigue resistance without causing any deterioration phenomenon after repeated uses and free entirely or substantially from residual potentials observed.

Another object of the present invention is to provide a photoconductive member, which is high in photosensitivity in all the visible light region, particularly excellent in matching to a semiconductor laser and rapid in light response.

A further object of the present invention is to provide a photoconductive member having excellent electrophotographic characteristics, which is sufficiently capable of retaining charges at the time of charging treatment for formation of electrostatic charges to the extent such that a conventional electrophotographic method can be very effectively applied when it is provided for use as an image forming member for electrophotography.

Still another object of the present invention is to provide a photoconductive member for electrophotography capable of providing easily a high quality image which is high in density, clear in halftone and high in resolution.

A still further object of the present invention is to provide a photoconductive member having high photosensitvity and high SN ratio characteristic.

According to the present invention, there is provided a photoconductive member comprising a support for a photoconductive member, a first amorphous layer having a layer constitution comprising a first layer region comprising an amorphous material containing silicon atoms and germanium atoms and a second layer region comprising an amorphous material containing silicon atoms and exhibiting photoconductivity, said first and second layer regions being provided successively from the side of said support; and a second amorphous layer comprising an amorphous material containing silicon atoms and carbon atoms.

DESCRIPTION OF THE PREFERRED EMBODIMENT

Figure 1:
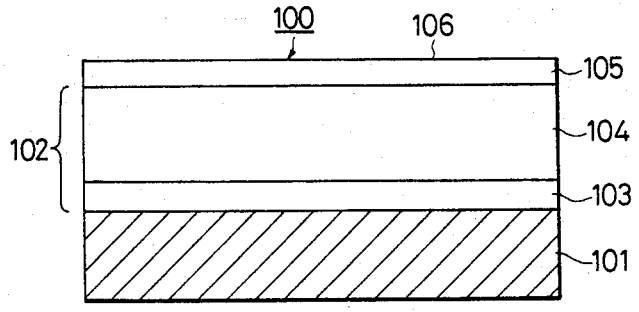
FIG. 1 shows a schematic sectional view for illustration of the layer constitution of a preferred embodiment of the photoconductive member according to the present invention.

Referring now to the drawings, the photoconductive members according to the present invention are to be described in detail below.

FIG. 1 shows a schematic sectional view for illustration of the layer constitution of a first embodiment of the photoconductive member of this invention.

The photoconductive member 100 as shown in FIG. 1 has a first amorphous layer (I) 102 and a second amorphous layer (II) 105 on a support 101 for photoconductive member, said amorphous layer (II) 105 having a free surface 106 on one of the end surfaces.

The first amorphous layer (I) 102 has a layer constitution comprising a first layer region (G) 103 comprising a-Si (H,X) containing germanium atoms (hereinafter abbreviated as "a-SiGe(H,X)") and a second layer region (S) 104 comprising a-Si(H,X) and having photoconductivity. The first layer region (G) 103 and the second layer region (S) 104 are successively laminated from the side of the support 101. The germanium atoms in the first layer region (G) 103 are contained in said layer region (G) 103 in a distribution continuous and uniform in the direction of the plane substantially parallel to the surface of the support 101, but in a distribution which may either be uniform or ununiform in the direction of layer thickness.

In the present invention, in the second layer region (S) provided on the first layer region (G), no germanium atom is contained. By forming an amorphous layer so as to have such a layer structure, there can be obtained a photoconductive member which is excellent in photosensitivity to the light with wavelengths of the whole region from relatively shorter wavelength to relatively longer wavelength including the visible ligth region.

Also, since the germanium atoms are continuously distributed throughout the first layer region (G), the light at the longerwavelength side which cannot substantially be absorbed in the second layer region (S) when employing a semiconductor laser, etc. can be absorbed in the first layer region (G) substantially completely, whereby interference due to reflection from the support surface can be prevented.

In the photoconductive member of the present invention, chemical stability can sufficiently be ensured at the laminated interface between the first layer region (G) and the second layer region (S), since each of the amorphous materials constituting respective layer regions has the common constituent of silicon atom.

Alternatively, when the distribution of the germanium atoms is made ununiform in the direction of layer thickness, improvement of the affinity between the first layer region (G) and the second layer region (S) can be effected by making the distribution of germanium atoms in the first layer region (G) such that germanium atoms are continuously distributed throughout the whole layer region and the distribution concentration C of germanium atoms in the direction of layer thickness is changed to be decreased from the support side toward the second layer region (S).

FIGS. 2 through 10 show typical examples of ununiform distribution in the direction of layer thickness of germanium atoms contained in the first layer region (G).

In FIGS. 2 through 10, the axis of abscissa indicates the distribution content C of germanium atoms and the axis of ordinate the layer thickness of the first layer region (G), $t_B$ showing the position of the end surface of the first layer region (G) on the support side and $t_T$ the position of the end surface of the first layer region (G) on the side opposite to the support side. That is, layer formation of the first layer region (G) containing germanium atoms proceeds from the $t_B$ side toward the $t_T$ side.

Figure 2:
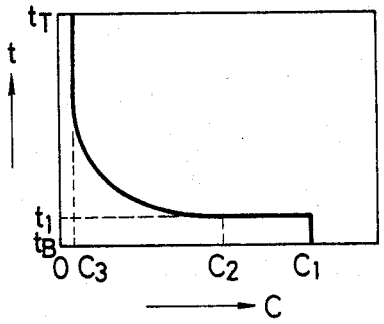
FIGS. 2 through 10 schematic sectional views for illustration of the distribution states of germanium atoms in the first amorphous layer, respectively.

In FIG. 2, there is shown a first typical embodiment of the depth profile of germanium atoms in the layer thickness direction contained in the first layer region (G).

In the embodiment as shown in FIG. 2, from the interface position $t_B$ at which the surface, on which the first layer region (G) containing germanium atoms is to be formed, is in contact with the surface of the first layer region (G) to the position $t_1$, the germanium atoms are contained in the first layer region (G), while the distribution concentration C of germanium atoms taking a constant value of $C_1$, which distribution concentration being gradually decreased continuously from the concentration $C_2$ from the position $t_1$ to the interface position $t_T$. At the interface position $t_T$, the concentration of germanium atoms is made $C_3$.

Figure 3:
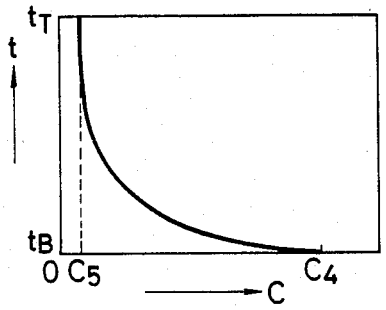

In the embodiment shown in FIG. 3, the distribution concentration C of germanium atoms contained is decreased gradually and continuously from the position $t_B$ to the position $t_T$ from the concentration $C_4$ until it becomes the concentration $C_5$ at the position $t_T$.

Figure 4:
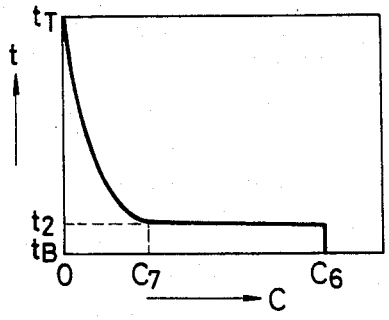

In case of FIG. 4, the distribution concentration C of germanium atoms is made constant as the concentration $C_6$ from the position $t_B$ to the position $t_2$ and gradually continuously decreased from the position $t_2$ to the position $t_T$, and the distribution concentration C is made substantially zero at the position $t_T$ (substantially zero herein means the content less than the detectable limit).

Figure 5:
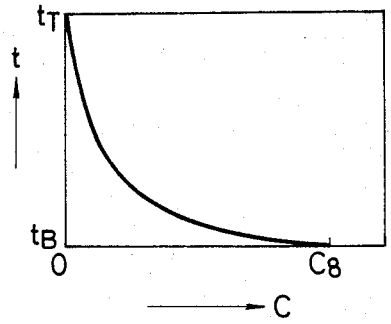

In case of FIG. 5, germanium atoms are decreased gradually and continuously from the position $t_B$ to the position $t_T$ from the concentration $C_8$, until it is made substantially zero at the position $t_T$.

Figure 6:
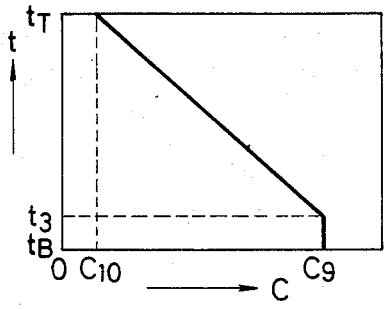

In the embodiment shown in FIG. 6, the distribution concentration C of germanium atoms is constantly $C_9$ between the position $t_B$ and the position $t_3$, and it is made $C_{10}$ at the position $t_T$. Between the position $t_3$ and the position $t_T$, the distribution concentration C is decreased as a first order function from the position $t_3$ to the position $t_T$.

Figure 7:
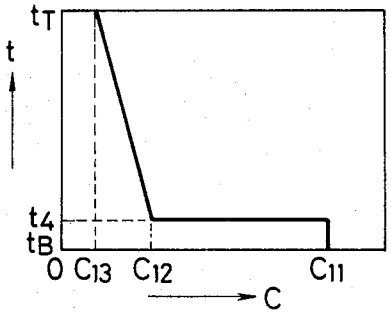

In the embodiment shown in FIG. 7, there is formed a depth profile such that the distribution concentration C takes a constant value of $C_{11}$ from the position $t_B$ to the position $t_4$, and is decreased as a first order function from the concentration $C_{12}$ to the concentration $C_{13}$ from the position $t_4$ to the position $t_T$.

Figure 8:
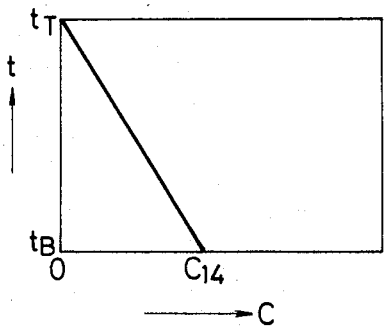

In the embodiment shown in FIG. 8, the distribution concentration C of germanium atoms is decreased as a first order function from the concentration $C_{14}$ to substantially zero from the position $t_B$ to the position $t_T$.

Figure 9:
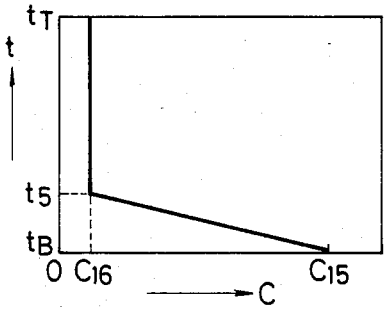

In FIG. 9, there is shown an embodiment, where the distribution concentration C of germanium atoms is decreased as a first order function from the concentration $C_{15}$ to $C_{16}$ from the position $t_B$ to $t_5$ and made constantly at the concentration $C_{16}$ between the position $t_5$ and $t_T$.

Figure 10:
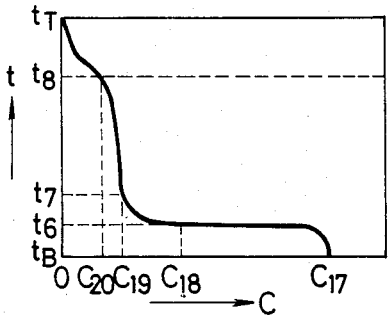

In the embodiment shown in FIG. 10, the distribution concentration C of germanium atoms is at the concentration $C_{17}$ at the position $t_B$, which concentration $C_{17}$ is initially decreased gradually and abrupty near the position $t_6$, until it is made the concentration $C_{18}$ at the position $t_6$.

Between the position $t_6$ and the position $t_7$, the concentration is initially decreased abruptly and thereafter gradually decreased, until it is made the concentration $C_{19}$ at the position $t_7$. Between the position $t_7$ and the position $t_8$, the concentration is decreased very gradually to the concentration $C_{20}$ at the position $t_8$. Between the position $t_8$ and the position $t_T$, the concentration is decreased along the curve having a shape as shown in the Figure from the concentration $C_{20}$ to substantially zero.

As described above about some typical examples of ununiform depth profiles of germanium atoms contained in the first layer region (G) in the direction of the layer thickness, when the depth profile of germanium atoms contained in the first layer region (G) is ununiform in the direction of layer thickness, the first layer region (G) is provided desirably with a depth profile of germanium atoms so as to have a portion enriched in distribution concentration C of germanium atoms on the support side and a portion made considerably lower in concentration C of germanium atoms than that of the support side on the interface $t_T$ side.

That is, the first layer region (G) which constitutes the first amorphous layer, when it contains germanium atoms so as to form a ununiform distribution in the direction of layer thickness, may preferably have a localized region (A) containing germanium atoms at a relatively higher concentration on the support side.

The localized region (A), as explained in terms of the symbols shown in FIG. 2 through FIG. 10, may be desirably provided within 5μ from the interface position $t_B$.

The above localized region (A) may be made to be identical with the whole layer region ($L_T$) up to the depth of 5μ thickness, from the interface position $t_B$, or alternatively a part of the layer region ($L_T$).

It may suitably be determined depending on the characteristics required for the first amorphous layer to be formed, whether the localized region (A) is made a part or whole of the layer region ($L_T$).

The localized region (A) may be preferably formed according to such a layer formation that the maximum, Cmax of the distribution concentrations of germanium atoms in the layer thickness direction (depth profile values) may preferably be 1000 atomic ppm or more, more preferably 5000 atomic ppm or more, most preferably $1\times10^4$ atomic ppm or more.

That is, according to the present invention, the first amorphous layer containing germanium atoms is preferably formed so that the maximum vaulue, Cmax of the distribution concentration may exist within a layer thickness of 5μ from the support side (the layer region within 5μ thickness from $t_B$).

In the present invention, the content of germanium atoms in the first region (G), which may suitably be determined as desired so as to achieve effectively the objects of the present invention, may preferably be 1 to $9.5\times10^5$ atomic ppm, more preferably 100 to $8\times10^5$ atomic ppm, most preferably 500 to $7\times10^5$ atomic ppm.

In the photoconductive member of the present invention, the layer thickness of the first layer region (G) and the layer thickness of the second layer region (S) are one of important factors for accomplishing effectively the object of the present invention, and therefore sufficient care should be paid in designing of the photoconductive member so that desirable characteristics may be imparted to the photoconductive member formed.

In the present invention, the layer thickness $T_B$ of the first layer region (G) may preferably be 30 Å to 50μ, more preferably 40 Å to 40μ, most preferably 50 Å to 30μ.

On the other hand, the layer thickness T of the second layer region (S) may be preferably 0.5 to 90μ, more preferably 1 to 80μ, most preferably 2 to 50μ.

The sum of the above layer thicknesses T and $T_B$, nemely ($T+T_B$) may be suitably determined as desired in designing of the layers of the photoconductive member, based on the mutual organic relationship between the characteristics required for both layer regions and the characteristics required for the whole first amorphous layer.

In the photoconductive member of the present invention, the numerical range for the above ($T_B+T$) may generally be from 1 to 100μ, preferably 1 to 80μ, most preferably 2 to 50μ.

In a more preferred embodiment of the present invention, it is preferred to select the numerical values for respective thicknesses $T_B$ and T as mentioned above so that the relation of preferably $T_B/T\leqq1$ may be satisfied. More preferably, in selection of the numerical values for the thicknesses $T_B$ and T in the above case, the values of $T_B$ and T are preferably be determined so that the relation of more preferably $T_B/T\leqq0.9$, most preferably, $T_B/T\leqq0.8$, may be satisfied.

In the present invention, when the content of germanium atoms in the first layer region (G) is $1\times10^5$ atomic ppm or more, the layer thickness $T_B$ of the first layer region (G) is desirably be made considerably thin, preferably 30μ or less, more preferably 25μ or less, most preferably 20μ or less.

In the present invention, illustrative of halogen atoms (X), which may optionally be incorporated in the first layer region (G) and the second layer region (S) constituting the first amorphous layer, are fluorine, chlorine, bromine and iodine, particularly preferably fluorine and chlorine.

In the present invention, the amount of hydrogen atoms (H) or the amount of halogen atoms (X) or the total amount of hydrogen plus halogen atoms (H+X) to be contained in the second layer region (S) constituting the first amorphous layer formed may preferably be 1 to 40 atomic %, more preferably 5 to 30 atomic %, most preferably 5 to 25 atomic %.

In the photoconductive member according to the present invention, a substance (C) for controlling the conduction characteristics may be incorporated at least in the first layer region (G) to impart desired conduction characteristics to the first layer region (G).

The substance (C) for controlling the conduction characteristics to be contained in the first layer region (G) may be contained evenly and uniformly within the whole layer region or locally in a part of the layer region.

When the substance (C) for controlling the conduction characteristics is incorporated locally in a part of the first layer region (G) in the present invention, the layer region (PN) containing the aforesaid substance (C) may desirably be provided as an end portion layer region of the first layer region (G). In particular, when the aforesaid layer region (PN) is provided as the end portion layer region on the support side of the first layer region (G), injection of charges of a specific polarity from the support into the amorphous layer can be effectively inhibited by selecting suitably the kind and the content of the aforesaid substance (C) to be contained in said layer region (PN).

In the photoconductive member of the present invention, the substance (C) capable of controlling the conduction characteristics may be incorporated in the first layer region (G) constituting a part of the first amorphous layer either evenly throughout the whole region or locally in the direction of layer thickness. Further, alternatively, the aforesaid substance (C) may also be incorporated in the second layer region (S) provided on the first layer region (G). Or, it is also possible to incorporate the aforesaid substance (C) in both of the first layer region (G) and the second layer region (S).

When the aforesaid substance (C) is to be incorporated in the second layer region (S), the kind and the content of the substance (C) to be incorporated in the second layer region (S) as well as its mode of incorporation may be determined suitably depending on the kind and the content of the substance (C) incorporated in the first layer region (G) as well as its mode of incorporation.

In the present invention, when the aforesaid substance (C) is to be incorporated in the second layer region (S), it is preferred that the aforesaid substance (C) may be incorporated within the layer region containing at least the contacted interface with the first layer region (G).

In the present invention, the aforesaid substance (C) may be contained evenly throughout the whole layer region of the second layer region (S) or alternatively uniformly in a part of the layer region.

When the substance (C) for controlling the conduction characteristics is to be incorporated in both of the first layer region (G) and the second layer region (S), it is preferred that the layer region containing the aforesaid substance (C) in the first layer region (G) and the layer region containing the aforesaid substance (C) in the second layer region (S) may be contacted with each other.

The aforesaid substance (C) to be incorporated in the first layer region (G) may be either the same as or different in kind from that in the second layer region (S), and their contents may also be the same or different in respective layer regions.

However, in the present invention, it is preferred that the content of the substance (C) in the first layer region (G) is made sufficiently greater when the same kind of the substance (C) is employed in respective layer regions, or that different kinds of substance (C) with different electrical characteristics are incorporated in desired respective layer regions.

In the present invention, by incorporating the substance (C) for controlling the conduction characteristics at least in the first layer region (G) constituting the first amorphous layer, the conduction characteristics of said layer region (PN) can freely be controlled as desired. As such a substance (C), there may be mentioned so called impurities in the field of semiconductors. In the present invention, there may be included P-type impurities giving P-type conduction characteristics and N-type impurities giving N-type conduction characteristics.

More specifically, there may be mentioned as P-type impurities atoms belonging to the group III of the periodic table (the group III atoms), such as B (boron), Al(aluminum), Ga(gallium), In(indium), Tl(thallium), etc., particularly preferably B and Ga.

As N-type impurities, there may be included the atoms belonging to the group V of the periodic table (the group V stoms), such as P(phosphorus), As(arsenic), Sb(antimony), Bi(bismuth), etc., particularly preferably P and As.

In the present invention, the content of the substance (C) in said layer region (PN) may be suitably be selected depending on the conduction characteristics required for said layer region (PN), or when said layer region (PN) is provided in direct contact with the support, depending on the organic relation such as the relation with the characteristics at the contacted interface with the support.

The content of the substance for controlling the conduction characteristics may be suitably selected also with consideration about other layer regions provided in direct contact with said layer region (PN) and the relationship with the characteristics at the contacted interface with said other layer regions.

In the present invention, the content of the substance (C) for controlling the conduction characteristics in the layer region (PN) may be preferably 0.01 to $5\times10^4$ atomic ppm, more preferably 0.5 to $1\times10^4$ atomic ppm, most preferably 1 to $5\times10^3$ atomic ppm.

In the present invention, by making the content of the substance (C) in the layer region (PN) preferably 30 atomic ppm or more, more preferably 50 atomic ppm or more, most preferably 100 atomic ppm or more, in case, for example, when said substance (C) to be incorporated is a P-type impurity, injection of electrons from the support side into the amorphous layer can be effectively inhibited when the free surface of the second amorphous layer is subjected to the charging treatment at ⊕ polarity, or in case when the aforesaid substance (C) to be incorporated is a N-type impurity, injection of positive holes from the support side into the amorphous layer can be effectively inhibited when the free surface of the second amorphous layer is subjected to the charging treatment at ⊖ polarity.

In the above cases, as described previously, the layer region (Z) excluding the aforesaid layer region (PN) may contain a substance (C) with a conduction type of a polarity different from that of the substance (C) contained in the layer region (PN), or it may contain substance (C) with a conduction type of the same polarity as that of the substance (C) in the layer region (PN) in an amount by far smaller than the practical amount to be contained in the layer region (PN).

In such a case, the content of the substance (C) for controlling the conduction characteristics to be contained in the aforesaid layer region (Z), which may suitably be determined as desired depending on the polarity and the content of the aforesaid substance (C) contained in the aforesaid layer region (PN), may be preferably 0.001 to 1000 atomic ppm, more preferably 0.05 to 500 atomic ppm, most preferably 0.1 to 200 atomic ppm.

In the present invention, when the same kind of the substance (C) is contained in the layer region (PN) and the layer region (Z), the content in the layer region (Z) may preferably be 30 atomic ppm or less.

In the present invention, by providing in the first amorphous layer a layer region containing a substance ($C_1$) for controlling the conduction characteristics having a conduction type of one polarity and a layer region containing a substance ($C_2$) for controlling the conduction characteristics having a conduction type of the other polarity in direct contact with each other, there can also be provided a so called depletion layer at said contacted region.

In short, a depletion layer can be provided in the first amorphous layer, for example, by providing a layer region (P) containing the aforesaid P-type impurity and a layer region (N) containing the aforesaid N-type impurity so as to be directly contacted with each other thereby to form a so called P-N junction.

In the photoconductive member of the present invention, for the purpose of improvements to higher photosensitivity, higher dark resistance and, further, improvement of adhesion between the support and the first amorphous layer, it is desirable to incorporate oxygen atoms in the first amorphous layer.

The oxygen atoms contained in the first amorphous layer may be contained either evenly throughout the whole layer region of the first amorphous layer or locally only in a part of the layer region of the first amorphous layer.

The oxygen atoms may be distributed in the direction of layer thickness of the first amorphous layer such that the distribution concentration C(O) may be either uniform or ununiform similarly to the distribution state of germanium atoms as described by referring to FIGS. 2 through 10.

In short, the distribution of oxygen atoms when the distribution concentration C(O) in the direction of layer thickness is ununiform may be explained similarly as in case of the germanium atoms by using FIGS. 2 through 10.

In the present invention, the layer region (O) constituting the first amorphous layer, when improvements of photosensitivity and dark resistance are primarily intended, is provided so as to occupy the whole layer region of the first amorphous layer while it is provided so as to occupy the end portion layer region on the support side of the first amorphous layer when reinforcement of adhesion between the support and the first amorphous layer is primarily intended.

In the former case, the content of oxygen atoms in the layer region (O) may be desirably made relatively smaller in order to maintain high photosensitivity, while in the latter case the content may be desirably made relatively large for ensuring reinforcement of adhesion with the support.

Also, for the purpose of accomplishing both of the former and latter objects at the same time, oxygen atoms may be distributed in the layer region (O) so that they may be distributed in a relatively higher concentration on the support side, and in a relatively lower concentration on the free surface side of the second amorphous layer, or no oxygen atom may be positively included in the layer region on the free surface side of the second amorphous layer.

The content of oxygen atoms to be contained in the layer region (O) may be suitably selected depending on the characteristics required for the layer region (O) per se or, when said layer region (O) is provided in direct contact with the support, depending on the organic relationship such as the relation with the characteristics at the contacted interface with said support, and others.

When another layer region is to be provided in direct contact with said layer region (O), the content of oxygen atoms may be suitably selected also with considerations about the characteristics of said another layer region and the relation with the characteristics of the contacted interface with said another layer region.

The content of oxygen atoms in the layer region (O), which may suitably be determined as desired depending on the characteristics required for the photoconductive member to be formed, may be preferably 0.001 to 50 atomic %, more preferably 0.002 to 40 atomic %, most preferably 0.003 to 30 atomic %.

In the present invention, when the layer region (O) occupies the whole region of the first amorphous layer or when, although it does not occupy the whole layer region, the layer thickness $T_O$ of the layer region (O) is sufficiently large relative to the layer thickness T of the first amorphous layer, the upper limit of the content of oxygen atoms in the layer region (O) is desirably be sufficiently smaller than the aforesaid value.

That is, the such a case when the ratio of the layer thickness $T_O$ of the layer region (O) relative to the layer thickness T of the amorphous layer is 2/5 or higher, the upper limit of the content of oxygen atoms in the layer region (O) may preferably be 30 atomic % or less, more preferably 20 atomic % or less, most preferably 10 atomic % or less.

In the present invention, the layer region (O) constituting the first amorphous layer may desirably be provided so as to have a localized region (B) containing oxygen atoms in a relatively higher concentration on the support side as described above, and in this case, adhesion between the support and the first amorphous layer can be further improved.

The localized region (B), as explained in terms of the symbols shown in FIG. 2 through FIG. 10, may be desirably provided within 5μ from the interface position $t_B$.

In the present invention, the above localized region (B) may be made to be identical with the whole layer region ($L_T$) up to the depth of 5μ thickness from the interface position $t_B$, or alternatively a part of the layer region ($L_T$).

It may suitably be determined depending on the characteristics required for the first amorphous layer to be formed, whether the localized region (B) is made a part or whole of the layer region ($L_T$).

The localized region (B) may preferably be formed according to such a layer formation that the maximum, Cmax of the distribution concentration of oxygen atoms in the layer thickness direction may preferably be 500 atomic ppm or more, more preferably 800 atomic ppm or more, most preferably 1000 atomic ppm or more.

That is, the layer region (O) may desirably be formed so that the maximum value, Cmax of the distribution concentration within a layer thickness of 5μ from the support side (the layer region within 5μ thickness from $t_B$).

In the present invention, formation of a first layer region (G) comprising a-SiGe(H, X) may be conducted according to the vacuum deposition method utilizing discharging phenomenon, such as glow discharge method, sputtering method or ion-plating method. For example, for formation of the first layer region (G) comprising a-SiGe(H, X) according to the glow discharge method, the basic procedure comprises introducing a starting gas capable of supplying silicon atoms (Si) and a starting gas capable of supplying germanium atoms (Ge) together with, if necessary, a starting gas for introduction of hydrogen atoms (H) or/and a starting gas for introduction of halogen atoms (X) into the deposition chamber which can be internally brought to a reduced pressure, and exciting glow discharge in said deposition chamber, thereby forming a layer comprising a-SiGe(H, X) on the surface of a support set a predetermined position. For formation of the layer according to the sputtering method, when effecting sputtering by use of two sheets of a target constituted of Si and a target constituted of Ge or one sheet of a target containing a mixture of Si and Ge, in an atmosphere of, for example, an inert gas such as Ar, He, etc. or a gas mixture based on these gases, a gas for introduction of hydrogen atoms (H) or/and halogen atoms (X) may be optionally introduced into the deposition chamber for sputtering.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred with respect to easy handling during layer formation and efficiency for supplying Si.

As the substances which can be starting gases for Ge supply, there may be included gaseous or gasifiable hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$ and the like as effective ones. In particular, for easiness in handling during layer forming operations and efficiency in supplying, $GeH_4$, $Ge_2H_6$ and $Ge_3H_8$ are preferred.

Effective starting gases for introduction of halogen atoms to be used in the present invention may include a large number of halogen compounds, including gaseous or gasifiable halogen compounds, as exemplified by halogen gases, halides, interhalogen compounds, or silane derivatives substituted with halogens.

Further, there may also be included gaseous or gasifiable hydrogenated silicon compounds containing halogen atoms constituted of silicon atoms and halogen atoms as constituent elements as effective ones in the present invention.

Typical examples of halogen compounds preferably used in the present invention may include halogen gases such as of fluorine, chlorine, bromine or iodine, interhalogen compounds such as BrF, ClF, $ClF_3$, $BrF_5$, $BrF_3$, $IF_3$, $IF_7$, ICl, IBr, etc.

As the silicon compounds containing halogen atoms, namely so called silane derivatives substituted with halogens, there may preferably be employed silicon halides such as $SiF_4$, $Si_2F_6$, $SiCl_4$, $SiBr_4$ and the like.

When the characteristic photoductive member of the present invention is to be formed according to the glow discharge method by employment of such a silicon compound containing halogen atoms, it is possible to form a first layer region (G) comprising a-SiGe containing halogen atoms on a certain support without use of a hydrogenated silicon gas as the starting material capable of supplying Si together with a starting gas for Ge supply.

For formation of a first layer region (G) containing halogen atoms according to the glow discharge method, the basic procedure comprises, for example, introducing a silicon halide gas as the starting gas for Si supply, a hydrogenated germanium as the starting gas for Ge supply and a gas such as Ar, $H_2$, He, etc. at a predetermined mixing ratio and gas flow rates into a deposition chamber for formation of the first layer region (G) and exciting glow discharging therein to form a plasma atmosphere of these gases, whereby the first layer region (G) can be formed on a certain support. For the purpose of controlling more easily the ratio of hydrogen atoms introduced, these gases may further be admixed at a desired level with a gas of a silicon compound containing hydrogen atoms.

Also, the respective gases may be used not only as single species but as a mixture of plural species.

For formation of a first layer region (G) comprising a-SiGe(H, X) according to the reactive sputtering method or the ion plating method, for example, in case of the sputtering method, sputtering may be effected by use of two sheets of a target of Si and a target of Ge or one sheet of a target comprising Si and Ge in a certain gas plasma atmosphere; or in case of the ion plating method, a polycrystalline silicon or a single crystalline silicon and a polycrystalline germanium or a single crystalline germanium are each placed as vapor sources in a vapor deposition boat and these vapor sources are vaporized by heating according to the resistance heating method or the electron beam method (EB method), and the resultant flying vaporized product is permitted to pass through the gas plasma atmosphere.

During this procedure, in either of the sputtering method or the ion plating method, introduction of halogen atoms into the layer formed may be effected by introducing a gas of a halogen compound or a silicon compound containing halogen atoms as described above into the deposition chamber and forming a plasma atmosphere of said gas.

Also, for introduction of hydrogen atoms, a starting gas for introduction of hydrogen atoms, such as $H_2$, or a gas of silanes or/and hydrogenated germanium such as those mentioned above may be introduced into the deposition chamber and a plasma atmosphere of said gas may be formed therein.

In the present invention, as the starting gas for introduction of halogen atoms, the halogen compounds or silicon compounds containing halogens as mentioned above can effectively be used. In addition, it is also possible to use a gaseous or gasifiable halide containing hydrogen atom as one of the constituents such as hydrogen halide, including HF, HCl, HBr, HI and the like, halo-substituted hydrogenated silicon, including $SiH_2F_2$, $SiH_2I_2$, $SiH_2Cl_2$, $SiHCl_3$, $SiH_2Br_2$, $SiHBr_3$ and the like, and hydrogenated germanium halides, including $GeHF_3$, $GeH_2F_2$, $GeH_3F$, $GeHCl_3$, $GeH_2Cl_2$, $GeH_3Cl$, $GeHBr_3$, $GeH_2Br_2$, $GeH_3Br$, $GeHI_3$, $GeH_2I_2$, $GeH_3I$ and the like; and gaseous or gasifiable germanium halides such as $GeF_4$, $GeCl_4$, $GeBr_4$, $GeI_4$, $GeF_2$, $GeCl_2$, $GeBr_2$, $GeI_2$, and so on as an effective starting material for formation of a first amorphous layer region (G).

Among these substances, halides containing hydrogen atom, which can introduce hydrogen atoms very effective for controlling electrical or photoelectric characteristics into the layer during formation of the first layer region (G) simultaneously with introduction of halogen atoms, can preferably be used as the starting material for introduction of halogen atoms.

For incorporation of hydrogen atoms structurally into the first layer region (G), other than the above method, $H_2$ or hydrogenated silicon, including $SiH_4$, $Si_2H_6$, $Si_3H_8$ and $Si_4H_{10}$ and the like and germanium or a germanium compound for supplying Ge, or alternatively a hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$ and the like and silicon or a silicon compound for supplying Si may be permitted to be copresent in a deposition chamber, wherein discharging is excited.

In preferred embodiments of this invention, the amount of hydrogen atoms (H) or halogen atoms (X) incorporated in the first layer region (G) constituting the first amorphous layer formed, or total amount of hydrogen atoms and halogen atoms (H+X), may be preferably 0.01 to 40 atomic %, more preferably 0.05 to 30 atomic %, most preferably 0.1 to 25 atomic %.

For controlling the amounts of hydrogen atoms (H) or/and halogen atoms (X) in the first layer region (G), for example, the support temperature or/and the amounts of the starting materials for incorporation of hydrogen atoms (H) or halogen atoms (X) to be introduced into the deposition device system or the discharging power may be controlled.

In the present invention, for formation of the second layer region (S) comprising a-Si(H, X), the starting materials selected from among the starting materials (I) for formation of the first layer region (G) as described above except for the starting material as the starting gas for Ge supply [that is, the starting materials (II) for formation of the second layer region (S)] may be employed, following the same method and conditions in case of formation of the first layer region (G).

That is, in the present invention, formation of a second layer region (S) comprising a-Si(H, X) may be conducted according to the vacuum deposition method utilizing discharging phenomenon, such as glow discharge method, sputtering method or ion-plating method. For example, for formation of the second layer region (S) comprising a-Si(H, X) according to the glow discharge method, the basic procedure comprises introducing a starting gas capable of supplying silicon atoms (Si) together with, if necessary, a starting gas for introduction of hydrogen atoms or/and halogen atoms into the deposition chamber which can be internally brought to a reduced pressure, and exciting glow discharge in said deposition chamber, thereby forming a layer comprising a-Si(H, X) on the surface of a support set a predetermined position. For formation of the layer according to the sputtering method, when effecting sputtering by use of a target constituted of Si in an atmosphere of, for example, an inert gas such as Ar, He, etc. or a gas mixture based on these gases, a gas for introduction of hydrogen atoms (H) or/and halogen atoms (X) may be introduced into the deposition chamber for sputtering.

For formation of a layer region (PN) containing a substance (C) for controlling the conduction characteristics, for example, the group III atoms or the group V atoms by introducing structurally the substance (C) into the layer region constituting the amorphous layer, a starting material for introduction of the group III atoms or a starting material for introduction of the group V atoms may be introduced under gaseous state into the deposition chamber together with other starting materials for forming the first amorphous layer. As such starting materials for introduction of the group III atoms, there may preferably be used gaseous or at least gasifiable compounds under the layer forming conditions. Typical examples of such starting materials for introduction of the group III atoms may include hydrogenated boron such as $B_2H_6$, $B_4H_{10}$, $B_5H_9$, $B_5H_{11}$, $B_6H_{10}$, $B_6H_{12}$, $B_6H_{14}$ and the like, boron halides such as $BF_3$, $BCl_3$, $BBr_3$ and the like for introduction of boron atoms. In addition, there may also be employed $AlCl_3$, $GaCl_3$, $Ga(CH_3)_3$, $InCl_3$, $TlCl_3$, etc.

As the starting material for introduction of the group V atoms to be effectively used in the present invention, there may be mentioned hydrogenated phosphorus such as $PH_3$, $P_2H_4$ and the like, phosphorus halides such as $PH_4I$, $PF_3$, $PF_5$, $PCl_3$, $PCl_5$, $PBr_3$, $PBr_5$, $PI_3$ and the like for introduction of phosphorus atoms. In addition, there may also be included $AsH_3$, $AsF_3$, $AsCl_3$, $AsBr_3$, $AsF_5$, $SbH_3$, $SbF_3$, $SbF_5$, $SbCl_3$, $SbCl_5$, $SiH_3$, $SiCl_3$, $BiBr_3$, etc. also as effective starting materials for introduction of the group V atoms.

For formation of the layer region (O) containing oxygen atoms in the first amorphous layer, a starting material for introduction of oxygen atoms may be used together with the starting material for formation of the first amorphous layer as mentioned above during formation of the layer and may be incorporated in the layer while controlling their amounts. When the glow discharge method is to be employed for formation of the layer region (O), a starting material for introduction of oxygen atoms may be added to the starting material selected as desired from those for formation of the first amorphous layer as mentioned above. As such a starting material for introduction of oxygen atoms, there may be employed most of gaseous or gasifiable substances containing at least oxygen atoms as constituent atoms.

For example, there may be employed a mixture of a starting gas containing silicon atoms (Si) as constituent atoms, a starting gas containing oxygen atoms (O) as constituent atoms and optionally a starting gas containing hydrogen atoms (H) or/and halogen atoms (X) as constituent atoms at a desired mixing ratio; a mixture of a starting gas containing silicon atoms (Si) as constituent atoms and a starting gas containing oxygen atoms (O) and hydrogen atoms (H) as constituent atoms also at a desired mixing ratio; or a mixture of a starting gas containing silicon atoms (Si) as constituent atoms and a starting gas containing the three atoms of silicon atoms (Si), oxygen atoms (O) and hydrogen atoms (H) as constituent atoms.

Alternatively, there may also be employed a mixture of a starting gas containing silicon atoms (Si) and hydrogen atoms (H) as constituent atoms and a starting gas containing oxygen atoms (O) as constituent atoms.

More specifically, there may be mentioned, for example, oxygen ($O_2$), ozone ($O_3$), nitrogen monooxide (NO), nitrogen dioxide ($NO_2$), dinitrogen monooxide ($N_2O$), dinitrogen trioxide ($N_2O_3$), dinitrogen tetraoxide ($N_2O_4$), dinitrogen pentaoxide ($N_2O_5$), nitrogen trioxide ($NO_3$), and lower siloxanes containing silicon atoms (Si), oxgen atoms (O) and hydrogen atoms (H) as constituent atoms such as disiloxane $H_3SiOSiH_3$, trisiloxane $H_3SiOSiH_2OSiH_3$, and the like.

For formation of the layer region (O) containing oxygen atoms according to the sputtering method, a single crystalline or polycrystalline Si wafer or $SiO_2$ wafer or a wafer containing Si and $SiO_2$ mixed therein may be employed and sputtering of these wafers may be conducted in various gas atmosphere.

For example, when Si wafer is employed as the target, a starting gas for introduction of oxygen atoms optionally together with a starting gas for introduction of hydrogen atoms or/and halogen atoms, which may optionally be diluted with a diluting gas, may be introduced into a deposition chamber for sputtering to form gas plasma of these gases, in which sputtering with the aforesaid Si wafer may be effected.

Alternatively, by use of separate targets of Si and $SiO_2$ or one sheet of a target containing Si and $SiO_2$ mixed therein, sputtering may be effected in an atmosphere of a diluting gas as a gas for sputtering or in a gas atmosphere containing at least hydrogen atoms (H) or/and halogen atoms (X) as constituent atoms. As the starting gas for introduction of oxygen atoms, there may be employed the starting gases shown as examples in the glow discharge method previously described also as effective gases in case of sputtering.

In the present invention, when providing a layer region (O) containing oxygen atoms during formation of the first amorphous layer, formation of the layer region (O) having a desired distribution state (depth profile) of oxygen atoms in the direction of layer thickness formed by varying the distribution concentration C(O) of oxygen atoms contained in said layer region (O) may be conducted in case of glow discharge by introducing a starting gas for introduction of oxygen atoms into a deposition chamber, while varying suitably its gas flow rate according to a desired change rate curve. For example, by the manual method or any other method conventionally used such as an externally driven motor, etc., the opening of a certain needle valve provided in the course of the gas flow channel system may be gradually varied. During this procedure, the rate of variation in the gas flow rate is not necessarily required to be linear, but the gas flow rate may be controlled according to a variation rate curve previously designed by means of, for example, a microcomputer to give a deisred content curve.

In case when the layer region (O) is formed by the sputtering method, a first method for formation of a desired distribution state (depth profile) of oxygen atoms in the direction of layer thickness by varying the distribution concentration C(O) of oxygen atoms in the direction of layer thickness may be performed similarly as in case of the glow discharge method by employing a starting material for introduction of oxygen atoms under gaseous state and varying suitably as desired the gas flow rate of said gas when introduced into the deposition chamber.

Secondly, formation of such a depth profile can also be achieved by previously changing the composition of a target for sputtering. For example, when a target comprising a mixture of Si and $SiO_2$ is to be used, the mixing ratio of Si to $SiO_2$ may be varied in the direction of layer thickness of the target.

The support to be used in the present invention may be either electroconductive or insulating. As the electroconductive material, there may be mentioned metals such as NiCr, stainless steel, Al, Cr, Mo, Au, Nb, Ta, V, Ti, Pt, Pd etc. or alloys thereof.

As insulating supports, there may usually be used films or sheets of synthetic resins, including polyester, phlyethylene, polycarbonate, cellulose acetate, polypropylene, polyvinyl chloride, polyvinylidene chloride, polystyrene, polyamide, etc., glasses, ceramics, papers and so on. These insulating supports should preferably have at least one surface subjected to electroconductive treatment, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO ($IN_2O_3+SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface. The support may be shaped in any form such as cylinders, belts, plates or others, and its form may be determined as desired. For example, when the photoconductive member 100 in FIG. 1 is to be used as an image forming member for electrophotography, it may desirably be formed into an endless belt or a cylinder for use in continuous high speed copying. The support may have a thickness, which is conveniently determined so that a photoconductive member as desired may be formed. When the photoconductive member is required to have a flexibility, the support is made as thin as possible, so far as the function of a support can be exhibited. However, in such a case, the thickness is generally 10$\mu$ or more from the points of fabrication and handling of the support as well as its mechanical strength.

The second amorphous layer (II) 105 formed on the first amorphous layer (I) 102 in the photoconductive member 100 as shown in FIG. 1 has a free surface and provided primarily for the purpose of accomplishing the objects of the present invention with respect to humidity resistance, continuous and repeated use characteristics, dielectric strength, environmental characteristics during use and durability.

Also, in the present invention, since each of the amorphous materials forming the first amorphous layer (I) 102 and the second amorphous layer (II) 105 have the common constituent of silicon atom, chemical stability is sufficiently ensured at the laminated interface.

The second amorphous layer (II) comprises an amorphous material containing silicon atoms (Si), carbon atoms (C) and optionally hydrogen atoms (H) or/and halogen atoms (X) (hereinafter written as "a-$(Si_xC_{1-x})_y(H,X)_{1-y}$, where $0<x, y<1$).

Formation of the second amorphous layer (II) comprising a-$(Si_xC_{1-x})_y(H,X)_{1-y}$ may be performed according to the glow discharge method, the sputtering method, the ion implantation method, the ion plating method, the electron beam method, etc. These preparation methods may be suitably selected depending on various factors such as the preparation conditions, the degree of the load for capital investment for installations, the production scale, the desirable characteristics required for the photoconductive member to be prepared, etc. For the advantages of relatively easy control of the preparation conditions for preparing photoconductive members having desired characteristics and easy introduction of silicon atoms and carbon atoms, optionally together with hydrogen atoms or halogen atoms, into the second amorphous layer (II) to be prepared, there may preferably be employed the glow discharge method or the sputtering method.

Further, in the present invention, the second amorphous layer (II) may be formed by using the glow discharge method and the sputtering method in combination in the same device system.

For formation of the second amorphous layer (II) according to the glow discharge method, starting gases for formation of a-$(Si_xC_{1-x})_y(H,X)_{1-y}$, optionally mixed at a predetermined mixing ratio with diluting gas, may be introduced into a deposition chamber for vacuum deposition in which a support is placed, and the gas introduced is made into a gas plasma by excitation of glow discharging, thereby depositing a-$(Si_xC_{1-x})_y(H,X)_{1-y}$ on the first amorphous layer (I) which has already been formed on the aforesaid support.

As the starting gases for formation of a-$(Si_xC_{1-x})_y(H,X)_{1-y}$ to be used in the present invention, it is possible to use most of gaseous substances or gasified gasifiable substances containing at least one of Si, C, H and X as constituent atoms.

In case when a starting gas having Si as constituent atoms as one of Si, C, H and X is employed, there may be employed, for example, a mixture of a starting gas containing Si as constituent atom, and a starting gas containing C as constituent atom, and optionally a starting gas containing H as constituent atom or/and a starting gas containing X as constituent atom at a desired mixing ratio, or alternatively a mixture of a starting gas containing Si as constituent atoms and a starting gas containing C and H as constituent atoms or/and a starting gas containing C and X as constituent atoms also at a desired mixing ratio, or a mixture of a starting gas containing Si as constituent atoms and a gas containing three atoms of Si,C and H as constituent atoms or a gas containing three atoms of Si, C and X as constituent atoms.

Alternatively, it is also possible to use a mixture of a starting gas containing Si and H as constituent atoms with a starting gas containing C as constituent atom, or a mixture of a starting gas containing Si and X as constituent atoms with a starting gas containing C as constituent atom.

In the present invention, preferable halogen atoms (X) to be contained in the second amorphous layer (II) are F, Cl, Br and I, particularly preferably F and Cl.

In the present invention, the compounds which can be effectively used as starting gases for formation of the second amorphous layer (II) may include those which are gaseous at normal temperature and normal pressure or can be easily be gasified.

In the present invention, the starting gases effectively used for formation of the second amorphous layer (II) may include hydrogenated silicon gases containing Si and H as constituent atoms such as silanes (e.g. $SiH_4$, $Si_2H_6$, $Si_3H_8$, $Si_4H_{10}$, etc.), compounds containing C and H as constituent atoms such as saturated hydrocarbons having 1 to 5 carbon atoms, ethylenic hydrocarbons having 2 to 5 carbon atoms and acetylenic hydrocarbons having 2 to 4 carbon atoms, single halogen substances, hydrogen halides, interhalogen compounds, silicon halides, halo-substituted hydrogenated silicons, hydrogenated silicons and the like.

More specifically, there may be included, as saturated hydrocarbons, methane ($CH_4$), ethane ($C_2H_6$), propane ($C_3H_8$), n-butane (n-$C_4H_{10}$), pentane ($C_5H_{12}$); as ethylenic hydrocarbons, ethylene ($C_2H_4$), propylene ($C_3H_6$), butene-1 ($C_4H_8$), butene-2 ($C_4H_8$), isobutylene ($C_4H_8$), pentene ($C_5H_{10}$); as acetylenic hydrocarbons, acetylene ($C_2H_2$), methyl acetylene ($C_3H_4$), butyne ($C_4H_6$); as single halogen substances, halogen gases such as of fluorine, chlorine, bromine and iodine; as hydrogen halides, HF, HI, HCl, HBr; as interhalogen compounds BrF, ClF, $ClF_3$, $ClF_5$, $BrF_5$, $BrF_3$, $IF_7$, $IF_5$, ICl, IBr; as silicon halides, $SiF_4$, $Si_2F_6$, $SiCl_4$, $SiCl_3Br$, $SiCl_2Br_2$, $SiClBr_3$, $SiCl_3I$, $SiBr_4$, as halo-substituted hydrogenated silicon, $SiH_2F_2$, $SiH_2Cl_2$, $SiHCl_3$, $SiH_3Cl$, $SiH_3Br$, $SiH_2Br_2$, $SiHBr_3$; as hydrogenated silicon, silanes such as $SiH_4$, $Si_2H_6$, $Si_4H_{10}$, etc; and so on.

In addition to these materials, there may also be employed halo-substituted paraffinic hydrocarbons such as $CF_4$, $CCl_4$, $CBr_4$, $CHF_3$, $CH_2F_2$, $CH_3F$, $CH_3Cl$, $CH_3Br$, $CH_3I$, $C_2H_5Cl$ and the like, fluorinated sulfur compounds such as $SF_4$, $SF_6$ and the like; alkyl silanes such as $Si(CH_3)_4$, $Si(C_2H_5)_4$, etc.; halo-containing alkyl silanes such as $SiCl(CH_3)_3$, $SiCl_2(CH_3)_2$, $SiCl_3CH_3$ and the like, as effective materials.

These materials for forming the second amorphous layer (II) may be selected and employed as desired during formation of the second amorphous layer (II) so that silicon atoms, carbon atoms, and halogen atoms and optionally hydrogen atoms may be contained at a desired composition ratio in the second amorphous layer (II) to be formed.

For example, $Si(CH_3)_4$ capable of incorporating easily silicon atoms, carbon atoms and hydrogen atoms and forming a layer with desired characteristics together with a material for incorporation of halogen atoms such as $SiHCl_3$, $SiH_2Cl_2$, $SiCl_4$ or $SiH_3Cl$, may be introduced at a certain mixing ratio under gaseous state into a device for formation of the second amorphous layer (II), wherein glow discharging is excited thereby to form a second amorphous layer (II) comprising a-$(Si_xC_{1-x})_y(Cl+H)_{1-y}$.

For formation of the second amorphous layer (II) according to the sputtering method, a single crystalline or polycrystalline Si wafer or C wafer or a wafer containing Si and C mixed therein is used as target and subjected to sputtering in an atmosphere of various gases containing, if desired, halogen atoms or/and hydrogen atoms as constituent atoms.

For example, when Si wafer is used as target, a starting gas for introducing C and H or/and X, which may be diluted with a diluting gas, if desired, may be introduced into a deposition chamber for sputter to form a gas plasma therein and effect sputtering with said Si wafer.

Alternatively, Si and C as separate targets or one sheet target of a mixture of Si and C can be used and sputtering is effected in a gas atmosphere containing, if necessary, hydrogen atoms or/and halogen atoms. As the starting gas for introduction of C, H and X, there may be employed the materials for formation of the second amorphous layer (II) as mentioned in the glow discharge as described above as effective gases also in case of sputtering.

In the present invention, as the diluting gas to be used in forming the second amorphous layer (II) by the glow discharge method or the sputtering method, there may preferably be employed so called rare gases such as He, Ne, Ar and the like.

The second amorphous layer (II) in the present invention should be carefully formed so that the required characteristics may be given exactly as desired.

That is, a substance containing as constituent atoms Si, C and, if necessary, H or/and X can take various forms from crystalline to amorphous, electrical properties from conductive through semiconductive to insulating and photoconductive properties from photoconductive to non-photoconductive depending on the preparation conditions. Therefore, in the present invention, the preparation conditions are strictly selected as desired so that there may be formed a-$(Si_xC_{1-x})_y(H,X)_{1-y}$ having desired characteristics depending on the purpose. For example, when the second amorphous layer (II) is to be provided primarily for the purpose of improvement of dielectric strength, a-$(Si_xC_{1-x})_y(H,X)_{1-y}$ is prepared as an amorphous material having marked electric insulating behaviours under the usage conditions.

Alternatively, when the primary purpose for provision of the second amorphous layer (II) is improvement of continuous repeated use characteristics or environmental use characteristics, the degree of the above electric insulating property may be alleviated to some extent and a-$(Si_xC_{1-x})_y(H,X)_{1-y}$ may be prepared as an amorphous material having sensitivity to some extent to the light irradiated.

In forming the second amorphous layer (II) comprising a-$(Si_xC_{1-x})_y(H,X)_{1-y}$ on the surface of the first amorphous layer (I), the support temperature during layer formation is an important factor having influences on the structure and the characteristics of the layer to be formed, and it is desired in the present invention to control severely the support temperature during layer formation so that a-$(Si_xC_{1-x})_y(H,X)_{1-y}$ having intended characteristics may be prepared as desired.

As the support temperature in forming the second amorphous layer (II) for accomplishing effectively the objects in the present invention, there may be selected suitably the optimum temperature range in conformity with the method for forming the second amorphous layer in carrying out formation of the second amorphous layer (II). Preferably, however, the support temperature may be 20° to 400° C., more preferably 50° to 350° C., most preferably 100° to 300° C. For formation of the second amorphous layer (II), the glow discharge method or the sputtering method may be advantageously adopted, because severe control of the composition ratio of atoms constituting the layer or control of layer thickness can be conducted with relative ease as compared with other methods. In case when the second amorphous layer (II) is to be formed according to these layer forming methods, the discharging power during layer formation is one of important factors influencing the characteristics of a-$(Si_xC_{1-x})_y(H,X)_{1-y}$ to be prepared, similarly as the aforesaid support temperature.

The discharging power condition for preparing effectively a-$(Si_xC_{1-x})_y(H,X)_{1-y}$ having characteristics for accomplishing the objects of the present invention with good productivity may preferably be 10 to 300 W, more preferably 20 to 250 W, most preferably 50 to 200 W.

The gas pressure in a deposition chamber may preferably be 0.01 to 1 Torr, more preferably 0.1 to 0.5 Torr.

In the present invention, the above numerical ranges may be mentioned as preferable numerical ranges for the support temperature, discharging power, etc. However, these factors for layer formation are not determined separately independently of each other, but it is desirable that the optimum values of respective layer forming factors may be determined desirably based on mutual organic relationships so that a second amorphous layer II comprising a-$(Si_xC_{1-x})_y(H,X)_{1-y}$ having desired characteristics may be formed.

The content of carbon atoms in the second amorphous layer (II) in the photoconductive member of the present invention is an important factor for obtaining the desired characteristics to accomplish the objects of the present invention, similarly as the conditions for preparation of the second amorphous layer (II).

The content of carbon atoms in the second amorphous layer (II) may be suitably determined depending on the kind of amorphous material for forming said layer and its property.

That is, the amorphous material represented by the above formula a-$(Si_xC_{1-x})_y(H,X)_{1-y}$ may be classified broadly into an amorphous material constituted of silicon atoms and carbon atoms (hereinafter written as "a-$Si_aC_{1-a}$", where $0<a<1$), an amorphous material constituted of silicon atoms, carbon atoms and hydrogen atoms (hereinafter written as "a-$(Si_bC_{1-b})_cH_{1-c}$, where $0<b, c<1$) and an amorphous material constituted of silicon atoms, carbon atoms and halogen atoms and optionally hydrogen atoms (hereinafter written as "a-$(Si_dC_{1-d})_e(H,X)_{1-e}$", where $0<d, e<1$).

In the present invention, the content of carbon atoms contained in the second amorphous layer (II), when it is constituted of a-$Si_aC_{1-a}$, may be preferably $1\times10^{-3}$ to 90 atomic %, more preferably 1 to 80 atomic %, most preferably 10 to 75 atomic %. That is, in terms of the aforesaid representation a in the formula a-$Si_aC_{1-a}$, a may be preferably 0.1 to 0.99999, more preferably 0.2 to 0.99, most preferably 0.25 to 0.9.

In the present invention, when the second amorphous layer (II) is constituted of a-$(Si_bC_{1-b})_cH_{1-c}$, the content of carbon atoms contained in said layer (II) may be preferably $1\times10^{-3}$ to 90 atomic %, more preferably 1 to 90 atomic %, most preferably 10 to 80 atomic %. The content of hydrogen atoms may be preferably 1 to 40 atomic %, more preferably 2 to 35 atomic %, most preferably 5 to 30 atomic %. A photoconductive member formed to have a hydrogen atom content within these ranges is sufficiently applicable as an excellent one in practical applications.

That is, in terms of the representation by a-$(Si_bC_{1-b})_cH_{1-c}$, b may be preferably 0.1 to 0.99999, more preferably 0.1 to 0.99, most preferably 0.15 to 0.9, and c preferably 0.6 to 0.99, more preferably 0.65 to 0.98, most preferably 0.7 to 0.95.

When the second amorphous layer (II) is constituted of a-$(Si_dC_{1-d})_e(H,X)_{1-e}$, the content of carbon atoms contained in said layer (II) may be preferably $1\times10^{-3}$ to 90 atomic %, more preferably 1 to 90 atomic %, most preferably 10 to 80 atomic %. The content of halogen atoms may be preferably 1 to 20 atomic %, more preferably 1 to 18 atomic %, most preferably 2 to 15 atomic %. A photoconductive member formed to have a halogen atom content within these ranges is sufficiently applicable as an excellent one in practical applications. The content of hydrogen atoms to be optionally contained may be preferably 19 atomic % or less, more preferably 13 atomic % or less.

That is, in terms of the representation by a-$(Si_dC_{1-d})_e(H,X)_{1-e}$, d may be preferably 0.1 to 0.99999, more preferably 0.1 to 0.99, most preferably 0.15 to 0.9, and e preferably 0.8 to 0.99, more preferably 0.82 to 0.99, most preferably 0.85 to 0.98.

The range of the numerical value of layer thickness of the second amorphous layer (II) is one of important factors for accomplishing effectively the objects of the present invention.

It may be desirably determined depending on the intended purpose so as to effectively accomplish the objects of the present invention.

The layer thickness of the second amorphous layer (II) is required to be determined as desired suitably with due considerations about the relationships with the contents of carbon atoms, the layer thickness of the first amorphous layer (I), as well as other organic relationships with the characteristics required for respective layer regions. In addition, it is also desirable to have considerations from economical point of view such as productivity or capability of mass production.

The second amorphous layer (II) in the present invention is desired to have a layer thickness preferably of 0.003 to 30μ, more preferably 0.004 to 20μ, most preferably 0.005 to 10μ.

Next, an example of the process for producing the photoconductive member of this invention is to be briefly described.

Figure 11:
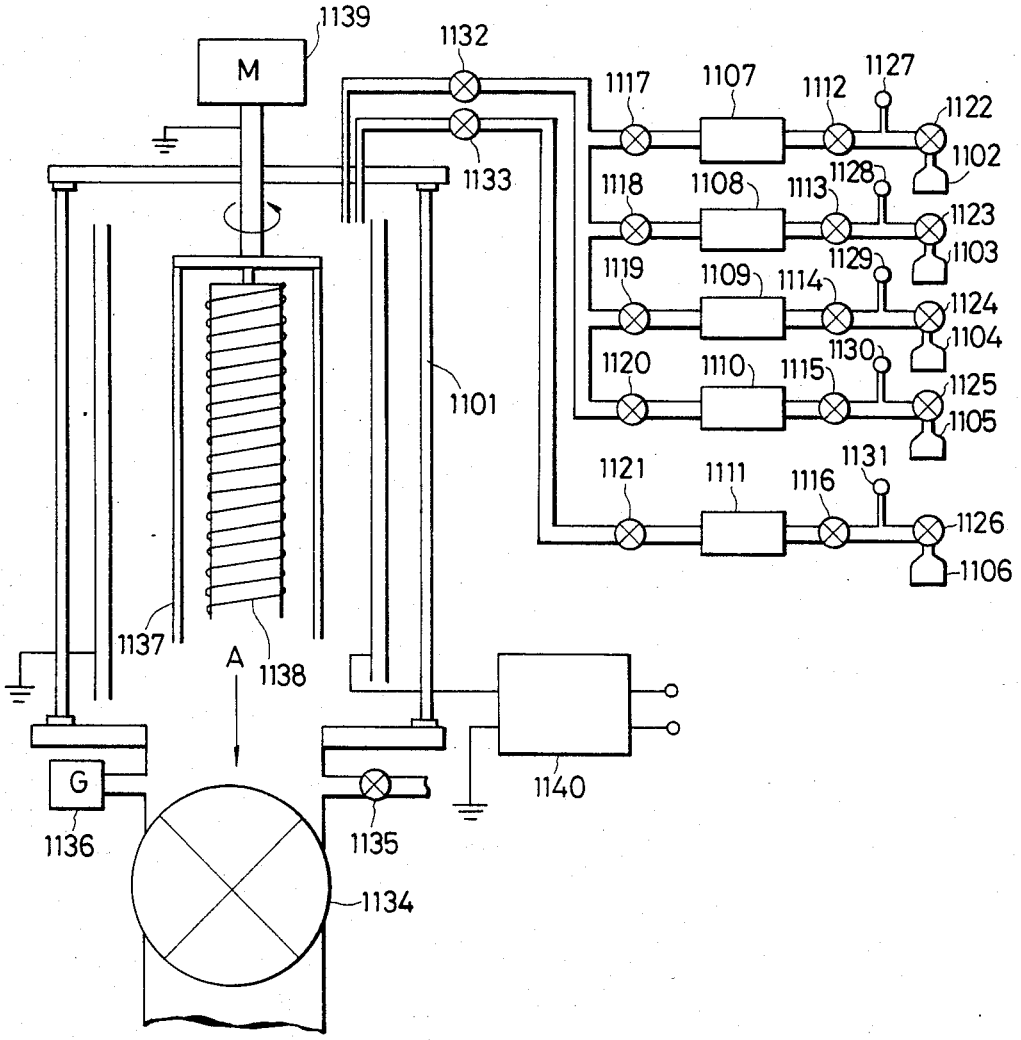
FIG. 11 a schematic flow chart for illustration of the device used in the present invention.

FIG. 11 shows one example of a device for producing a photoconductive member.

In the gas bombs 1102–1106 there are hermetically contained starting gases for formation of the photoconductive member of the present invention. For example, 1102 is a bomb containing $SiH_4$ gas (purity: 99.999%) diluted with He (hereinafter abbreviated as "$SiH_4$/He"), 1103 is a bomb containing $GeH_4$gas (purity: 99.999%) diluted with He (hereinafter abbreviated as "$GeH_4$/He"), 1104 is a bomb containing $SiF_4$ gas (purity: 99.99%) diluted with He (hereinafter abbreviated as "$SiF_4$/He"), 1105 is a bomb containing NO gas (purity: 99.999%) and 1106 is a bomb containing $C_2H_4$ gas (purity: 99.999%).

For allowing these gases to flow into the reaction chamber 1101, on confirmation of the valves 1122–1126 of the gas bombs 1102–1106 and the leak valve 1135 to be closed, and the inflow valves 1112–1116, the outflow valves 1117–1121 and the auxiliary valves 1132, 1133 to be opened, the main valve 1134 is first opened to evacuate the reaction chamber 1101 and the gas pipelines. As the next step, when the reading on the vacuum indicator 1136 becomes about $5\times10^{-6}$ Torr, the auxiliary valves 1132, 1133 and the outflow valves 1117–1121 are closed.

Referring now to an example of forming a first amorphous layer (I) on the cylindrical substrate 1137, $SiH_4$/He gas from the gas bomb 1102, $GeH_4$/He gas from the gas bomb 1103 and NO gas from the gas bomb 1105 are permitted to flow into the mass-flow controllers 1107, 1108, 1110 by opening the valves 1122, 1123, 1125, respectively, and controlling the pressures at the outlet pressure gauges 1127, 1128, 1130 to 1 Kg/cm$^2$ and opening gradually the inflow valves 1112, 1113, 1115. Subsequently, the outflow valves 1117, 1118, 1120 and the auxiliary valve 1132 are gradually opened to permit respective gases to flow into the reaction chamber 1101. The outflow valves 1117, 1118, 1120 are controlled so that the flow rate ratio of $SiH_4$/He, $GeH_4$/He, and NO may have a desired value and opening of the main valve 1134 is also controlled while watching the reading on the vacuum indicator 1136 so that the pressure in the reaction chamber 1101 may reach a desired value. And, after confirming that the temperature of the substrate 1137 is set at 50°–400° C. by the heater 1138, the power source 1140 is set at a desired power to excite glow discharge in the reaction chamber 1101. The glow discharging is maintained for a desired period of time until a first layer region (G) is formed on the substrate 1137. At the stage when the first layer regin (G) is formed to a desired layer thickness, following the same conditions and the procedure as in formation of the first layer region except for closing completely the outflow valve 1118 and changing the discharging conditions, if desired, glow discharging is maintained for a desired period of time, whereby a second layer region (S) containing substantially no germanium atom can be formed on the first layer region (G).

For incorporation of a substance for controlling the conduction characteristics in the first layer region (G), the second layer region (S) or both thereof, a gas such as $B_2H_6$, $PH_3$ etc. may be added into the gases to be introduced into the deposition chamber 1101 during formation of respective layer regions.

For incorporating halogen atoms into the first amorphous layer (I), for example $SiF_4$ gas may be further added to the above gases to excite the glow discharge.

Further, for incorporating halogen atoms instead of hydrogen atoms into the first amorphous layer (I), $SiF_4$/He gas and $GeF_4$/He gas may be employed in place of $SiH_4$/He gas and $GeH_4$/He gas.

Formation of a second amorphous layer (II) on the first amorphous layer (I) which have been formed to a desired thickness may be carried out according to the same valve operation as in case of formation of the first amorphous layer (I), for example, by permitting $SiH_4$ gas, and $C_2H_4$ gas, optionally diluted with a diluting gas such as He, to flow into the reaction chamber and exciting glow discharging in said chamber following the desired conditions.

For incorporation of halogen atoms in the second amorphous layer (II), for example, $SiF_4$ gas and $C_2H_4$ gas, or a mixture of these gases with $SiH_4$ gas may be employed and the second amorphous layer (II) can be formed similarly as described above.

Needless to say, outflow valves other than those for the gas bombs used in forming the respective layers are all closed. Further, for the purpose of avoiding the gas for formation of the previous layer from remaining in the chamber 1101 and the gas pipelines from the outflow valves 1117–1121 to the chamber 1101, the inside of the system is once brought to high vacuum state, if necessary, by closing the ouflow valves 1117–1121, opening the auxiliary valves 1132, 1133 and fully opening the main valve 1134.

The content of carbon atoms to be contained in the second amorphous layer (II) can be controlled as desired by, for example, varying the flow rate ratio of $SiH_4$ gas to $C_2H_4$ gas to be introduced into the reaction chamber 1101 when layer formation is effected by glow discharge; or, when layer formation is done by sputtering, by varying the sputter area ratio of silicon wafer to graphite wafer when forming a target or by varying the mixing ratio of silicon powder to graphite powder in molding of target. The content of halogen atoms (X) to be contained in the second amorphous layer (II) may be controlled by controlling the flow rate of a starting gas for introduction of halogen atoms, for example, $SiF_4$ gas into the reaction chamber 1101.

In the course of layer formation, for the purpose of effecting uniform layer formation, the substrate 1137 may desirably be rotated at a constant speed by a motor 1139.

The photoconductive member of the present invention designed to have layer constitution as described above can overcome all of the problems as mentioned above and exhibit very excellent electrical, optical, photoconductive characteristics, dielectric strength and good environmental characteristics in use.

In particular, when it is applied as an image forming member for electrophotography, it is free from any influence of residual potential on image formation at all, being stable in its electrical properties with high sensitivity and having high SN ratio as well as excellent light fatigue resistance and repeated usage characteristics, whereby it is possible to obtain stably and repeatedly images of high quality with high concentration, clear halftone and high resolution.

Further, the photoconductive member of the present invention is high in photosensitivity in the entire visible light region, particularly excellent in matching to a semiconductor laser and rapid in light response.

EXAMPLE 1

By means of the preparation device as shown in FIG. 11, layers were formed on a cylindrical aluminum substrate under the conditions as indicated in Table A1 to obtain an image forming member for electrophotography.

The image forming member thus obtained was set in a charging-exposure experimental device, subjected to corona charging at ⊖5.0 KV for 0.3 sec., followed immediately by irradiation of a light image. As the light source, a tungsten lamp was employed and irradiation was effected at 2 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper subjected to corona charging at ⊖5.0 KV, there was obtained a clear image with high density which was excellent in resolution and good in halftone reproducibility.

EXAMPLE 2

By means of the preparation device as shown in FIG. 11, layers were formed in the same manner as in Example 1 except that the conditions were changed to those as shown in Table A2 to obtain an image forming member for electrophotography.

Using the thus obtained image forming member, images were formed on transfer papers according to the same procedure and under the same conditions as in Example 1 except that the polarity in corona charging and the charged polarity of the developer were made opposite to those in Example 1, respectively, to obtain a very clear image quality.

EXAMPLE 3

By means of the preparation device as shown in FIG. 11, layers were formed in the same manner as in Example 1 except that the conditions were changed to those as shown in Table A3 to obtain an image forming member for electrophotography.

Using the thus obtained image forming member, images were formed on transfer papers according to the same procedure and under the same conditions as in Example 1 to obtain a very clear image quality.

EXAMPLE 4

Layer formation was conducted in entirely the same manner as in Example 1 except that the content of germanium atoms in the first layer was varied by varying the flow rate ratio of $GeH_4$/He gas to $SiH_4$/He gas as shown in Table A4 to prepare image forming members for electrophotography, respectively.

Using the image forming members thus obtained, images were formed on transfer papers according to the same procedure under the same conditions as in Example 1 to obtain the results as shown in Table A4.

EXAMPLE 5

Respective image forming members were prepared in the same manner as in Example 1 except that the layer thickness of the first layer constituting the amorphous layer (I) was varied as shown in Table A5.

Using the image forming members thus obtained, images were formed on transfer papers according to the same procedure under the same conditions as in Example 1 to obtain the results as shown in Table A5.

EXAMPLE 6

By means of the preparation device as shown in FIG. 11, layers were formed on a cylindrical aluminum substrate under the conditions as indicated in Table A6 to obtain an image forming member for electrophotography.

The image forming member thus obtained was set in a charging-exposure experimental device, subjected to corona charging at ⊖5.0 KV for 0.3 sec., followed immediately by irradiation of a light image. As the light source, a tungsten lamp was employed and irradiation was effected at 2 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper with corona charging at ⊖5.0 KV, there was obtained a clear image with high density which was excellent in resolution and good in halftone reproducibility.

EXAMPLE 7

Using an image forming member for electrophotography prepared under the same conditions as in Example 1, evaluation of the image quality was performed for the transferred tone images formed under the same toner image forming conditions as in Example 1 except that electrostatic images were formed by use of a GaAs system semiconductor laser (10 mW) at 810 nm in place of the tungsten lamp as the light source. As the result, there could be obtained clear images of high quality which are excellent in resolution and good in halftone reproducibility.

EXAMPLE 8

Image forming members for electrophotography (23 samples of Sample Nos. 8-201A to 8-208A, 8-301A to 8-308A and 8-601A to 8-608A) were prepared by following the same conditions and procedures as in Examples 2, 3 and 5, respectively, except that the conditions for preparation of the amorphous layer (II) were changed to the respective conditions as shown in Table A7 below.

The image forming members thus obtained were individually set in a copier, subjected to corona charging at ⊖5.0 KV for 0.2 sec., followed immediately by irradiation of a light image. As the light source, a tungsten lamp was employed and irradiation was effected at 1.0 lux.sec. The latent image was developed with a positively charged developer (containing toner and carrier) and transferred onto a plain paper. The transferred image was found to be very good. The toner not transferred remaining on the image forming member for electrophotography was subjected to cleaning with a rubber blade. Such steps were repeated for 100,000 times or more, but no deterioration of image was observed in any case.

The results of the overall image quality evaluation of the transferred image and evaluation of durability by repeated continuous usage are listed in Table A8.

EXAMPLE 9

Image forming members were prepared, respectively, according to the same method as in Example 1, except that the content ratio of silicon atoms to carbon atoms was varied in the amorphous layer (II) by varying the area ratio of silicon wafer to graphite during formation of the amorphous layer (II). For each of the thus prepared image forming members, the steps of image making, development and cleaning as described in Example 1 were repeated for about 50,000 times, followed by image evaluation, to obtain the results as shown in Table A9.

EXAMPLE 10

Image forming members were prepared, respectively, according to the same method as in Example 1, except that the content ratio of silicon atoms to carbon atoms was varied in the amorphous layer (II) by varying the flow rate ratio of $SiH_4$ gas to $C_2H_4$ gas during formation of the amorphous layer (II). For each of the thus prepared image forming members, the steps to transfer as described in Example 1 were repeated for about 50,000 times, followed by image evaluation, to obtain the results as shown in Table A10.

EXAMPLE 11

Image forming members were prepared, respectively, according to the same method as in Example 1, except that the content ratio of silicon atoms to carbon atoms was varied in the amorphous layer (II) by varying the flow rate ratio of $SiH_4$ gas:$SiF_4$ gas:$C_2H_4$ gas during formation of the amorphous layer (II). For each of the thus prepared image forming members, the steps of image making, development and cleaning as described in Example 1 were repeated for about 50,000 times, followed by image evaluation, to obtain the results as shown in Table A11.

EXAMPLE 12

Image forming members were prepared according to the same method as in Example 1, except that the layer thickness of the amorphous layer (II) was varied. For each sample, the steps of image-making, development and cleaning as described in Example 1 were repeated to obtain the results shown in Table A12.

EXAMPLE 13

By means of the preparation device as shown in FIG. 11, an image forming member for electrophotography was formed on a cylindrical aluminum substrate under the conditions as indicated in Table B1.

The image forming member thus obtained was set in a charging-exposure experimental device, subjected to corona charging at ⊖5.0 KV for 0.3 sec., followed immediately by irradiation of a light image. As the light source, a tungsten lamp was employed and irradiation was effected at 2 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper with corona charging at ⊖5.0 KV, there was obtained a clear image with high density which was excellent in resolution and good in halftone reproducibility.

EXAMPLE 14

By means of the preparation device as shown in FIG. 11, an image forming member for electrophotography was formed in the same manner as in Example 13 except that the conditions were changed to those as shown in Table B2.

Using the thus obtained image forming member, images were formed on transfer papers according to the same procedure and under the same conditions as in Example 13 except that the polarity in corona charging and the charged polarity of the developer were made opposite to those in Example 13, respectively, to obtain a very clear image quality.

EXAMPLE 15

By means of the preparation device as shown in FIG. 11, an image forming member for electrophotography was formed in the same manner as in Example 13 except that the conditions were changed to those as shown in Table B3.

Using the thus obtained image forming member, images were formed on transfer papers according to the same procedure and under the same conditions as in Example 13 to obtain a very clear image quality.

EXAMPLE 16

Layer formation was conducted in entirely the same manner as in Example 13 except that the content of germanium atoms in the first layer was varied by varying the flow rate ratio of $GeH_4$/He gas to $SiH_4$/He gas as shown in Table B4 to prepare image forming members for electrophotography, respectively.

Using the image forming members thus obtained, images were formed on transfer papers according to the same procedure under the same conditions as in Example 13 to obtain the results as shown in Table B4.

EXAMPLE 17

Layer formation was conducted in entirely the same manner as in Example 13 except that the layer thickness of the first layer was varied as shown in Table B5 to prepare image forming members for electrophotography, respectively.

Using the image forming members thus obtained, images were formed on transfer papers according to the same procedure under the same conditions as in Example 13 to obtain the results as shown in Table B5.

EXAMPLE 18

By means of the preparation device as shown in FIG. 11, an image forming member for electrophotography was formed on a cylindrical aluminum substrate in the same manner as in Example 13 except that the first amorphous layer (I) was formed under the conditions as indicated in Table B6.

The image forming member thus obtained was set in a charging-exposure experimental device, subjected to corona charging at ⊖5.0 KV for 0.3 sec., followed immediately by irradiation of a light image. As the light source, a tungsten lamp was employed and irradiation was effected at 2 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper with corona charging at ⊖5.0 KV, there was obtained a clear image with high density which was excellent in resolution and good in halftone reproducibility.

EXAMPLE 19

Using an image forming member for electrophotography prepared under the same conditions as in Example 13, evaluation of the image quality was performed for the transferred toner images formed under the same toner image forming conditions as in Example 13 except that electrostatic image were formed by use of a GaAs system semiconductor laser (10 mW) at 810 nm in place of the tungsten lamp as the light source. As the result, there could be obtained clear images of high quality which were excellent in resolution and good in halftone reproducibility.

EXAMPLE 20

Image forming members for electrophotography (24 samples of Sample Nos. 12-201B to 12-208B, 12-301B to 12-308B and 12-601B to 12-608B) were prepared by following the same conditions and procedures as in Examples 14, 15 and 17, respectively, except that the conditions for preparation of the amorphous layer (II) were changed to the respective conditions as shown in Table B11 below.

The image forming members thus obtained were individually set in a copier, subjected to corona charging at ⊖5.0 KV for 0.2 sec., followed immediately by irradiation of a light image. As the light source, a tungsten lamp was employed and irradiation was effected at 1.0 lux.sec. The latent image was developed with a positively charged developer (containing toner and carrier) and transferred onto a plain paper. The transferred image was found to be very good. The toner not transferred remaining on the image forming member for electrophotography was subjected to cleaning with a rubber blade. Such steps were repeated for 100,000 times or more, but no deterioration of image was observed in any case.

The results of the overall image quality evaluation of the transferred image and evaluation of durability by repeated continuous usage are listed in Table B8.

EXAMPLE 21

Image forming members were prepared, respectively, according to the same method as in Example 13, except that sputtering was employed and the content ratio of silicon atoms to carbon atoms was varied in the amorphous layer (II) by varying the area ratio of silicon wafer to graphite during formation of the amorphous layer (II). For each of the thus prepared image forming members, the steps of image making, development and cleaning as described in Example 13 were repeated for about 50,000 times, followed by image evaluation, to obtain the results as shown in Table B9.

EXAMPLE 22

Image forming members were prepared, respectively, according to the same method as in Example 13, except that the content ratio of silicon atoms and carbon atoms was varied in the amorphous layer (II) by varying the flow rate ratio of $SiH_4$ gas to $C_2H_4$ gas during formation of the amorphous layer (II). For each of the thus prepared image forming members, the steps to transfer as described in Example 13 were repeated for about 50,000 times, followed by image evaluation, to obtain the results as shown in Table B10.

EXAMPLE 23

Image forming members were prepared, respectively, according to the same method as in Example 13, except that the content ratio of silicon atoms to carbon atoms was varied in the amorphous layer (II) by varying the flow rate ratio of $SiH_4$ gas:$SiF_4$ gas:$C_2H_4$ gas during formation of the amorphous layer (II). For each of the thus prepared image forming members, the steps of image making, development and cleaning as described in Example 13 were repeated for about 50,000 times, followed by image evaluation, to obtain the results as shown in Table B11.

EXAMPLE 24

Image forming members were prepared according to the same method as in Example 13, except that the layer thickness of the amorphous layer (II) was varied. For each sample, the steps of image-making, development and cleaning as described in Example 13 were repeated to obtain the results shown in Table B12.

Example 25

By means of the preparation device as shown in FIG. 11, an image forming member for electrophotography was formed on a cylindrical aluminum substrate under the conditions as indicated in Table C1.

The image forming member thus obtained was set in a charging-exposure experimental device, subjected to corona charging at ⊖5.0 KV for 0.3 sec., followed immediately by irradiation of a light image. As the light source, a tungsten lamp was employed and irradiation was effected at 2 lux.sec. using a transmissive type test chart.

Immediately thereafter, a negatively charged developer (containing toner and carrier) was cascaded onto the surface of the image forming member, whereby a good toner image was obtained thereon. When the toner image on the member was transferred onto a transfer paper with corona charging at ⊖5.0 KV, there was obtained a clear image with high density which was excellent in resolution and good in halftone reproducibility.

EXAMPLE 26

By means of the preparation device as shown in FIG. 11, an image forming member for electrophotography was formed in the same manner as in Example 25 except that the conditions were changed to those as shown in Table C2.

Using the thus obtained image forming member, images were formed on transfer papers according to the same procedure and under the same conditions as in Example 25 except that the polarity in corona charging and the charged polarity of the developer were made opposite to those in Example 25, respectively, to obtain a very clear image quality.

EXAMPLE 27

By means of the preparation device as shown in FIG. 11, an image forming member for electrophotography was formed in the same manner as in Example 25 except that the conditions were changed to those as shown in Table C3.

Using the thus obtained image forming member, images were formed on transfer papers according to the same procedure and under the same conditions as in Example 25 to obtain a very clear image quality.

EXAMPLE 28

Layer formation was conducted in entirely the same manner as in Example 25 except that the content of germanium atoms in the first layer was varied by varying the flow rate ratio of $GeH_4$/He gas to $SiH_4$/He gas as shown in Table C4 to prepare image forming members (Sample Nos. 401C–408C) for electrophotography, respectively.

Using the same forming members thus obtained, images were formed on transfer papers according to the same procedure under the same conditions as in Example 25 to obtain the results as shown in Table C4.

EXAMPLE 29

Layer formation was conducted in entirely the same manner as in Example 25 except that the layer thickness of the first layer was varied as shown in Table C5 to prepare image forming members (Sample Nos. 501C–508C) for electrophotography, respectively.

Using the image forming members thus obtained, images were formed on transfer papers according to the same procedure under the same conditions as in Example 25 to obtain the results as shown in Table C5.

EXAMPLE 30

By means of the preparation device as shown in FIG. 11, layers were formed on a cylindrical aluminum substrate under the conditions as indicated in Tables C6 to C8 to obtain image forming member (Sample Nos. 601C, 602C, 603C), for electrophotography respectively.

The image forming members thus obtained were set in a charging-exposure experimental device, subjected to corona charging at ⊕5.0 KV for 0.3 sec., followed immediately by irradiation of a light image. As the light source, a tungsten lamp was employed and irradiation was effected at 2 lux.sec. using a transmissive type test chart.

Immediately thereafter, a negatively charged developer (containing toner and carrier) was cascaded onto the surface of the image forming member, whereby a good toner image was obtained thereon. When the toner image on the member was transferred onto a transfer paper with corona charging at ⊕5.0 KV, there was obtained a clear image with high density which was excellent in resolution and good in halftone reproducibility.

EXAMPLE 31

By means of the preparation device as shown in FIG. 11, image forming members (Sample Nos. 701C, 702C) for electrophotography were formed in the same manner as in Example 25 except that the conditions were changed to those as shown in Tables C9 and C10.

Using each of the thus obtained image forming members, images were formed on transfer papers according to the same procedure and under the same conditions as in Example 25 to obtain a very clear image quality.

EXAMPLE 32

By means of the preparation device as shown in FIG. 11, image forming members (Sample Nos. 801C–805C) for electrophotography were formed in the same manner as in Example 25 except that the conditions were changed to those as shown in Tables C11 to C15.

Using each of the thus obtained image forming members, images were formed on transfer papers according to the same procedure and under the same conditions as in Example 25 to obtain a very clear image quality.

EXAMPLE 33

Using an image forming member for electrophotography prepared under the same conditions as in Example 25, evaluation of the image quality was performed for the transferred toner images formed under the same toner image forming conditions as in Example 25 except that electrostatic images were formed by use of a GaAs system semiconductor laser (10 mW) at 810 nm in place of the tungsten lamp as the light source. As the result, there could be obtained clear images of high quality which were excellent in resolution and good in halftone reproducibility.

EXAMPLE 34

Image forming members for electrophotography (16 samples of Sample Nos. 12-201C to 12-208C, 12-301C to 12-308C) were prepared by following the same conditions and procedures as in Examples 26 and 27, respectively, except that the conditions for preparation of the amorphous layer (II) were changed to the respective conditions as shown in Table C16 below.

The image forming members thus obtained were individually set in a copier, subjected to corona charging at ⊕5.0 KV for 0.12 sec., followed immediately by irradiation of a light image. As the light source, a tungsten lamp was employed and irradiation was effected at a dose of 1.0 lux.sec. The latent image was developed with a negatively charged developer (containing toner and carrier) and transferred onto a plain paper. The transferred image was found to be very good. The toner not transferred remaining on the image forming member for electrophotography was subjected to cleaning with a rubber blade. Such steps were repeated for 100,000 times or more, but no deterioration of image was observed in any case.

The results of the overall image quality evaluation of the transferred image and evaluation of durability by repeated continuous usage are listed in Table C16A.

EXAMPLE 35

Image forming members were prepared, respectively, according to the same method as in Example 25, except that sputtering was employed and the content ratio of silicon atoms to carbon atoms was varied in the amorphous layer (II) by varying the area ratio of silicon wafer to graphite during formation of the amorphous layer (II). For each of the thus prepared image forming members, the steps of image making, development and cleaning as described in Example 25 were repeated for about 50,000 times, followed by image evaluation, to obtain the results as shown in Table C17.

EXAMPLE 36

Image forming members were prepared, respectively, according to the same method as in Example 25, except that the content ratio of silicon atoms to carbon atoms was varied in the amorphous layer (II) by varying the flow rate ratio of $SiH_4$ gas to $C_2H_4$ gas during formation of the amorphous layer (II). For each of the thus prepared image forming members, the steps to transfer as described in Example 25 were repeated for about 50,000 times, followed by image evaluation, to obtain the results as shown in Table C18.

EXAMPLE 37

Image forming members were prepared, respectively, according to the same method as in Example 25, except that the content ratio of silicon atoms to carbon atoms was varied in the amorphous layer (II) by varying the flow rate ratio of $SiH_4$ gas:$SiF_4$ gas:$C_2H_4$ gas during formation of the amorphous layer (II). For each of the thus prepared image forming members, the steps of image making, development and cleaning as described in Example 25 were repeated for about 50,000 times, followed by image evaluation, to obtain the results as shown in Table C19.

EXAMPLE 38

Image forming members were prepared according to the same method as in Example 25, except that the layer thickness of the amorphous layer (II) was varied. For each sample, the steps of image-making, development and cleaning as described in Example 25 were repeated to obtain the results shown in Table C20.

EXAMPLE 39

Figure 12:
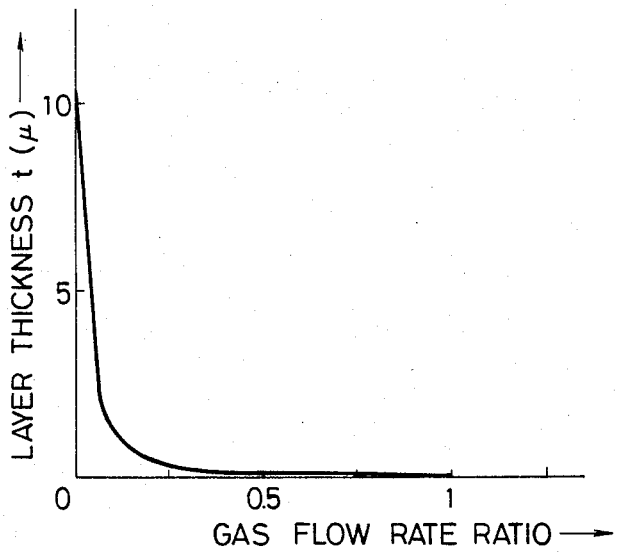
FIGS. 12 through 27 graphs showing the change rate curves of the gas flow rate ratios in Examples of the present invention, respectively.

By means of the preparation device as shown in FIG. 11, a first amorphous layer (I) was formed on a cylindrical aluminum substrate under the conditions as indicated in Table D1, while varying the gas flow rate ratio of $GeH_4$/He gas to $SiH_4$/He gas with lapse of time for layer formation in accordance with the change rate curve of gas flow rate ratio as shown in FIG. 12 and then a second amorphous layer (II) was formed on said first amorphous layer (I) under the conditions as shown in Table D1 to obtain an image forming member for electrophotography.

The image forming member thus obtained was set in a charging-exposure experimental device, subjected to corona charging at ⊕5.0 KV for 0.3 sec., followed immediately by irradiation of a light image. As the light source, a tungsten lamp was employed and irradiation was effected at 2 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper subjected to corona charging at ⊕5.0 KV, there was obtained a clear image with high density which was excellent in resolution and good in halftone reproducibility.

EXAMPLE 40

Figure 13:
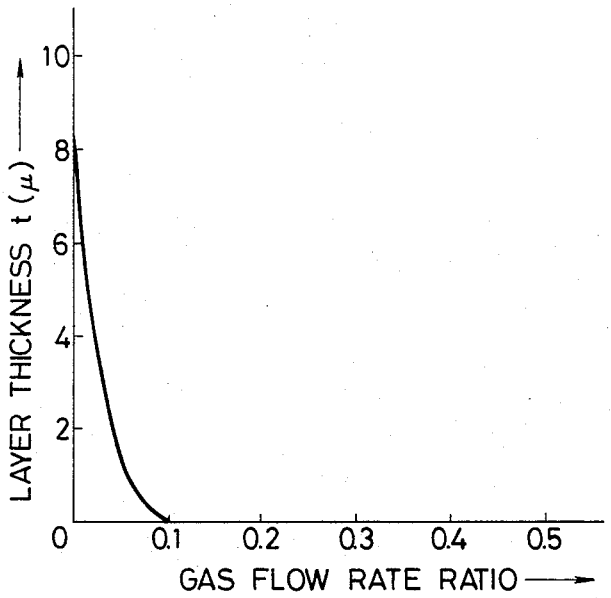

By means of the preparation device as shown in FIG. 11, a first amorphous layer (I) was formed under the conditions as indicated in Table D2, while varying the gas flow rate ratio of $GeH_4$/He gas to $SiF_4$/He gas with lapse of time for layer formation in accordance with the change rate curve of gas flow rate ratio as shown in FIG. 13, under otherwise the same conditions as in Example 39, and then a second amorphous layer (II) was formed similarly as in Example 39 to obtain an image forming member for electrophotography.

Using the image forming member thus obtained, images were formed on transfer papers according to the same procedure and under the same conditions as in Example 39 to obtain very clear image quality.

EXAMPLE 41

Figure 14:
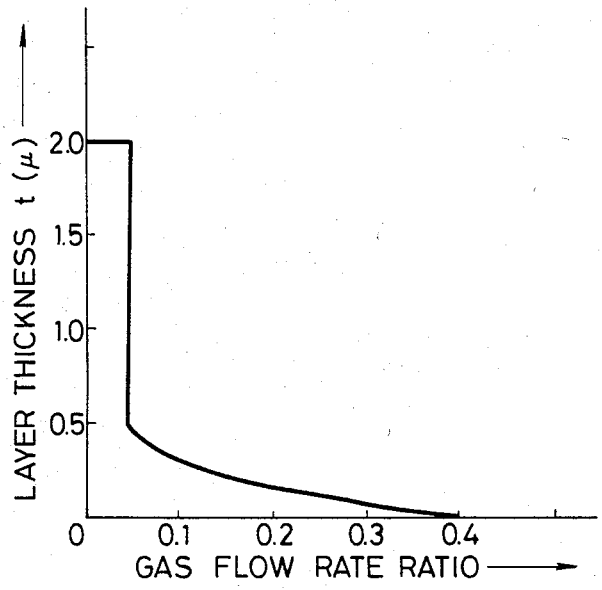

By means of the preparation device as shown in FIG. 11, layer formation was performed under the conditions as indicated in Table D3, while varying the gas flow rate ratio of $GeH_4$/He gas to $SiH_4$/He gas with lapse of time for layer formation in accordance with the change rate curve of gas flow rate ratio as shown in FIG. 14, under otherwise the same conditions as in Example 39, to obtain an image forming member for electrophotography.

Using the image forming member thus obtained, images were formed on transfer papers according to the same procedure and under the same conditions as in Example 39 to obtain very clear image quality.

EXAMPLE 42

Figure 15:
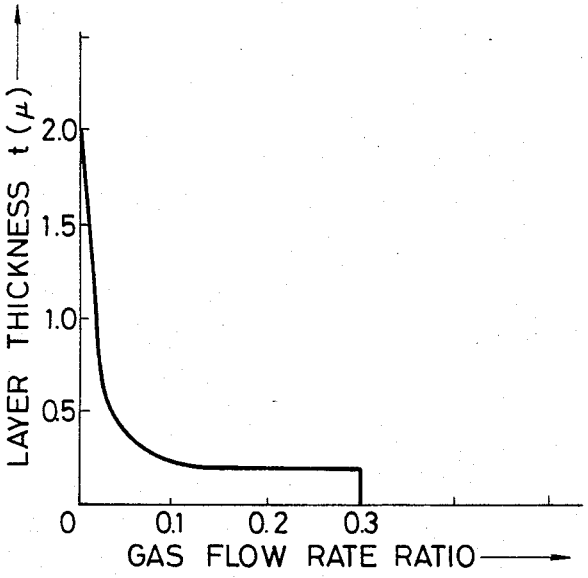

By means of the preparation device as shown in FIG. 11, layer formation was performed under the conditions as indicated in Table $D_4$, while varying the gas flow rate ratio of $GeH_4$/He gas to $SiH_4$/He gas with lapse of time for layer formation in accordance with the change rate curve of gas flow rate ratio as shown in FIG. 15, under otherwise the same conditions as in Example 39 to obtain an image forming member for electrophotography.

Using the image forming member thus obtained, images were formed on transfer papers according to the same procedure and under the same conditions as in Example 39 to obtain very clear image quality.

EXAMPLE 43

Figure 16:
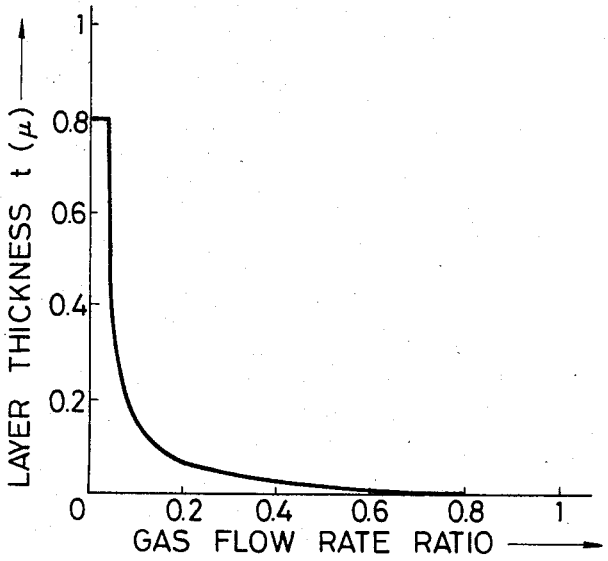

By means of the preparation device as shown in FIG. 11, an image forming member electrophotography was formed under the conditions as indicated in Table D5, while varying the gas flow rate ratio of $GeH_4$/He gas to $SiH_4$/He gas with lapse of time for layer formation in accordance with the change rate curve of gas flow rate ratio as shown in FIG. 16, under otherwise the same conditions as in Example 39.

Using the image forming member thus obtained, images were formed on transfer papers according to the same procedure and under the same conditions as in Example 39 to obtain very clear image quality.

EXAMPLE 44

Figure 17:
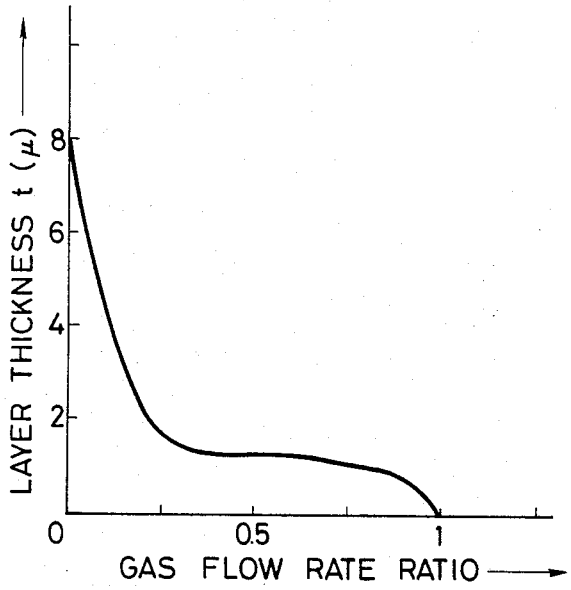

By means of the preparation device as shown in FIG. 11, an image forming member for electrophotography was formed under the conditions as indicated in Table D6, while varying the gas flow rate ratio of $GeH_4$/He gas to $SiH_4$/He gas with lapse of time for layer formation in accordance with the change rate curve of gas flow rate ratio as shown in FIG. 17, under otherwise the same conditions as in Example 39.

Using the image forming member thus obtained, images were formed on transfer papers according to the same procedure and under the same conditions as in Example 39 to obtain very clear image quality.

EXAMPLE 45

Figure 18:
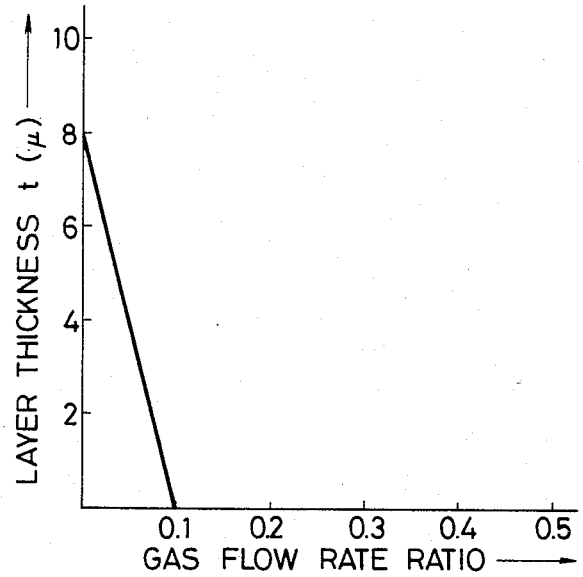

By means of the preparation device as shown in FIG. 11, an image forming member for electrophotography was formed under the conditions as indicated in Table D7, while varying the gas flow rate ratio of $GeH_4$/He gas to $SiH_4$/He gas with lapse of time for layer formation in accordance with the change rate curve of gas flow rate ratio as shown in FIG. 18, under otherwise the same conditions as in Example 39.

Using the image forming member thus obtained, images were formed on transfer papers according to the same procedure and under the same conditions as in Example 39 to obtain very clear image quality.

EXAMPLE 46

An image forming member for electrophotography was formed under the same conditions as in Example 39 except that $Si_2H_6$/He gas was employed in place of $SiH_4$/He gas and the conditions were changed to those as indicated in Table D8.

Using the image forming member thus obtained, images were formed on transfer papers according to the same procedure and under the same conditions as in Example 39 to obtain very clear image quality.

EXAMPLE 47

An image forming member for electrophotography was formed under the same conditions as in Example 39 except that $SiF_4$/He gas was employed in place of $SiH_4$/He gas and the conditions were changed to those as indicated in Table D9.

Using the image forming member thus obtained, images were formed on transfer papers according to the same procedure and under the same conditions as in Example 39 to obtain very clear image quality.

EXAMPLE 48

An image forming member for electrophotography was formed under the same conditions as in Example 39 except that ($SiH_4$/He+$SiF_4$/He) gas was employed in place of $SiH_4$/He gas and the conditions were changed to those as indicated in Table D10.

Using the image forming member thus obtained, images were formed on transfer papers according to the same procedure and under the same conditions as in Example 39 to obtain very clear image quality.

EXAMPLE 49

In Examples 39 to 48, the conditions for preparation of the second layer constituting the first amorphous layer (I) were changed to those as shown in Table D11, under otherwise the same conditions as in respective Examples, to prepare image forming members for electrophotography, respectively.

Using the thus prepared image forming members, images were formed according to the same procedure and under the same conditions as in Example 39 to obtain the results as shown in Table D11A.

EXAMPLE 50

In Examples 39 to 48, the conditions for preparation of the second layer constituting the first amorphous layer (I) were changed to those as shown in Table D12, under otherwise the same conditions as in respective Examples, to prepare image forming members for electrophotography, respectively.

Using the thus prepared image forming members, images were formed according to the same procedure and under the same conditions as in Example 39 to obtain the results as shown in Table D12A.

EXAMPLE 51

Using an image forming member for electrophotography prepared under the same conditions as in Example 39, evaluation of the image quality was performed for the transferred toner images formed under the same toner image forming conditions as in Example 39 except that electrostatic images were formed by use of a GaAs system semiconductor laser (10 mW) at 810 nm in place of the tungsten lamp as the light source. As the result, there could be obtained clear images of high quality which were excellent in resolution and good in halftone reproducibility.

EXAMPLE 52

Image forming members for electrophotography (72 samples of Sample Nos. 12-201D to 12-208D, 12-301D to 12-308D, . . . , 12-1001D to 12-1009D) were prepared by following the same conditions and procedures as in Examples 39 to 48, respectively, except that the conditions for preparation of the amorphous layer (II) were changed to the respective conditions as shown in Table D13 below.

The image forming members thus obtained were individually set in a charging-exposure experimental device, subjected to corona charging at ⊖5.0 KV for 0.2 sec., followed immediately by irradiation of a light image. As the light source, a tungsten lamp was employed and irradiation was effected at 1.0 lux.sec. The latent image was developed with a positively charged developer (containing toner and carrier) and transferred onto a plain paper. The transferred image was found to be very good. The toner not transferred remaining on the image forming member for electrophotography was subjected to cleaning with a rubber blade. Such steps were repeated for 100,000 times or more, but no deterioration of image was observed in any case.

The results of the overall image quality evaluation of the transferred image and evaluation of durability by repeated continuous usage are listed in Table D13A.

EXAMPLE 53

Image forming members were prepared, respectively, according to the same method as in Example 39, except that the content ratio of silicon atoms to carbon atoms was varied in the amorphous layer (II) by varying the area ratio of silicon wafer to graphite during formation of the amorphous layer (II). For each of the thus prepared image forming members, the steps of image making, development and cleaning as described in Example 39 were repeated for about 50,000 times, followed by image evaluation, to obtain the results as shown in Table D14.

EXAMPLE 54

Image forming members were prepared, respectively, according to the same method as in Example 39, except that the content ratio of silicon atoms to carbon atoms was varied in the amorphous layer (II) by varying the flow rate ratio of $SiH_4$ gas to $C_2H_4$ gas during formation of the amorphous layer (II). For each of the thus prepared image forming members, the steps to transfer as described in Example 39 were repeated for about 50,000 times, followed by image evaluation, to obtain the results as shown in Table D15.

EXAMPLE 55

Image forming members were prepared, respectively, according to the same method as in Example 39 except that the content ratio of silicon atoms to carbon atoms was varied in the amorphous layer (II) by varying the flow rate ratio of $SiH_4$ gas:$SiF_4$ gas:$C_2H_4$ gas during formation of the amorphous layer (II). For each of the thus prepared image forming members, the steps of image making, development and cleaning as described in Example 39 were repeated for about 50,000 times, followed by image evaluation, to obtain the results as shown in Table D16.

EXAMPLE 56

Image forming members were prepared according to the same method as in Example 39, except that the layer thickness of the amorphous layer (II) was varied. For each sample, the steps of image-making, development and cleaning as described in Example 39 were repeated to obtain the results shown in Table D17.

EXAMPLE 57

By means of the preparation device as shown in FIG. 11, layers were formed on a cylindrical aluminum substrate under the conditions as indicated in Table E1 to obtain an image forming member for electrophotography.

The image forming member thus obtained was set in a charging-exposure experimental device, subjected to corona charging at ⊕5.0 KV for 0.3 sec., followed immediately by irradiation of a light image. As the light source, a tungsten lamp was employed and irradiation was effected at 2 lux.sec. using a transmissive type test chart.

Immediately thereafter, a negatively charged developer (containing toner and carrier) was cascaded onto the surface of the image forming member, whereby a good toner image was obtained thereon. When the toner image on the member was transferred onto a transfer paper with corona charging at ⊕5.0 KV, there was obtained a clear image with high density which was excellent in resolution and good in halftone reproducibility.

EXAMPLE 58

By means of the preparation device as shown in FIG. 11, layers were formed in the same manner as in Example 57 except that the conditions were changed to those as shown in Table E2 to obtain an image forming member for electrophotography.

Using the thus obtained image forming member, images were formed on transfer papers according to the same procedure and under the same conditions as in Example 57 except that the polarity in corona charging and the charged polarity of the developer were made opposite to those in Example 57, respectively, to obtain a very clear image quality.

EXAMPLE 59

By means of the preparation device as shown in FIG. 11, layers were formed in the same manner as in Example 57 except that the conditions were changed to those as shown in Table E3 to obtain an image forming member for electrophotography.

Using the thus obtained image forming member, images were formed on transfer papers according to the same procedure and under the same conditions as in Example 57 to obtain a very clear image quality.

EXAMPLE 60

Layer formation was conducted in entirely the same manner as in Example 57 except that the content of germanium atoms in the first layer was varied by varying the flow rate ratio of $GeH_4$/He gas to $SiH_4$/He gas as shown in Table E4 to prepare image forming members for electrophotography, respectively.

Using the image forming members thus obtained, images were formed on transfer papers according to the same procedure under the same conditions as in Example 57 to obtain the results as shown in Table E4.

EXAMPLE 61

Layer formation was conducted in entirely the same manner as in Example 57 except that the layer thickness of the first layer was varied as shown in Table E5 to prepare image forming members for electrophotography, respectively.

Using the image forming members thus obtained, images were formed on transfer papers according to the same procedure under the same conditions as in Example 57 to obtain the results as shown in Table E5.

EXAMPLE 62

By means of the preparation device as shown in FIG. 11, layers were formed on a cylindrical aluminum substrate in the same manner as in Example 57 except that the first amorphous layer (I) was formed under the conditions as indicated in Table E6 to obtain an image forming member for electrophotography.

The image forming member thus obtained was set in a charging-exposure experimental device, subjected to corona charging at ⊕5.0 KV for 0.3 sec., followed immediately by irradiation of a light image. As the light source, a tungsten lamp was employed and irradiation was effected at 2 lux.sec. using a transmissive type test chart.

Immediately thereafter, a negatively charged developer (containing toner and carrier) was cascaded onto the surface of the image forming member, whereby a good toner image was obtained thereon. When the toner image on the member was transferred onto a transfer paper with corona charging at ⊕5.0 KV, there was obtained a clear image with high density which was excellent in resolution and good in halftone reproducibility.

EXAMPLE 63

By means of the preparation device as shown in FIG. 11, layers were formed on a cylindrical aluminum substrate in the same manner as in Example 57 except that the first amorphous layer (I) was formed under the conditions as indicated in Table E7 to obtain an image forming member for electrophotography.

The image forming member thus obtained was set in a charging-exposure experimental device, subjected to corona charging at ⊕5.0 KV for 0.3 sec., followed immediately by irradiation of a light image. As the light source, a tungsten lamp was employed and irradiation was effected at 2 lux.sec. using a transmissive type test chart.

Immediately thereafter, a negatively charged developer (containing toner and carrier) was cascaded onto the surface of the image forming member, whereby a good toner image was obtained thereon. When the toner image on the member was transferred onto a transfer paper with corona charging at ⊕5.0 KV, there was obtained a clear image with high density which was excellent in resolution and good in halftone reproducibility.

EXAMPLE 64

By means of the preparation device as shown in FIG. 11, layers were formed on a cylindrical aluminum substrate in the same manner as in Example 57 except that the first amorphous layer (I) was formed under the conditions as indicated in Table E8 to obtain an image forming member for electrophotography.

The image forming member thus obtained was set in a charging-exposure experimental device, subjected to corona charging at ⊕5.0 KV for 0.3 sec, followed immediately by irradiation of a light image. As the light source, a tungsten lamp was employed and irradiation was effected at 2 lux.sec. using a transmissive type test chart.

Immediately thereafter, a negatively charged developer (containing toner and carrier) was cascaded onto the surface of the image forming member, whereby a good toner was obtained thereon. When the toner image on the member was transferred onto a transfer paper subjected to corona charging at ⊕5.0 KV, there was obtained a clear image with high density which was excellent in resolution and good in halftone reproducibility.

EXAMPLE 65

By means of the preparation device as shown in FIG. 11, layers were formed in the same manner as in Example 57 except that the conditions were changed to those as shown in Table E9 to obtain an image forming member for electrophotography.

Using the thus obtained image forming member, images were formed on transfer papers according to the same procedure and under the same conditions as in Example 57 to obtain a very clear image quality.

EXAMPLE 66

By means of the preparation device as shown in FIG. 11, layers were formed in the same manner as in Example 57 except that the conditions were changed to those as shown in Table E10 to obtain an image forming member for electrophotography.

Using the thus obtained image forming member, images were formed on transfer papers according to the same procedure and under the same conditions as in Example 57 to obtain a very clear image quality.

EXAMPLE 67

Using an image forming member for electrophotography prepared under the same conditions as in Example 57, evaluation of the image quality was performed for the transferred toner images formed under the same toner image forming conditions as in Example 57 except that electrostatic image were formed by use of a GaAs semiconductor laser (10 mW) at 810 nm in place of the tungsten lamp as the light source. As the result, there could be obtained clear images of high quality which were excellent in resolution and good in halftone reproducibility.

EXAMPLE 68

Image forming members for electrophotography (72 samples of Sample Nos. 12-201E to 12-208E, 12-301E to 12-308E, 12-601E to 12-608E, . . . , and 12-1001E to 12-1008E) were prepared by following the same conditions and procedures as in Examples 58, 59 and 62 to 66, respectively, except that the conditions for preparation of the amorphous layer (II) were changed to the respective conditions as shown in Table E11 below.

The image forming members thus obtained were individually set in a charging-exposure experimental device, subjected to corona charging at ⊕5.0 KV for 0.2 sec., followed immediately by irradiation of a light image. As the light source, a tungsten lamp was employed and irradiation was effected at a dose of 1.0 lux.sec. The latent image was developed with a negatively charged developer (containing toner and carrier) and transferred onto a plain paper. The transferred image was found to be very good. The toner not transferred remaining on the image forming member for electrophotography was subjected to cleaning with a rubber blade. Such steps were repeated for 100,000 times or more, but no deterioration of image was observed in any case.

The results of the overall image quality evaluation of the transferred image and evaluation of durability by repeated continuous usage are listed in Table E12.

EXAMPLE 69

Image forming members were prepared, respectively, according to the same method as in Example 57, except that sputtering was employed and the content ratio of silicon atoms to carbon atoms was varied in the amorphous layer (II) by varying the area ratio of silicon wafer to graphite during formation of the amorphous layer (II). For each of the thus prepared image forming members, the steps of image making, development and cleaning as described in Example 57 were repeated for about 50,000 times, followed by image evaluation, to obtain the results as shown in Table E13.

EXAMPLE 70

Image forming members were prepared, respectively, according to the same method as in Example 57, except that the content ratio of silicon atoms to carbon atoms was varied in the amorphous layer (II) by varying the flow rate ratio of $SiH_4$ gas to $C_2H_4$ gas during formation of the amorphous layer (II). For each of the thus prepared image forming members, the steps to transfer as described in Example 57 were repeated for about 50,000 times, followed by image evaluation, to obtain the results as shown in Table E14.

EXAMPLE 71

Image forming members were prepared, respectively, according to the same method as in Example 57, except that the content ratio of silicon atoms to carbon atoms was varied in the amorphous layer (II) by varying the flow rate ratio of $SiH_4$ gas:$SiF_4$ gas:$C_2H_4$ gas during formation of the amorphous layer (II). For each of the thus prepared image forming members, the steps of image making, development and cleaning as described in Example 57 were repeated for about 50,000 times, followed by image evaluation, to obtain the results as shown in Table E15.

EXAMPLE 72

Image forming members were prepared according to the same method as in Example 57, except that the layer thickness of the amorphous layer (II) was varied. For each sample, the steps of image-making, development and cleaning as described in Example 57 were repeated to obtain the results shown in Table E16.

EXAMPLE 73

By means of the preparation device as shown in FIG. 11, a first amorphous layer (I) was formed on a cylindrical aluminum substrate under the conditions as indicated in Table F1, while varying the gas flow rate ratio of $GeH_4$/He gas to $SiH_4$/He gas with lapse of time for layer formation in accordance with the change rate curve of gas flow rate ratio as shown in FIG. 12 and then a second amorphous layer (II) was formed under the conditions as shown in Table F1 to obtain an image forming member for electrophotography.

The image forming member thus obtained was set in a charging-exposure experimental device, subjected to corona charging at ⊕5.0 KV for 0.3 sec., followed immediately by irradiation of a light image. As the light source, a tungsten lamp was employed and irradiation was effected at 2 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper subjected to corona charging at ⊕5.0 KV, there was obtained a clear image with high density which was excellent in resolution and good in halftone reproducibility.

EXAMPLE 74

By means of the preparation device as shown in FIG. 11, an image forming member for electrophotography was formed in the same manner as in Example 73, except that a first amorphous layer (I) was formed under the conditions as indicated in Table F2, while varying the gas flow rate ratio of $GeH_4$/He gas to $SiH_4$/He gas with lapse of time for layer formation in accordance with the change rate curve of gas flow rate ratio as shown in FIG. 13, under otherwise the same conditions as in Example 73.

Using the image forming member thus obtained, images were formed on transfer papers according to the same procedure and under the same conditions as in Example 73 to obtain very clear image quality.

EXAMPLE 75

By means of the preparation device as shown in FIG. 11, an image forming member for electrophotography was formed in the same manner in Example 73, except that a first amorphous layer (I) was formed under the conditions as indicated in Table F3, while varying the gas flow rate ratio of $GeH_4$/He gas to $SiH_4$/He gas with lapse of time for layer formation in accordance with the change rate curve of gas flow rate ratio as shown in FIG. 14, under otherwise the same conditions as in Example 73.

Using the image forming member thus obtained, images were formed on transfer papers according to the same procedure and under the same conditions as in Example 73 to obtain very clear image quality.

EXAMPLE 76

By means of the preparation device as shown in FIG. 11, an image forming member for electrophotography was formed in the same manner as in Example 73, except that a first amorphous layer (I) was formed under the conditions as indicated in Table F4, while varying the gas flow rate ratio of $GeH_4$/He gas to $SiH_4$/He gas with lapse of time for layer formation in accordance with the change rate curve of gas flow rate ratio as shown in FIG. 15, under otherwise the same conditions as in Example 73.

Using the image forming member thus obtained, images were formed on transfer papers according to the same procedure and under the same conditions as in Example 73 to obtain very clear image quality.

EXAMPLE 77

Figure 22:
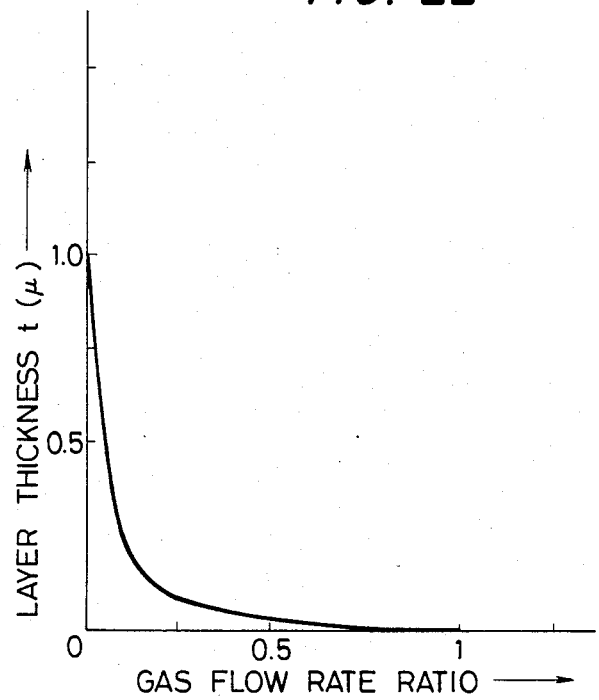

By means of the preparation device as shown in FIG. 11, an image forming member for electrophotography was formed in the same manner in Example 73, except that a first amorphous layer (I) was formed under the conditions as indicated in Table F5, while varying the gas flow rate ratio of $GeH_4$/He gas to $SiH_4$/He gas with lapse of time for layer formation in accordance with the change rate curve of gas flow rate ratio as shown in FIG. 22, under otherwise the same conditions as in Example 73.

Using the image forming member thus obtained, images were formed on transfer papers according to the same procedure and under the same conditions as in Example 73 to obtain very clear image quality.

EXAMPLE 78

Figure 25:
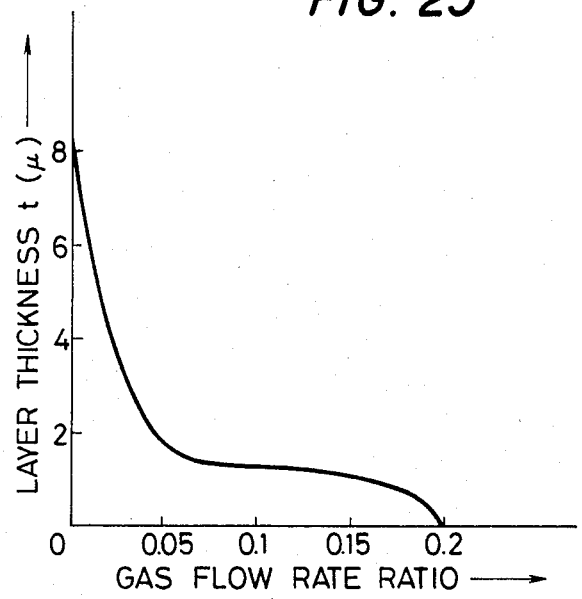

By means of the preparation device as shown in FIG. 11, an image forming member for electrophotography was formed in the same manner as in Example 73, except that a first amorphous layer (I) was formed under the conditions as indicated in Table F6, while varying the gas flow rate ratio $GeH_4$/He gas to $SiH_4$/He gas with lapse of time for layer formation in accordance with the change rate curve of gas flow rate ratio as shown in FIG. 25, under otherwise the same conditions as in Example 73.

Using the image forming member thus obtained, images were formed on transfer papers according to the same procedure and under the same conditions as in Example 73 to obtain very clear image quality.

EXAMPLE 79

By means of the preparation device as shown in FIG. 11, an image forming member for electrophotography was formed in the same manner in Example 73, except that a first amorphous layer (I) was formed under the conditions as indicated in Table F7, while varying the gas flow rate ratio of $GeH_4$/He gas to $SiH_4$/He gas with lapse of time for layer formation in accordance with the change rate curve of gas flow rate ratio as shown in FIG. 18, under otherwise the same conditions as in Example 73.

Using the image forming member thus obtained, images were formed on transfer papers according to the same procedure and under the same conditions as in Example 73 to obtain very clear image quality.

EXAMPLE 80

An image forming member for electrophotography was formed under the same conditions as in Example 73 except that $Si_2H_6$/He gas was employed in place of $SiH_4$/He gas and the conditions were changed to those as indicated in Table F8.

Using the image forming member thus obtained, images were formed on transfer papers according to the same procedure and under the same conditions as in Example 73 to obtain very clear image quality.

EXAMPLE 81

An image forming member for electrophotography was formed under the same conditions as in Example 73 except that $SiF_4$/He gas was employed in place of $SiH_4$/He gas and the conditions were charged to those as indicated in Table F9.

Using the image forming member thus obtained, images were formed on transfer papers according to the same procedure and under the same conditions as in Example 73 to obtain very clear image quality.

EXAMPLE 82

An image forming member for electrophotography was formed under the same conditions as in Example 73 except that ($SiH_4$/He + $SiF_4$/He) gas was employed in place of $SiH_4$/He gas and the conditions were changed to those as indicated in Table F10.

Using the image forming member thus obtained, images were formed on transfer papers according to the same procedure and under the same conditions as in Example 73 to obtain very clear image quality.

EXAMPLE 83

In Examples 73 to 82, the conditions for preparation of the third layer were changed to those as shown in Table F11, under otherwise the same conditions as in respective Examples, to prepare image forming members for electrophotography, respectively.

Using the thus prepared image forming members, images were formed according to the same procedure and under the same conditions as in Example 73 to obtain the results as shown in Table F11A.

EXAMPLE 84

In Examples 73 to 82, the conditions for preparation of the third layer were changed to those as shown in Table F12, under otherwise the same conditions as in respective Examples, to prepare image forming members for electrophotography, respectively.

Using the thus prepared image forming members, images were formed according to the same procedure and under the same conditions as in Example 73 to obtain the results as shown in Table F12A.

EXAMPLE 85

Figure 26:
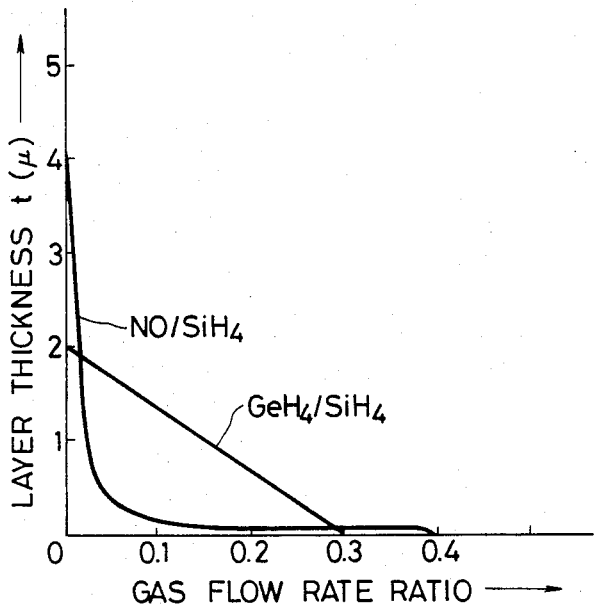

By means of the preparation device as shown in FIG. 11, an image forming member for electrophotography was formed under the conditions as indicated in Table F13, while varying the gas flow rate ratio $GeH_4$/He gas to $SiH_4$/He gas and the gas flow rate ratio of NO gas to $SiH_4$/He gas with lapse of time for layer formation in accordance with the change rate curve of gas flow rate ratio as shown in FIG. 26, under otherwise the same conditions as in Example 73.

Using the image forming member thus obtained, images were formed on transfer papers according to the same procedure and under the same conditions as in Example 73 to obtain very clear image quality.

EXAMPLE 86

Figure 27:
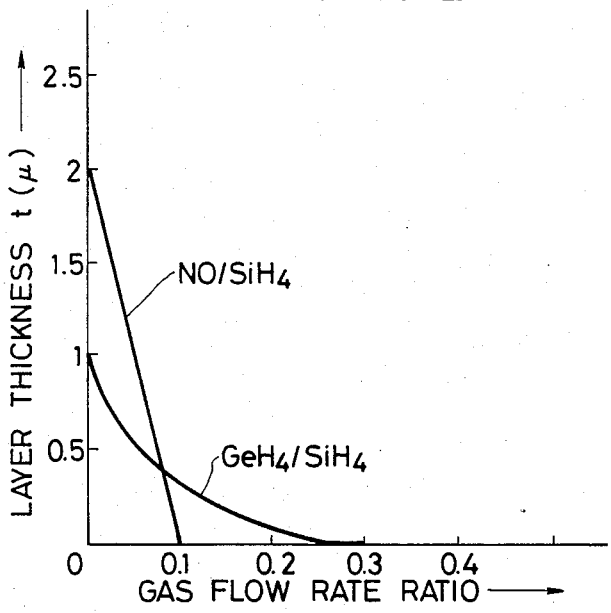

By means of the preparation device as shown in FIG. 11, an image forming member for electrophotography was formed under the conditions as indicated in Table F14, while varying the gas flow rate ratio of $GeH_4$/He gas to $SiH_4$/He gas and the gas flow rate ratio of NO gas to $SiH_4$/He gas with lapse of time for layer formation in accordance with the change rate curve of gas flow rate ratio as shown in FIG. 27, under otherwise the same conditions as in Example 73.

Using the image forming member thus obtained, images were formed on transfer papers according to the same procedure and under the same conditions as in Example 73 to obtain very clear image quality.

EXAMPLE 87

Using image forming members for electrophotography prepared under the same conditions as in Examples 73 to 82, evaluation of the image quality was performed for the transferred toner images formed under the same toner image forming conditions as in Example 73 except that electrostatic images were formed by use of a GaAs system semiconductor laser (10 mW) at 810 nm in place of the tungsten lamp as the light source. As the result, there could be obtained clear images of high quality which were excellent in resolution and good in halftone reproducibility.

EXAMPLE 88

Image forming members for electrophotography (72 samples of Sample Nos. 12-201F to 12-208F, 12-301F to 12-308F, . . . , 12-1001F to 12-1009F) were prepared by following the same conditions and procedures as in Examples 74 to 82, respectively, except that the conditions for preparation of the amorphous layer (II) were changed to the respective conditions as shown in Table F15 below.

The image forming members thus obtained were individually set in a charging-exposure experimental device, subjected to corona charging at ⊖5.0 KV for 0.2 sec., followed immediately by irradiation of a light image. As the light source, a tungsten lamp was employed and irradiation was effected at 1.0 lux.sec. The latent image was developed with a positively charged developer (containing toner and carrier) and transferred onto a plain paper. The transferred image was found to be very good. The toner not transferred remaining on the image forming member for electrophotography was subjected to cleaning with a rubber blade. Such steps were repeated for 100,000 times or more, but no deterioration of image was observed in any case.

The results of the overall image quality evaluation of the transferred image and evaluation of durability by repeated continuous usage are listed in Table F15A.

EXAMPLE 89

Image forming members were prepared, respectively, according to the same method as in Example 73, except that sputtering was employed and the content ratio of silicon atoms to carbon atoms was varied in the amorphous layer (II) by varying the area ratio of silicon wafer to graphite during formation of the amorphous layer (II). For each of the thus prepared image forming members, the steps of image making, development and cleaning as described in Example 73 were repeated for about 50,000 times, followed by image evaluation, to obtain the results as shown in Table F16.

EXAMPLE 90

Image forming members were prepared, respectively, according to the same method as in Example 73, except that the content ratio of silicon atoms to carbon atoms was varied in the amorphous layer (II) by varying the flow rate ratio of $SiH_4$ gas to $C_2H_4$ gas during formation of the amorphous layer (II). For each of thus prepared image forming members, the steps to transfer as described in Example 73 were repeated for about 50,000 times, followed by image evaluation, to obtain the results as shown in Table F17.

EXAMPLE 91

Image forming members were prepared, respectively, according to the same method as in Example 73, except that the content ratio of silicon atoms to carbon atoms was varied in the amorphous layer (II) by varying the flow rate ratio of $SiH_4$ gas:$SiF_4$ gas:$C_2H_4$ gas during formation of the amorphous layer (II). For each of the thus prepared image forming members, the steps of image making, development and cleaning as described in Example 73 were repeated for about 50,000 times, followed by image evaluation, to obtain the results as shown in Table F18.

EXAMPLE 92

The respective image forming members were prepared according to the same method as in Example 73, except that the layer thickness of the amorphous layer (II) was varied. For each sample, the steps of image-making, development and cleaning as described in Example 73 were repeated to obtain the results shown in Table F19.

EXAMPLE 93

Figure 19:
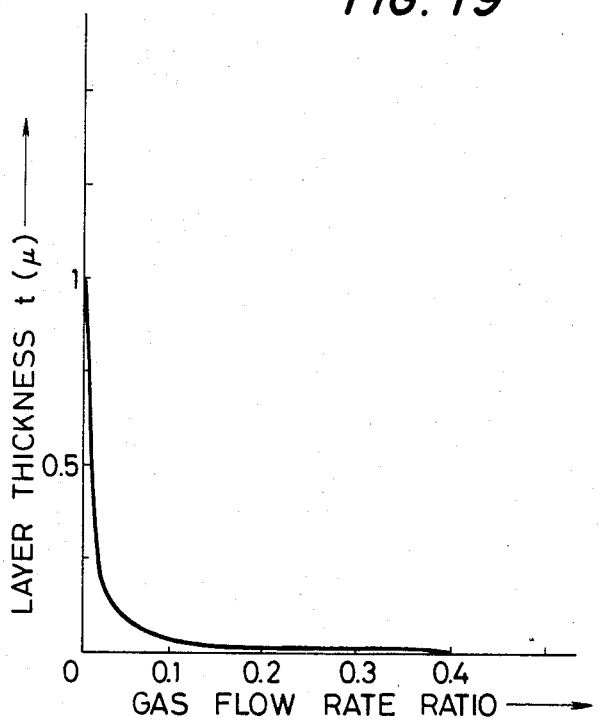

By means of the preparation device as shown in FIG. 11, a first amorphous layer (I) was formed on a cylindrical aluminum substrate under the conditions as indicated in Table G1, while varying the gas flow rate ratio of $GeH_4$/He gas to $SiH_4$/He gas with lapse of time for layer formation in accordance with the change rate curve of gas flow rate ratio as shown in FIG. 19 and then a second amorphous layer (II) was formed under the conditions as shown in Table G1 to obtain an image forming member for electrophotography.

The image forming member thus obtained was set in a charging-exposure experimental device, subjected to corona charging at ⊕5.0 KV for 0.3 sec., followed immediately by irradiation of a light image. As the light source, a tungsten lamp was employed and irradiation was effected at 2 lux.sec. using a transmissive type test chart.

Immediately thereafter, a negatively charged developer (containing toner and carrier) was cascaded onto the surface of the image forming member, whereby a good toner image was obtained thereon. When the toner image on the member was transferred onto a transfer paper with corona charging at ⊕5.0 KV, there was obtained a clear image with high density which was excellent in resolution and good in halftone reproducibility.

EXAMPLE 94

Figure 20:
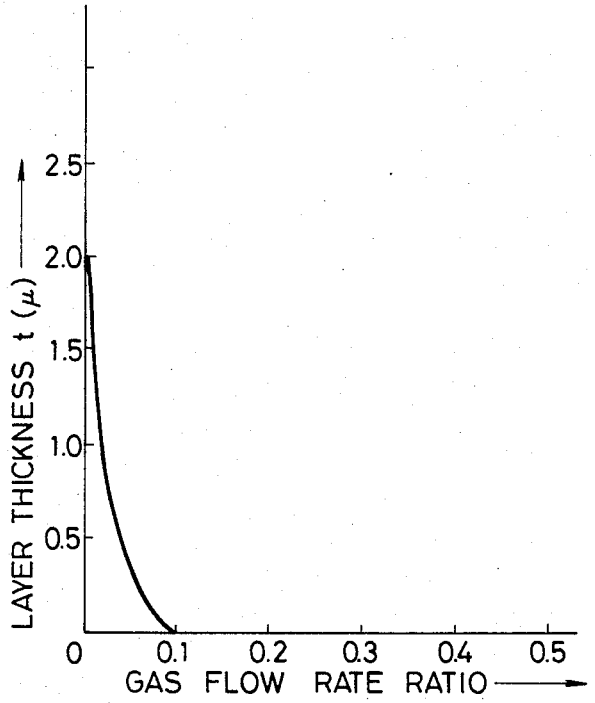

By means of the preparation device as shown in FIG. 11, an image forming member for electrophotography was formed in the same manner as in Example 93, except that a first amorphous layer (I) was formed under the conditions as indicated in Table G2, while varying the gas flow rate ratio of $GeH_4$/He gas to $SiH_4$/He gas with lapse of time for layer formation in accordance with the change rate curve of gas flow rate ratio as shown in FIG. 20, under otherwise the same conditions as in Example 93.

Using the image forming member thus obtained, images were formed on transfer papers according to the same procedure and under the same conditions as in Example 93 to obtain very clear image quality.

EXAMPLE 95

By means of the preparation device as shown in FIG. 11, an image forming member for electrophotography was formed in the same manner as in Example 93, except that a first amorphous layer (I) was formed under the conditions as indicated in Table G3, while varying the gas flow rate ratio of $GeH_4$/He gas to $SiH_4$/He gas with lapse of time for layer formation in accordance with the change rate curve of gas flow rate ratio as shown in FIG. 14, under otherwise the same conditions as in Example 93.

Using the image forming member thus obtained, images were formed on transfer papers according to the same procedure and under the same conditions as in Example 93 to obtain very clear image quality.

EXAMPLE 96

Figure 21:
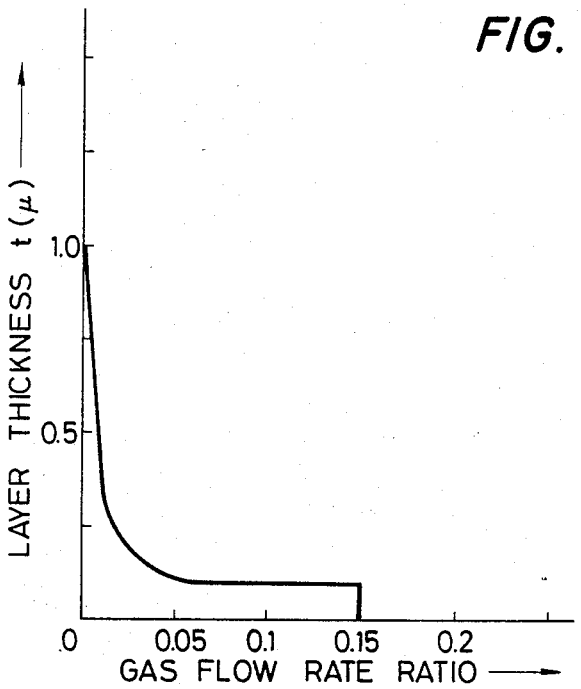

By means of the preparation device as shown in FIG. 11, an image forming member for electrophotography was formed in the same manner as in Example 93, except that a first amorphous layer (I) was formed under the conditions as indicated in Table G4, while varying the gas flow rate ratio of $GeH_4$/He gas to $SiH_4$/He gas with lapse of time for layer formation in accordance with the change rate curve of gas flow rate ratio as shown in FIG. 21, under otherwise the same conditions as in Example 93.

Using the image forming member thus obtained, images were formed on transfer papers according to the same procedure and under the same conditions as in Example 93 to obtain very clear image quality.

EXAMPLE 97

By means of the preparation device as shown in FIG. 11, an image forming member for electrophotography was formed in the same manner as in Example 93, except that a first amorphous layer (I) was formed under the conditions as indicated in Table G5, while varying the gas flow rate ratio of $GeH_4$/He gas to $SiH_4$/He gas with lapse of time for layer formation in accordance with the change rate curve of gas flow rate ratio as shown in FIG. 22, under otherwise the same conditions as in Example 93.

Using the image forming member thus obtained, images were formed on transfer papers according to the same procedure and under the same conditions as in Example 93 to obtain very clear image quality.

EXAMPLE 98

Figure 23:
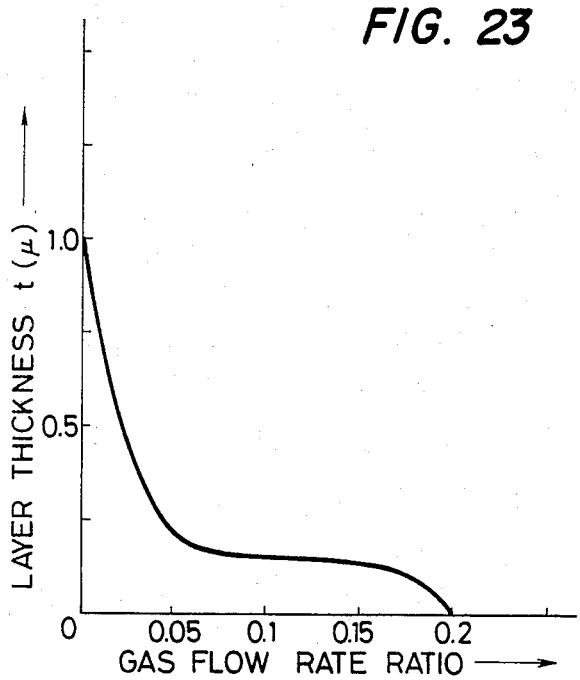

By means of the preparation device as shown in FIG. 11, an image forming member for electrophotography was formed in the same manner as in Example 93, except that a first amorphous layer (I) was formed under the conditions as indicated in Table G6, while varying the gas flow rate ratio of $GeH_4$/He gas to $SiH_4$/He gas with lapse of time for layer formation in accordance with the change rate curve of gas flow rate ratio as shown in FIG. 23, under otherwise the same conditions as in Example 93.

Using the image forming member thus obtained, images were formed on transfer papers according to the same procedure and under the same conditions as in Example 93 to obtain very clear image quality.

EXAMPLE 99

Figure 24:
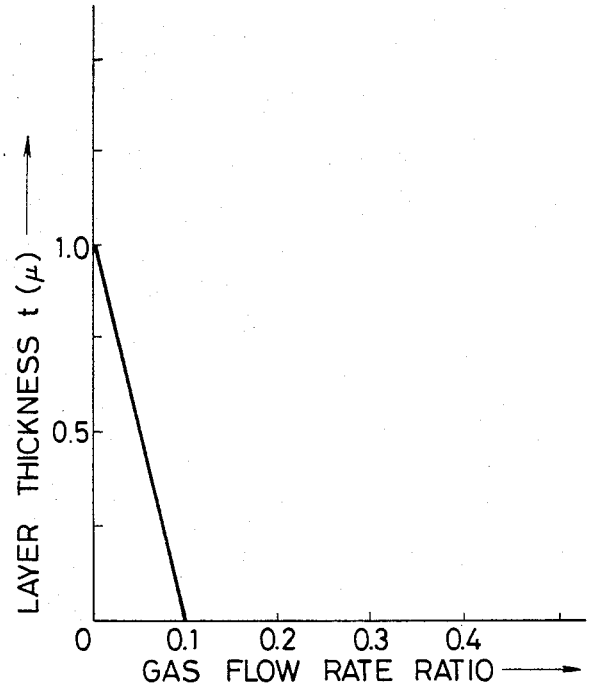

By means of the preparation device as shown in FIG. 11, an image forming member for electrophotography was formed in the same manner as in Example 93, except that a first amorphous layer (I) was formed under the conditions as indicated in Table G7, while varying the gas flow rate ratio of $GeH_4$/He gas to $SiH_4$/He gas with lapse of time for layer formation in accordance with the change rate curve of gas flow rate ratio as shown in FIG. 24, under otherwise the same conditions as in Example 93.

Using the image forming member thus obtained, images were formed on transfer papers according to the same procedure and under the same conditions as in Example 93 to obtain very clear image quality.

EXAMPLE 100

An image forming member for electrophotography was formed under the same conditions as in Example 93 except that $Si_2H_6$/He gas was employed in place of $SiH_4$/He gas and the conditions were changed to those as indicated in Table G8.

Using the image forming member thus obtained, images were formed on transfer papers according to the same procedure and under the same conditions as in Example 93 to obtain very clear image quality.

EXAMPLE 101

An image forming member for electrophotography was formed under the same conditions as in Example 93 except that $SiF_4$/He gas was employed in place of $SiH_4$/He gas and the conditions were changed to those as indicated in Table G9.

Using the image forming member thus obtained, images were formed on transfer papers according to the same procedure and under the same conditions as in Example 93 to obtain very clear image quality.

EXAMPLE 102

An image forming member for electrophotography was formed under the same conditions as in Example 93 except that ($SiH_4$/He+$SiF_4$/He) gas was employed in place of $SiH_4$/He gas and the conditions were changed to those as indicated in Table G10.

Using the image forming member thus obtained, images were formed on transfer papers according to the same procedure and under the same conditions as in Example 93 to obtain very clear image quality.

EXAMPLE 103

By means of the preparation device as shown in FIG. 11, an image forming member for electrophotography was formed in the same manner as in Example 93, except that a first amorphous layer (I) was formed on a cylindrical aluminum substrate under the conditions as indicated in Table G11, while varying the gas flow rate ratio of $GeH_4$/He gas to $SiH_4$/He gas with lapse of time for layer formation in accordance with the change rate curve of gas flow rate ratio as shown in FIG. 19.

The image forming member thus obtained was set in a charging-exposure experimental device, subjected to corona charging at ⊕5.0 KV for 0.3 sec., followed immediately by irradiation of a light image. As the light source, a tungsten lamp was employed and irradiation was effected at a dose of 2 lux.sec. using a transmissive type test chart.

Immediately thereafter, a negatively charged developer (containing toner and carrier) was cascaded onto the surface of the image forming member, whereby a good toner image was obtained thereon. When the toner image on the member was transferred onto a transfer paper with corona charging at ⊖5.0 KV, there was obtained a clear image with high density which was excellent in resolution and good in halftone reproducibility.

EXAMPLE 104

In Example 103, the flow rate of $B_2H_6$ relative to ($SiH_4$+$GeH_4$) was varied during preparation of the first layer, while the flow rate of $B_2H_6$ relative to $SiH_4$ was varied during preparation of the second layer, as indicated in Table G12, under otherwise the same conditions as in Example 103, to obtain respective image forming members (Sample Nos. 1201G to 1208G) for electrophotography.

Using the image forming members thus obtained, image were formed on transfer papers according to the same procedure and under the same conditions as in Example 103 to obtain the results as shown in Table G12.

EXAMPLE 105

In Examples 93 to 102, the conditions for preparation of the second layer were changed to those as shown in Tables G13 and G14, under otherwise the same conditions as in respective Examples to prepare image forming members (Sample Nos. 1301G to 1310G and 1401G to 1410G) for electrophotography, respectively.

Using the thus prepared image forming members, images were formed according to the same procedure and under the same conditions as in Example 93 to obtain the results as shown in Tables G13A and G14A.

EXAMPLE 106

Using an image forming member for electrophotography prepared under the same conditions as in Example 93, evaluation of the image quality was performed for the transferred toner images formed under the same toner image forming conditions as in Example 93 except that electrostatic images were formed by use of a GaAs system semiconductor laser (10 mW) at 810 nm in place of the tungsten lamp as the light source. As the result, there could be obtained clear images of high quality which were excellent in resolution and good in halftone reproducibility.

EXAMPLE 107

Image forming members for electrophotography (72 samples of Sample Nos. 12-201G to 12-208G, 12-301G to 12-308G, . . . , 12-1001G to 12-1009G), were prepared by following the same conditions and procedures as in Examples 94 to 102, respectively, except that the conditions for preparation of the amorphous layer (II) were changed to the respective conditions as shown in Table G15 below.

The image forming members thus obtained were individually set in a charging-exposure experimental device, subjected to corona charging at ⊕5.0 KV for 0.2 sec., followed immediately by irradiation of a light image. As the light source, a tungsten lamp was employed and irradiation was effected at 1.0 lux.sec. The latent image was developed with a negatively charged developer (containing toner and carrier) and transferred onto a plain paper. The transferred image was found to be very good. The toner not transferred remaining on the image forming member for electrophotography was subjected to cleaning with a rubber blade. Such steps were repeated for 100,000 times or more, but no deterioration of image was observed in any case.

The results of the overall image quality evaluation of the transferred image and evaluation of durability by repeated continuous usage are listed in Table G15.

EXAMPLE 108

Image forming members were prepared, respectively, according to the same method as in Example 93, except that sputtering was employed and the content ratio of silicon atoms to carbon atoms was varied in the amorphous layer (II) by varying the area ratio of silicon wafer to graphite during formation of the amorphous layer (II). For each of the thus prepared image forming members, the steps of image making, development and cleaning as described in Example 93 were repeated for about 50,000 times, followed by image evaluation, to obtain the results as shown in Table G16.

EXAMPLE 109

Image forming members were prepared, respectively, according to the same method as in Example 93, except that the content ratio of silicon atoms to carbon atoms was varied in the amorphous layer (II) by varying the flow rate ratio of $SiH_4$ gas to $C_2H_4$ gas during formation of the amorphous layer (II). For each of the thus prepared image forming members, the steps to transfer as described in Example 93 were repeated for about 50,000 times, followed by image evaluation, to obtain the results as shown in Table G17.

EXAMPLE 110

Image forming members were prepared, respectively, according to the same method as in Example 93, except that the content ratio of silicon atoms to carbon atoms was varied in the amorphous layer (II) by varying the flow rate ratio of $SiH_4$ gas:$SiF_4$ gas:$C_2H_4$ gas during formation of the amorphous layer (II). For each of the thus prepared image forming members, the steps of image making, development and cleaning as described in Example 93 were repeated for about 50,000 times, followed by image evaluation, to obtain the results as shown in Table G18.

EXAMPLE 111

The respective image forming members were prepared according to the same method as in Example 93, except that the layer thickness of the amorphous layer (II) was varied. For each sample, the steps of image-making, development and cleaning as described in Example 93 were repeated to obtain the results shown in Table G19.

EXAMPLE 112

By means of the preparation device as shown in FIG. 11, a first amorphous layer (I) was formed on a cylindrical aluminum substrate under the conditions as indicated in Table H1, while varying the gas flow rate ratio of $GeH_4$/He gas to $SiH_4$/He gas with lapse of time for layer formation in accordance with the change rate curve of gas flow rate ratio as shown in FIG. 19 and then a second amorphous layer (II) was formed under the conditions as shown in Table H1 to obtain an image forming member for electrophotography.

The image forming member thus obtained was set in a charging-exposure experimental device, subjected to corona charging at ⊕5.0 KV for 0.3 sec., followed immediately by irradiation of a light image. As the light source, a tungsten lamp was employed and irradiation was effected at 2 lux.sec. using a transmissive type test chart.

Immediately thereafter, a negatively charged developer (containing toner and carrier) was cascaded onto the surface of the image forming member, whereby a good toner image was obtained thereon. When the toner image on the member was transferred onto a transfer paper with corona charging at ⊕5.0 KV, there was obtained a clear image with high density which was excellent in resolution and good in halftone reproducibility.

EXAMPLE 113

By means of the preparation device as shown in FIG. 11, an image forming member for electrophotography was formed under the conditions as indicated in Table H2, while varying the gas flow rate ratio of $GeH_4$/He gas to $SiH_4$/He gas with lapse of time for layer formation in accordance with the change rate curve of gas flow rate ratio as shown in FIG. 20, under otherwise the same conditions as in Example 112.

Using the image forming member thus obtained, images were formed on transfer papers according to the same procedure and under the same conditions as in Example 112 to obtain very clear image quality.

EXAMPLE 114

By means of the preparation device as shown in FIG. 11, an image forming member for electrophotography was formed under the conditions as indicated in Table H3, while varying the gas flow rate ratio of $GeH_4$/He gas to $SiH_4$/He gas with lapse of time for layer formation in accordance with the change rate curve of gas flow rate ratio as shown in FIG. 14, under otherwise the same conditions as in Example 112.

Using the image forming member thus obtained, images were formed on transfer papers according to the same procedure and under the same conditions as in Example 112 to obtain very clear image quality.

EXAMPLE 115

By means of the preparation device as shown in FIG. 11, an image forming member for electrophotography was formed under the conditions as indicated in Table H4, while varying the gas flow rate ratio of $GeH_4$/He gas to $SiH_4$/He gas with lapse of time for layer formation in accordance with the change rate curve of gas flow rate ratio as shown in FIG. 21, under otherwise the same conditions as in Example 112.

Using the image forming member thus obtained, images were formed on transfer papers according to the same procedure and under the same conditions as in Example 112 to obtain very clear image quality.

EXAMPLE 116

By means of the preparation device as shown in FIG. 11, an image forming member for electrophotography was formed under the conditions as indicated in Table H5, while varying the gas flow rate ratio of $GeH_4$/He gas to $SiH_4$/He gas with lapse of time for layer formation in accordance with the change rate curve of gas flow rate ratio as shown in FIG. 22, under otherwise the same conditions as in Example 112.

Using the image forming member thus obtained, images were formed on transfer papers according to the same procedure and under the same conditions as in Example 112 to obtain very clear image quality.

EXAMPLE 117

By means of the preparation device as shown in FIG. 11, an image forming member for electrophotography was formed under the conditions as indicated in Table H6, while varying the gas flow rate ratio of $GeH_4$/He gas to $SiH_4$/He gas with lapse of time for layer formation in accordance with the change rate curve of gas flow rate ratio as shown in FIG. 23, under otherwise the same conditions as in Example 112.

Using the image forming member thus obtained, images were formed on transfer papers according to the same procedure and under the same conditions as in Examples 112 to obtain very clear image quality.

EXAMPLE 118

By means of the preparation device as shown in FIG. 11, an image forming member for electrophotography was formed under the conditions as indicated in Table H7, while varying the gas flow rate ratio of $GeH_4$/He gas to $SiH_4$/He gas with lapse of time for layer formation in accordance with the change rate curve of gas flow rate ratio as shown in FIG. 24, under otherwise the same conditions as in Example 112.

Using the image forming member thus obtained, images were formed on transfer papers according to the same procedure and under the same conditions as in Example 112 to obtain very clear image quality.

EXAMPLE 119

An image forming member for electrophotography was formed under the same conditions as in Example 112 except that $Si_2H_6$/He gas was employed in place of $SiH_4$/He gas and the conditions were changed to those as indicated in Table H8.

Using the image forming member thus obtained, images were formed on transfer papers according to the same procedure and under the same conditions as in Example 112 to obtain very clear image quality.

EXAMPLE 120

An image forming member for electrophotography was formed under the same conditions as in Example 112 except that $SiF_4$/He gas was employed in place of $SiH_4$/He gas and the conditions were changed to those as indicated in Table H9.

Using the image forming member thus obtained, images were formed on transfer papers according to the same procedure and under the same conditions as in Example 112 to obtain very clear image quality.

EXAMPLE 121

An image forming member for electrophotography was formed under the same conditions as in Example 112 except that ($SiH_4$/He + $SiF_4$/He) gas was employed in place of $SiH_4$/He gas and the conditions were changed to those as indicated in Table H10.

Using the image forming member thus obtained, images were formed on transfer papers according to the same procedure and under the same conditions as in Example 112 to obtain very clear image quality.

EXAMPLE 122

By means of the preparation device as shown in FIG. 11, a first amorphous layer (I) was formed on a cylindrical aluminum substrate under the conditions as indicated in Table H11, while varying the gas flow rate ratio of $GeH_4$/He gas to $SiH_4$/He gas with lapse of time for layer formation in accordance with the change rate curve of gas flow rate ratio as shown in FIG. 19 and then a second amorphous layer (II) was formed under the conditions as shown in Table H11 to obtain an image forming member for electrophotography.

The image forming member thus obtained was set in a charging-exposure experimental device, subjected to corona charging at ⊕5.0 KV for 0.3 sec., followed immediately by irradiation of a light image. As the light source, a tungsten lamp was employed and irradiation was effected at 2 lux.sec. using a transmissive type test chart.

Immediately thereafter, a negatively charged developer (containing toner and carrier) was cascaded onto the surface of the image forming member, whereby a good toner image was obtained thereon. When the toner image on the member was transferred onto a transfer paper with corona charging at ⊕5.0 KV, there was obtained a clear image with high density which was excellent in resolution and good in halftone reproducibility.

EXAMPLE 123

In Example 122, the flow rate of $B_2H_6$ relative to ($SiH_4$ + $GeH_4$) was varied during preparation of the first layer, while the flow rate of $B_2H_6$ relative to $SiH_4$ was varied during preparation of the second layer, as indicated in Table H12, under otherwise the same conditions as in Example 122, to obtain respective image forming members for electrophotography.

Using the image forming members thus obtained, images were formed on transfer papers according to the same procedure and under the same conditions as in Example 122 to obtain good results.

EXAMPLE 124

In Examples 112 to 121, the conditions for preparation of the second layer were changed to those as shown in Table H13, under otherwise the same conditions as in respective Examples, to prepare image forming members for electrophotography, respectively.

Using the thus prepared image forming members, images were formed according to the same procedure and under the same conditions as in Example 112 to obtain the results as shown in Table H13A.

EXAMPLE 125

In Examples 112 to 121, the conditions for preparation of the second layer were changed to those as shown in Table H14, under otherwise the same conditions as in respective Examples, to prepare image forming members for electrophotography, respectively.

Using the thus prepared image forming members, images were formed according to the same procedure and under the same conditions as in Example 112 to obtain the results as shown in Table H14.

EXAMPLE 126

Using an image forming member for electrophotography prepared under the same conditions as in Example 112, evaluation of the image quality was performed for the transferred toner images formed under the same toner image forming conditions as in Example 112 except that electrostatic images were formed by use of a GaAs system semiconductor laser (10 mW) at 810 nm in place of the tungsten lamp as the light source. As the result, there could be obtained clear images of high quality which were excellent in resolution and good in halftone reproducibility.

EXAMPLE 127

Image forming members for electrophotography (72 samples of Sample Nos. 12-201H to 12-208H, 12-301H to 12-308H, . . . , 12-1001H to 12-1008H) were prepared by following the same conditions and procedures as in Examples 113 to 121, respectively, except that the conditions for preparation of the amorphous layer (II) were changed to the respective conditions as shown in Table H15 below.

The image forming members thus obtained were individually set in a charging-exposure experimental device, subjected to corona charging at ⊕5.0 KV for 0.2 sec., followed immediately by irradiation of a light image. As the light source, a tungsten lamp was employed and irradiation was effected at 1.0 lux.sec. The latent image was developed with a negatively charged developer (containing toner and carrier) and transferred onto a plain paper. The transferred image was found to be very good. The toner not transferred remaining on the image forming member for electrophotography was subjected to cleaning with a rubber blade. Such steps were repeated for 100,000 times or more, but no deterioration of image was observed in any case.

The results of the overall image quality evaluation of the transferred image and evaluation of durability by repeated continuous usage are listed in Table H16.

EXAMPLE 128

Image forming members were prepared, respectively, according to the same method as in Example 112, except that sputtering was employed and the content ratio of silicon atoms to carbon atoms was varied in the amorphous layer (II) by varying the area ratio of silicon wafer to graphite during formation of the amorphous layer (II). For each of the thus prepared image forming members, the steps of image making, development and cleaning as described in Example 112 were repeated for about 50,000 times, followed by image evaluation, to obtain the results as shown in Table H17.

EXAMPLE 129

Image forming members were prepared, respectively, according to the same method as in Example 112, except that the content ratio of silicon atoms to carbon atoms was varied in the amorphous layer (II) by varying the flow rate ratio of $SiH_4$ gas to $C_2H_4$ gas during formation of the amorphous layer (II). For each of the thus prepared image forming members, the steps to transfer as described in Example 112 were repeated for about 50,000 times, followed by image evaluation, to obtain the results as shown in Table H18.

EXAMPLE 130

Image forming members were prepared, respectively, according to the same method as in Example 112, except that the content ratio of silicon atoms to carbon atoms was varied in the amorphous layer (II) by varying the flow rate ratio of $SiH_4$ gas:$SiF_4$ gas:$C_2H_4$ gas during formation of the amorphous layer (II). For each of the thus prepared image forming members, the steps of image making, development and cleaning as described in Example 112 were repeated for about 50,000 times, followed by image evaluation, to obtain the results as shown in Table H19.

EXAMPLE 131

The respective image forming members were prepared according to the same method as in Example 112, except that the layer thickness of the amorphous layer (II) was varied. For each sample, the steps of image-making, development and cleaning as described in Example 112 were repeated to obtain the results shown in Table H20.

The common layer forming conditions employed in the above Examples of the present invention as shown below:

Substrate temperature:

for germanium atom (Ge) containing layer . . . about 200° C.

for no germanium atom (Ge) containing layer . . . about 250° C.

Discharging frequency: 13.56 MHz.

Inner pressure in reaction chamber during reaction: 0.3 Torr.

TABLE A1

| Layer constitution | | Gases employed | Flow rate (SCCM) | Flow rate ratio | Discharging power (W/cm²) | Layer formation speed (A/sec) | Layer thickness (μ) |
|---|---|---|---|---|---|---|---|
| Amorphous layer (I) | First layer | $SiH_4$/He = 0.05<br>$GeH_4$/He = 0.05 | $SiH_4$ + $GeH_4$ = 50 | $GeH_4/SiH_4$ = 1 | 0.18 | 5 | 3 |
| | Second | $SiH_4$/He = 0.5 | $SiH_4$ = 200 | | 0.18 | 15 | 15 |
| Amorphous | | $SiH_4$/He = 0.5 | $SiH_4$ = 100 | $SiH_4/C_2H_4$ = 3/7 | 0.18 | 10 | 0.5 |

TABLE A1-continued

| Layer constitution | Gases employed | Flow rate (SCCM) | Flow rate ratio | Dis-charging power ($W/cm^2$) | Layer formation speed (A/sec) | Layer thick-ness (μ) |
|---|---|---|---|---|---|---|
| layer (II) | $C_2H_4$ | | | | | |

TABLE A2

| Layer constitution | | Gases employed | Flow rate (SCCM) | Flow rate ratio | Dis-charging power ($W/cm^2$) | Layer Formation speed (Å/sec) | Layer thick-ness (μ) |
|---|---|---|---|---|---|---|---|
| Amorphous layer (I) | First layer | $SiH_4/He = 0.05$ $GeH_4/He = 0.05$ | $SiH_4 + GeH_4 = 50$ | $GeH_4/SiH_4 = 0.1$ | 0.18 | 5 | 20 |
| | Second layer | $SiH_4/He = 0.5$ | $SiH_4 = 200$ | | 0.18 | 15 | 5 |

TABLE A3

| Layer constitution | | Gases employed | Flow rate (SCCM) | Flow rate ratio | Dis-charging power ($W/cm^2$) | Layer formation speed (Å/sec) | Layer thick-ness (μ) |
|---|---|---|---|---|---|---|---|
| Amorphous layer (I) | First layer | $SiH_4/He = 0.05$ $GeH_4/He = 0.05$ | $SiH_4 + GeH_4 = 50$ | $GeH_4/SiH_4 = 0.4$ | 0.18 | 5 | 2 |
| | Second layer | $SiH_4/He = 0.5$ $B_2H_6/He = 10^{-3}$ | $SiH_4 = 200$ | $B_2H_6/SiH_4 = 2 \times 10^{-5}$ | 0.18 | 15 | 20 |

TABLE A4

| Sample No. | 401A | 402A | 403A | 404A | 405A | 406A | 407A |
|---|---|---|---|---|---|---|---|
| Ge content (atomic %) | 1 | 3 | 5 | 10 | 40 | 60 | 90 |
| Evaluation | Δ | o | o | ◎ | ◎ | o | Δ |

◎: Excellent
o: Good
Δ: Practically satisfactory

TABLE A5

| Sample No. | 501A | 502A | 503A | 504A | 505A |
|---|---|---|---|---|---|
| Layer thickness (μ) | 0.1 | 0.5 | 1 | 2 | 5 |
| Evaluation | o | o | ◎ | ◎ | o |

◎: Excellent
o: Good

TABLE A6

| Layer constitution | | Gases employed | Flow rate (SCCM) | Flow rate ratio | Dis-charging power ($W/cm^2$) | Layer formation speed (Å/sec) | Layer thick-ness (μ) |
|---|---|---|---|---|---|---|---|
| Amorphous layer (I) | First layer | $SiH_4/He = 0.05$ $GeH_4/He = 0.05$ | $SiH_4 + GeH_4$ | $GeH_4/SiH_4 = 1$ | 0.18 | 5 | 2 |
| | Second layer | $SiH_4/He = 0.5$ $PH_3/He = 10^{-3}$ | $SiH_4 = 200 =$ 50 | $PH_3/SiH_4 = 1 \times 10^{-7}$ | 0.18 | 15 | 20 |

TABLE A7

| Condition | Gases employed | Flow rate (SCCM) | Flow rate ratio or area ratio | Discharging power ($W/cm^2$) | Layer thickness (μ) |
|---|---|---|---|---|---|
| 12-1 | Ar | 200 | Si wafer:Graphite = 1.5:8.5 | 0.3 | 0.5 |
| 12-2 | Ar | 200 | Si wafer:Graphite = 0.5:9.5 | 0.3 | 0.3 |
| 12-3 | Ar | 200 | Si wafer:Graphite = 6:4 | 0.3 | 1.0 |
| 12-4 | $SiH_4/He = 1$ $C_2H_4$ | $SiH_4 = 15$ | $SiH_4:C_2H_4 = 0.4:9.6$ | 0.18 | 0.3 |
| 12-5 | $SiH_4/He = 0.5$ $C_2H_4$ | $SiH_4 = 100$ | $SiH_4:C_2H_4 = 5:5$ | 0.18 | 1.5 |
| 12-6 | $SiH_4/He = 0.5$ $SiF_4/He = 0.5$ $C_2H_4$ | $SiH_4 + SiF_4 =$ 150 | $SiH_4:SiF_4:C_2H_4 = 1.5:1.5:7$ | 0.18 | 0.5 |
| 12-7 | $SiH_4/He = 0.5$ $SiF_4/He = 0.5$ $C_2H_4$ | $SiH_4 + SiF_4 =$ 15 | $SiH_4:SiF_4:C_2H_4 = 0.3:0.1:9.6$ | 0.18 | 0.3 |
| 12-8 | $SiH_4/He = 0.5$ $SiF_4/He = 0.5$ $C_2H_4$ | $SiH_4 + SiF_4 =$ 150 | $SiH_4:SiF_4:C_2H_4 = 3:3:4$ | 0.18 | 1.5 |

TABLE A8

Amorphous layer (II)

TABLE A8-continued

| preparation condition | Sample No./Evaluation | | |
|---|---|---|---|
| 8-1A | 8-201A | 8-301A | 8-601A |
| | o o | o o | o o |
| 8-2A | 8-202A | 8-302A | 8-602A |
| | o o | o o | o o |
| 8-3A | 8-203A | 8-303A | 8-603A |
| | o o | o o | o o |
| 8-4A | 8-204A | 8-304A | 8-604A |
| | ◎ ◎ | ◎ ◎ | ◎ ◎ |
| 8-5A | 8-205A | 8-305A | 8-605A |
| | ◎ ◎ | ◎ ◎ | ◎ ◎ |
| 8-6A | 8-206A | 8-306A | 8-606A |
| | ◎ ◎ | ◎ ◎ | ◎ ◎ |
| 8-7A | 8-207A | 8-307A | 8-607A |
| | o o | o o | o o |
| 8-8A | 8-208A | 8-308A | 8-608A |
| | o o | o o | o o |
| | Sample No. | | |
| | Overall image | Durability | |

TABLE A8-continued

| | quality evaluation | evaluation |
|---|---|---|

Evaluation standards:
◎ Excellent
o Good

TABLE A9

| Sample No. | 901A | 902A | 903A | 904A | 905A | 906A | 907A |
|---|---|---|---|---|---|---|---|
| Si:C target (area ratio) | 9:1 | 6.5:3.5 | 4:6 | 2:8 | 1:9 | 0.5:9.5 | 0.2:9.8 |
| Si:C (content ratio) | 9.7:0.3 | 8.8:1.2 | 7.3:2.7 | 4.8:5.2 | 3:7 | 2:8 | 0.8:9.2 |
| Image quality evaluation | Δ | o | ◎ | ◎ | o | Δ | X |

◎: Very good
o: Good
Δ: Practically satisfactory
X: Image defect formed

TABLE A10

| Sample No. | 1001A | 1002A | 1003A | 1004A | 1005A | 1006A | 1007A | 1008A |
|---|---|---|---|---|---|---|---|---|
| $SiH_4$:$C_2H_4$ (flow rate ratio) | 9:1 | 6:4 | 4:6 | 2:8 | 1:9 | 0.5:9.5 | 0.35:9.65 | 0.2:9.8 |
| Si:C (content ratio) | 9:1 | 7:3 | 5.5:4.5 | 4:6 | 3:7 | 2:8 | 1.2:8.8 | 0.8:9.2 |
| Image quality evaluation | Δ | o | ◎ | ◎ | ◎ | o | Δ | X |

◎: Very good
o: Good
Δ: Practically satisfactory
X: Image defect formed

TABLE A11

| Sample No. | 1101A | 1102A | 1103A | 1104A | 1105A | 1106A | 1107A | 1108A |
|---|---|---|---|---|---|---|---|---|
| $SiH_4$:$SiF_4$:$C_2H_4$ (flow rate ratio) | 5:4:1 | 3:3.5:3.5 | 2:2:6 | 1:1:8 | 0.6:0.4:9 | 0.2:0.3:9.5 | 0.2:0.15:9.65 | 0.1:0.1:9.8 |
| Si:C (content ratio) | 9:1 | 7:3 | 5.5:4.5 | 4:6 | 3:7 | 2:8 | 1.2:8.8 | 0.8:9.2 |
| Image quality evaluation | Δ | o | ◎ | ◎ | ◎ | o | Δ | X |

◎: Very good
o: Good
Δ: Practically satisfactory
X: Image defect formed

TABLE A12

| Sample No. | Thickness of amorphous layer (II) (μ) | Results |
|---|---|---|
| 1201A | 0.001 | Image defect liable to occur |
| 1202A | 0.02 | No image defect during 20.000 repetitions |
| 1203A | 0.05 | Stable for 50.000 repetitions or more |
| 1204A | 1 | Stable for 200.000 repetitions or more |

TABLE B1

| Layer constitution | | Gases employed | Flow rate (SCCM) | Flow rate ratio | Discharging power ($W/cm^2$) | Layer formation speed (A/sec) | Layer thickness (μ) |
|---|---|---|---|---|---|---|---|
| Amorphous layer (I) | First layer | $SiH_4$/He = 0.05<br>$GeH_4$/He = 0.05<br>NO | $SiH_4$ + $GeH_4$ = 50 | $GeH_4$/$SiH_4$ = 1/1<br>NO/($GeH_4$ + $SiH_4$) = 2/100 | 0.18 | 5 | 3 |
| | Second layer | $SiH_4$/He = 0.5 | $SiH_4$ = 200 | | 0.18 | 15 | 15 |
| Amorphous layer (II) | | $SiH_4$/He = 0.5<br>$C_2H_4$ | $SiH_4$ = 100 | $SiH_4$:$C_2H_4$ = 3:7 | 0.8 | 10 | 0.5 |

TABLE B2

| Layer constitution | | Gases employed | Flow rate (SCCM) | Flow rate ratio | Discharging power (W/cm$^2$) | Layer formation speed (A/sec) | Layer thickness ($\mu$) |
|---|---|---|---|---|---|---|---|
| Amorphous layer (I) | First layer | $SiH_4$/He = 0.05<br>$GeH_4$/He = 0.05<br>NO | $SiH_4 + GeH_4$ = 50 | $GeH_4/SiH_4$ = 1/10<br>NO/($GeH_4 + SiH_4$) = 3/100~0<br>(Linearly decreased) | 0.18 | 5 | 5 |
| | Second layer | $SiH_4$/He = 0.05<br>$GeH_4$/He = 0.05 | $SiH_4 + GeH_4$ = 50 | $GeH_4/SiH_4$ = 1/10 | 0.18 | 5 | 1 |
| | Third layer | $SiH_4$/He = 0.5 | $SiH_4$ = 200 | | 0.18 | 15 | 15 |

TABLE B3

| Layer constitution | | Gases employed | Flow rate (SCCM) | Flow rate ratio | Discharging power (W/cm$^2$) | Discharging tion speed (A/sec) | Layer thickness ($\mu$) |
|---|---|---|---|---|---|---|---|
| Amorphous layer (I) | First layer | $SiH_4$/He = 0.5<br>$GeH_4$/He = 0.05<br>NO | $SiH_4 + GeH_4$ = 50 | $GeH_4/SiH_4$ = 4/10<br>NO/($GeH_4 + SiH_4$) = 2/100 | 0.18 | 5 | 2 |
| | Second layer | $SiH_4$/He = 0.5<br>NO<br>$B_2H_6$/He = $10^{-3}$ | $SiH_4$ = 200 | NO/$SiH_4$ = 2/100<br>$B_2H_6/SiH_4 = 1 \times 10^{-5}$ | 0.18 | 15 | 2 |
| | Third layer | $SiH_4$/He = 0.5<br>$B_2H_6$/He = $10^{-3}$ | $SiH_4$ = 200 | $B_2H_6/SiH_4 = 1 \times 10^{-5}$ | 0.18 | 15 | 15 |

TABLE B4

| Sample No. | 401B | 402B | 403B | 404B | 405B | 406B | 407B |
|---|---|---|---|---|---|---|---|
| Ge content (atomic %) | 1 | 3 | 5 | 10 | 40 | 60 | 90 |
| Evaluation | Δ | o | ◎ | ◎ | ◎ | o | Δ |

◎: Excellent
o: Good
Δ: Practically satisfactory

TABLE B5

| Sample No. | 501B | 502B | 503B | 504B | 505B |
|---|---|---|---|---|---|
| Layer thickness ($\mu$) | 0.1 | 0.5 | 1 | 2 | 5 |
| Evaluation | o | o | ◎ | ◎ | o |

◎: Excellent
o: Good

TABLE B6

| Layer constitution | | Gases employed | Flow rate (SCCM) | Flow rate ratio | Discharging power (W/cm$^2$) | Layer formation speed (A/sec) | Layer thickness ($\mu$) |
|---|---|---|---|---|---|---|---|
| Amorphous layer (I) | First layer | $SiH_4$/He = 0.05<br>$GeH_4$/He = 0.05<br>NO | $SiH_4 + GeH_4$ = 50 | $GeH_4/SiH_4$ = 4/10<br>NO/($GeH_4 + SiH_4$) = 2/100 | 0.18 | 5 | 2 |
| | Second layer | $SiH_4$/He = 0.5<br>$PH_3$/He = $10^{-3}$ | $SiH_4$ = 200 | $PH_3/SiH_4 = 1 \times 10^{-7}$ | 0.18 | 15 | 20 |

TABLE B7

| Condition | Gases employed | Flow rate (SCCM) | Flow rate ratio or area ratio | Discharging power (W/cm$^2$) | Layer thickness ($\mu$) |
|---|---|---|---|---|---|
| 12-1B | Ar | 200 | Si wafer:Graphite = 1.5:8.5 | 0.3 | 0.5 |
| 12-2B | Ar | 200 | Si wafer:Graphite = 0.5:9.5 | 0.3 | 0.3 |
| 12-3B | Ar | 200 | Si wafer:Graphite = 6:4 | 0.3 | 1.0 |
| 12-4B | $SiH_4$/He = 1<br>$C_2H_4$ | $SiH_4$ = 15 | $SiH_4:C_2H_4$ = 0.4:9.6 | 0.18 | 0.3 |
| 12-5B | $SiH_4$/He = 0.5<br>$C_2H_4$ | $SiH_4$ = 100 | $SiH_4:C_2H_4$ = 5:5 | 0.18 | 1.5 |
| 12-6B | $SiH_4$/He = 0.5<br>$SiF_4$/He = 0.5<br>$C_2H_4$ | $SiH_4 + SiF_4$ = 150 | $SiH_4:SiF_4:C_2H_4$ = 1.5:1.5:7 | 0.18 | 0.5 |
| 12-7B | $SiH_4$/He = 0.5<br>$SiF_4$/He = 0.5<br>$C_2H_4$ | $SiH_4 + SiF_4$ = 15 | $SiH_4:SiF_4:C_2H_4$ = 0.3:0.1:9.6 | 0.18 | 0.3 |
| 12-8B | $SiH_4$/He = 0.5<br>$SiF_4$/He = 0.5 | $SiH_4 + SiF_4$ = 150 | $SiH_4:SiF_4:C_2H_4$ = 3:3:4 | 0.18 | 1.5 |

TABLE B7-continued

| Condition | Gases employed | Flow rate (SCCM) | Flow rate ratio or area ratio | Discharging power ($W/cm^2$) | Layer thickness ($\mu$) |
|---|---|---|---|---|---|
| | $C_2H_4$ | | | | |

TABLE B8

| Amorphous layer (II) preparation condition | Sample No./Evaluation | | |
|---|---|---|---|
| 12-1B | 12-201B | 12-301B | 12-601B |
| | o o | o o | o o |
| 12-2B | 12-202B | 12-302B | 12-602B |
| | o o | o o | o o |
| 12-3B | 12-203B | 12-303B | 12-603B |
| | o o | o o | o o |
| 12-4B | 12-204B | 12-304B | 12-604B |
| | ◎ ◎ | ◎ ◎ | ◎ ◎ |
| 12-5B | 12-205B | 12-305B | 12-605B |
| | ◎ ◎ | ◎ ◎ | ◎ ◎ |
| 12-6B | 12-2-6B | 12-306B | 12-606B |

TABLE B8-continued

| | | | |
|---|---|---|---|
| | ◎ ◎ | ◎ ◎ | ◎ ◎ |
| 12-7B | 12-207B | 12-307B | 12-607B |
| | o o | o o | o o |
| 12-8B | 12-208B | 12-308B | 12-608B |
| | o o | o o | o o |
| | Sample No. | | |
| | Overall image quality evaluation | | Durability evaluation |

Evaluation standards:
◎ . . . Excellent
o . . . Good

TABLE B9

| Sample No. | 901B | 902B | 903B | 904B | 905B | 906B | 907B |
|---|---|---|---|---|---|---|---|
| Si:C target (area ratio) | 9:1 | 6.5:3.5 | 4:6 | 2:8 | 1:9 | 0.5:9.5 | 0.2:9.8 |
| Si:C (content ratio) | 9.7:0.3 | 8.8:1.2 | 7.3:2.7 | 4.8:5.2 | 3:7 | 2:8 | 0.8:9.2 |
| Image quality evaluation | Δ | o | ◎ | ◎ | o | Δ | X |

◎ : Very good
o: Good
Δ: Practically satisfactory
X: Image defect formed

TABLE B10

| Sample No. | 1001B | 1002B | 1003B | 1004B | 1005B | 1006B | 1007B | 1008B |
|---|---|---|---|---|---|---|---|---|
| $SiH_4$:$C_2H_4$ (flow rate ratio) | 9:1 | 6:4 | 4:6 | 2:8 | 1:9 | 0.5:9.5 | 0.35:9.65 | 0.2:9.8 |
| Si:C (content ratio) | 9:1 | 7:3 | 5.5:4.5 | 4:6 | 3:7 | 2:8 | 1.2:8.8 | 0.8:9.2 |
| Image quality evaluation | Δ | o | ◎ | ◎ | ◎ | o | Δ | X |

◎ : Very good
o: Good
Δ: Practically satisfactory
X: Image defect formed

TABLE B11

| Sample No. | 1101B | 1102B | 1103B | 1104B | 1105B | 1106B | 1107B | 1108B |
|---|---|---|---|---|---|---|---|---|
| $SiH_4$:$SiF_4$:$C_2H_4$ (flow rate ratio) | 5:4:1 | 3:3.5:3.5 | 2:2:6 | 1:1:8 | 0.6:0.4:9 | 0.2:0.3:9.5 | 0.2:0.15:9.65 | 0.1:0.1:9.8 |
| Si:C (content ratio) | 9:1 | 7:3 | 5.5:4.5 | 4:6 | 3:7 | 2:8 | 1.2:8.8 | 0.8:9.2 |
| Image quality evaluation | Δ | o | ◎ | ◎ | ◎ | o | Δ | X |

◎ Very good
o: Good
Δ: Practically satisfactory
X: Image defect formed

TABLE B12

| Sample No. | Thickness of amorphous layer (II) ($\mu$) | Results |
|---|---|---|
| 1201B | 0.001 | Image defect liable to occur |
| 1202B | 0.02 | No image defect during 20,000 repetitions |
| 1203B | 0.05 | Stable for 50,000 repetitions or more |
| 1204B | 1 | Stable for 200,000 repetitions or more |

TABLE C1

| Layer constitution | | Gases employed | Flow rate (SCCM) | Flow rate ratio | Discharging power (W/cm$^2$) | Layer formation speed (Å/sec) | Layer thickness (μ) |
|---|---|---|---|---|---|---|---|
| Amorphous layer (I) | First layer | $SiH_4/He = 0.05$<br>$GeH_4/He = 0.05$<br>$B_2H_6/He = 10^{-3}$<br>NO | $SiH_4 + GeH_4 = 50$ | $GeH_4/SiH_4 = 3/10$<br>$B_2H_6/(GeH_4 + SiH_4) = 3 \times 10^{-3}$<br>$NO/(GeH_4 + SiH_4) = 3/100$ | 0.18 | 5 | 1 |
| | Second layer | $SiH_4/He = 0.5$ | $SiH_4 = 200$ | | 0.18 | 15 | 20 |
| Amorphous layer (ii) | | $SiH_4/He = 0.5$<br>$C_2H_4$ | $SiH_4 = 100$ | $SiH_4:C_2H_4 = 3:7$ | 0.18 | 10 | 0.5 |

TABLE C2

| Layer constitution | | Gases employed | Flow rate (SCCM) | Flow rate ratio | Discharging power (W/cm$^2$) | Layer formation speed (Å/sec) | Layer thickness (μ) |
|---|---|---|---|---|---|---|---|
| Amorphous layer (I) | First layer | $SiH_4He = 0.05$<br>$GeH_4/He = 0.05$<br>$B_2H_6/He = 10^{-3}$<br>NO | $SiH_4 + GeH_4 = 50$ | $GeH_4/SiH_4 = 1/10$<br>$B_2H_6/(GeH_4 + SiH_4) = 3 \times 10^{-3}$<br>$NO/(GeH_4 + SiH_4) = 3/100$ | 0.18 | 5 | 1 |
| | Second layer | $SiH_4/He = 0.05$<br>$GeH_4/He = 0.05$ | $SiH_4 + GeH_4 = 50$ | $GeH_4/SiH_4 = 1/10$ | 0.18 | 5 | 19 |
| | Third layer | $SiH_4/He = 0.5$ | $SiH_4 = 200$ | | 0.18 | 15 | 5 |

TABLE C3

| Layer constitution | Gases employed | Flow rate (SCCM) | Flow rate ratio | Discharging power (W/cm$^2$) | Layer formation speed (Å/sec) | Layer thickness (μ) |
|---|---|---|---|---|---|---|
| Amorphous layer (I) | | | | | | |
| First layer | $SiH_4/He = 0.05$<br>$GeH_4/He = 0.05$<br>$B_2H_6/He = 10^{-3}$<br>NO | $SiH_4 + GeH_4 = 50$ | $GeH_4/SiH_4 = 3/10$<br>$B_2H_6/(GeH_4 + SiH_4) = 5 \times 10^{-3}$<br>$NO/(GeH_4 + SiH_4) = 1/100$ | 0.18 | 5 | 2 |
| Second layer | $SiH_4/He = 0.5$<br>$B_2H_6/He = 10^{-3}$ | $SiH_4 = 200$ | $B_2H_6/SiH_4 = 2 \times 10^{-4}$ | 0.18 | 15 | 20 |

TABLE C4

| Sample No. | 401C | 402C | 403C | 404C | 405C | 406C | 407C | 408C |
|---|---|---|---|---|---|---|---|---|
| $GeH_4/SiH_4$ Flow rate ratio | 5/100 | 1/10 | 2/10 | 4/10 | 5/10 | 7/10 | 8/10 | 1/1 |
| Ge content (atomic %) | 4.3 | 8.4 | 15.4 | 26.7 | 32.3 | 38.9 | 42 | 47.6 |
| Evaluation | ◎ | ◎ | ◎ | ◎ | ◎ | o | o | o |

◎ : Excellent
o: Good

TABLE C5

| Sample No. | 501C | 502C | 503C | 504C | 505C | 506C | 507C | 508C |
|---|---|---|---|---|---|---|---|---|
| Layer thickness | 30Å | 500Å | 0.1μ | 0.3μ | 0.8μ | 3μ | 4μ | 5μ |
| Evaluation | Δ | o | ◎ | ◎ | ◎ | o | o | Δ |

◎ :Excellent
o: Good
Δ: Practically satisfactory

TABLE C6

| Layer constitution | Gases employed | Flow rate (SCCM) | Flow rate ratio | Discharging power (W/cm$^2$) | Layer formation speed (Å/sec) | Layer thickness (μ) |
|---|---|---|---|---|---|---|
| Amorphous layer (I) | | | | | | |
| First layer | $SiH_4/He = 0.05$<br>$GeH_4/He = 0.05$<br>$B_2H_6/He = 10^{-3}$<br>NO | $SiH_4 + GeH_4 = 50$ | $GeH_4/SiH_4 = 5/10$<br>$B_2H_6/(GeH_4 + SiH_4) = 5 \times 10^{-3}$<br>$NO/(GeH_4 + SiH_4) = 1/100$ | 0.18 | 5 | 2 |
| Second layer | $SiH_4/He = 0.5$<br>$PH_3/He = 10^{-3}$ | $SiH_4 = 200$ | $PH_3/SiH_4 = 9 \times 10^{-5}$<br>(Sample No. 601C) | 0.18 | 15 | 20 |

TABLE C7

| Layer constitution | Gases employed | Flow rate (SCCM) | Flow rate ratio | Discharging power (W/cm$^2$) | Layer formation speed (A/sec) | Layer thickness ($\mu$) |
|---|---|---|---|---|---|---|
| Amorphous layer (I) | | | | | | |
| First layer | $SiH_4/He = 0.05$<br>$GeH_4/He = 0.05$<br>$B_2H_6/He = 10^{-3}$<br>NO | $SiH_4 + GeH_4 = 50$ | $GeH_4/SiH_4 = 1/10$<br>$B_2H_6/(GeH_4 + SiH_4) = 8 \times 10^{-4}$<br>$NO/(GeH_4 + SiH_4) = 1/100$ | 0.18 | 5 | 15 |
| Second layer | $SiH_4/He = 0.5$<br>$PH_3/He = 10^{-3}$ | $SiH_4 = 200$ | $PH_3/SiH_4 = 1 \times 10^{-5}$<br>(Sample No. 602C) | 0.18 | 15 | 5 |

TABLE C8

| Layer constitution | Gases employed | Flow rate (SCCM) | Flow rate ratio | Discharging power (W/cm$^2$) | Layer formation speed (A/sec) | Layer thickness ($\mu$) |
|---|---|---|---|---|---|---|
| Amorphous layer (I) | | | | | | |
| First layer | $SiH_4/He = 0.05$<br>$GeH_4/He = 0.05$<br>$B_2H_6/He = 10^{-3}$<br>NO | $SiH_4 + GeH_4 = 50$ | $GeH_4/SiH_4 = 3/10$<br>$B_2H_6/(GeH_4 + SiH_4) = 3 \times 10^{-3}$<br>$NO/(GeH_4 + SiH_4) = 3/100$ | 0.18 | 5 | 1 |
| Second layer | $SiH_4/He = 0.5$<br>$B_2H_6/He = 10^{-3}$ | $SiH_4 = 200$ | $B_2H_6/SiH_4 = 3 \times 10^{-4}$<br>(Sample No. 603C) | 0.18 | 15 | 20 |

TABLE C9

| Layer constitution | Gases employed | Flow rate (SCCM) | Flow rate ratio | Discharging power (W/cm$^2$) | Layer formation speed (A/sec) | Layer thickness ($\mu$) |
|---|---|---|---|---|---|---|
| Amorphous layer (I) | | | | | | |
| First layer | $SiH_4/He = 0.05$<br>$GeH_4/He = 0.05$<br>$B_2H_6/He = 10^{-3}$<br>NO | $SiH_4 + GeH_4 = 50$ | $GeH_4/SiH_4 = 1/10$<br>$B_2H_6/(GeH_4 + SiH_4) = 1 \times 10^{-5}$<br>$NO/(GeH_4 + SiH_4) = 3/100$ | 0.18 | 5 | 1 |
| Second layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 1/10$<br>$B_2H_6/(GeH_4 + SiH_4) = 1 \times 10^{-5}$ | 0.18 | 5 | 19 |
| Third layer | $SiH_4/He = 0.5$<br>$B_2H_6/He = 10^{-3}$ | $SiH_4 = 200$ | $B_2H_6/SiH_4 = 3 \times 10^{-4}$<br>(Sample No. 701C) | 0.18 | 15 | 5 |

TABLE C10

| Layer constitution | Gases employed | Flow rate (SCCM) | Flow rate ratio | Discharging power (W/cm$^2$) | Layer formation speed (A/sec) | Layer thickness ($\mu$) |
|---|---|---|---|---|---|---|
| Amorphous layer (I) | | | | | | |
| First layer | $SiH_4/He = 0.05$<br>$GeH_4/He = 0.05$<br>$B_2H_6/He = 10^{-3}$<br>NO | $SiH_4 + GeH_4 = 50$ | $GeH_4/SiH_4 = 3/10$<br>$B_2H_6/(GeH_4 + SiH_4) = 1 \times 10^{-5}$<br>$NO/(SiH_4 = 3/100$ | 0.18 | 5 | 1 |
| Second layer | $SiH_4/He = 0.05$<br>$GeH_4/He = 0.05$<br>NO | $SiH_4 + GeH_4 = 50$ | $GeH_4/SiH_4 = 3/10$<br>$NO/SiH_4 = 3/100$ | 0.18 | 5 | 1 |
| Third layer | $SiH_4/He = 0.5$<br>NO<br>$B_2H_6/He = 10^{-3}$ | $SiH_4 = 200$ | $NO/SiH_4 = 3/100$<br>$B_2H_6/SiH_4 = 1 \times 10^{-4}$ | 0.18 | 15 | 1 |
| Fourth layer | $SiH_4/He = 0.5$<br>$B_2H_6/He = 10^{-3}$ | $SiH_4 = 200$ | $B_2H_6/SiH_4 = 1 \times 10^{-4}$<br>(Sample No. 702C) | 0.18 | 15 | 15 |

TABLE C11

| Layer constitution | Gases employed | Flow rate (SCCM) | Flow rate ratio | Discharging power (W/cm$^2$) | Layer formation speed (A/sec) | Layer thickness ($\mu$) |
|---|---|---|---|---|---|---|
| Amorphous layer (I) | | | | | | |
| First | $SiH_4/He = 0.05$ | $SiH_4 + GeH_4 = 50$ | $GeH_4/SiH_4 = 3/10$ | 0.18 | 5 | 1 |

TABLE C11-continued

| Layer constitution | Gases employed | Flow rate (SCCM) | Flow rate ratio | Discharging power (W/cm$^2$) | Layer formation speed (Å/sec) | Layer thickness (μ) |
|---|---|---|---|---|---|---|
| layer | $GeH_4/He = 0.05$<br>$B_2H_6/He = 10^{-3}$<br>NO | | $B_2H_6/(GeH_4 + SiH_4) = 3 \times 10^{-3}$<br>$NO/(GeH_4 + SiH_4) =$<br>$3/100 \sim 2.83/100$ | | | |
| Second layer | $SiH_4/He = 0.05$<br>$GeH_4/He = 0.05$<br>NO | $SiH_4 + GeH_4 = 50$ | $GeH_4/SiH_4 = 3/10$<br>$NO/GeH_4 + SiH_4) = 2.83/100 \sim 0$ | 0.18 | 5 | 1 |
| Third layer | $SiH_4/He = 0.5$ | $SiH_4 = 200$ | | 0.18 | 15 | 19 |
| | | | (Sample No. 801C) | | | |

Note
$No/(GeH_4 + SiH_4)$ was linearly decreased.

TABLE C12

| Layer constitution | Gases employed | Flow rate (SCCM) | Flow rate ratio | Discharging power (W/cm$^2$) | Layer formation speed (Å/sec) | Layer thickness (μ) |
|---|---|---|---|---|---|---|
| Amorphous layer (I) | | | | | | |
| First layer | $SiH_4/He = 0.05$<br>$GeH_4/He = 0.05$<br>$B_2H_6/He = 10^{-3}$<br>NO | $SiH_4 + GeH_4 = 50$ | $GeH_4/SiH_4 = 1/10$<br>$B_2H_6/(GeH_4 + SiH_4) = 3 \times 10^{-3}$<br>$NO/(GeH_4 + SiH_4) = 3/100 \sim 0$ | 0.18 | 5 | 0.5 |
| Second layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 1/10$<br>$B_2H_6/(GeH_4 + SiH_4) = 3 \times 10^{-3}$ | 0.18 | 5 | 0.5 |
| Third layer | $SiH_4/He = 0.05$<br>$GeH_4/He = 0.05$ | $SiH_4 + GeH_4 = 50$ | $GeH_4/SiH_4 = 1/10$ | 0.18 | 5 | 19 |
| Fourth layer | $SiH_4/He = 0.5$ | $SiH_4 = 200$ | | 0.18 | 15 | 5 |
| | | | (Sample No. 802C) | | | |

TABLE C13

| Layer constitution | Gases employed | Flow rate (SCCM) | Flow rate ratio | Discharging power (W/cm$^2$) | Layer formation speed (Å/sec) | Layer thickness (μ) |
|---|---|---|---|---|---|---|
| Amorphous layer (I) | | | | | | |
| First layer | $SiH_4/He = 0.05$<br>$GeH_4/He = 0.05$<br>$B_2H_6/He = 10^{-3}$<br>NO | $SiH_4 + GeH_4 = 50$ | $GeH_4/SiH_4 = 3/10$<br>$B_2H_6/(GeH_4 + SiH_4) = 5 \times 10^{-3}$<br>$NO/(GeH_4 + SiH_4) = 1/100 \sim 0$ | 0.18 | 5 | 1 |
| Second layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 3/10$<br>$B_2H_6/(GeH_4 + SiH_4) = 5 \times 10^{-3}$ | 0.18 | 5 | 1 |
| Third layer | $SiH_4/He = 0.5$<br>$B_2H_6/He = 10^{-3}$ | $SiH_4 = 200$ | $B_2H_6/SiH_4 = 2 \times 10^{-4}$<br>(Sample No. 803C) | 0.18 | 15 | 20 |

TABLE C14

| Layer constitution | Gases employed | Flow rate (SCCM) | Flow rate ratio | Discharging power (W/cm$^2$) | Layer formation speed (Å/sec) | Layer thickness (μ) |
|---|---|---|---|---|---|---|
| Amorphous layer (I) | | | | | | |
| First layer | $SiH_4/He = 0.05$<br>$GeH_4/He = 0.05$<br>$B_2H_6/He = 10^{-3}$<br>NO | $SiH_4 + GeH_4 = 50$ | $GeH_4/SiH_4 = 3/10$<br>$B_2H_6/SiH_4 = 3 \times 10^{-3}$<br>$NO/SiH_4 = 3/100 \sim 2.83/100$ | 0.18 | 5 | 1 |
| Second layer | $SiH_4/He = 0.5$<br>NO<br>$B_2H_6/He = 10^{-3}$ | $SiH_4 = 200$ | $NO/SiH_4 = 2.83/100 \sim 0$<br>$B_2H_6/SiH_4 = 3 \times 10^{-4}$<br>(Sample No. 804C) | 0.18 | 15 | 20 |

Note
$NO/SiH_4$ was linearly decreased.

TABLE C15

| Layer constitution | Gases employed | Flow rate (SCCM) | Flow rate ratio | Discharging power ($W/cm^2$) | Layer formation speed (A/sec) | Layer thickness ($\mu$) |
|---|---|---|---|---|---|---|
| Amorphous layer (I) | | | | | | |
| First layer | $SiH_4/He = 0.05$<br>$GeH_4/He = 0.05$<br>$B_2H_6/He = 10^{-3}$<br>NO | $SiH_4 + GeH_4 = 50$ | $GeH_4/SiH_4 = 1/10$<br>$B_2H_6/(GeH_4 + SiH_4) = 1 \times 10^{-5}$<br>$NO/(GeH_4 + SiH_4) = 3/100 \sim 0$ | 0.18 | 5 | 1 |
| Second layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 1/10$<br>$B_2H_6/(GeH_4 + SiH_4) = 1 \times 10^{-5}$ | 0.18 | 5 | 19 |
| Third layer | $SiH_4/He = 0.5$<br>$B_2H_6/He = 10^{-3}$ | $SiH_4 = 200$ | $B_2H_6/SiH_4 = 3 \times 10^{-4}$<br>(Sample No. 805C) | 0.18 | 15 | 5 |

Note
$NO/(GeH_4 + SiH_4)$ was linearly decreased.

TABLE C16

| Condition | Gases employed | Flow rate (SCCM) | Flow rate ratio or area ratio | Discharging power ($W/cm^2$) | Layer thickness ($\mu$) |
|---|---|---|---|---|---|
| 12-1C | Ar | 200 | Si wafer:Graphite = 1.5:8.5 | 0.3 | 0.5 |
| 12-2C | Ar | 200 | Si wafer:Graphite = 0.5:9.5 | 0.3 | 0.3 |
| 12-3C | Ar | 200 | Si wafer:Graphite = 6:4 | 0.3 | 1.0 |
| 12-4C | $SiH_4/He = 1$<br>$C_2H_4$ | $SiH_4 = 15$ | $SiH_4:C_2H_4 = 0.4:9.6$ | 0.18 | 0.3 |
| 12-5C | $SiH_4/He = 0.5$<br>$C_2H_4$ | $SiH_4 = 100$ | $SiH_4:C_2H_4 = 5:5$ | 0.18 | 1.5 |
| 12-6C | $SiH_4/He = 0.5$<br>$SiF_4/He = 0.5$<br>$C_2H_4$ | $SiH_4 + SiF_4 = 150$ | $SiH_4:SiF_4:C_2H_4 = 1.5:1.5:7$ | 0.18 | 0.5 |
| 12-7C | $SiH_4/He = 0.5$<br>$SiF_4/He = 0.5$<br>$C_2H_4$ | $SiH_4 + SiF_4 = 15$ | $SiH_4:SiF_4:C_2H_4 = 0.3:0.1:9.6$ | 0.18 | 0.3 |
| 12-8C | $SiH_4/He = 0.5$<br>$SiF_4/He = 0.5$<br>$C_2H_4$ | $SiH_4 + SiF_4 = 150$ | $SiH_4:SiF_4:C_2H_4 = 3:3:4$ | 0.18 | 1.5 |

TABLE C 16A

| Amorphous layer (II) preparation condition | Sample No./ evaluation | |
|---|---|---|
| 12-1C | 12-201C<br>o o | 12-301C<br>o o |
| 12-2C | 12-202C<br>o o | 12-302C<br>o o |
| 12-3C | 12-203C<br>o o | 12-303C<br>o o |
| 12-4C | 12-204C<br>◎ ◎ | 12-304C<br>◎ ◎ |
| 12-5C | 12-205C<br>◎ ◎ | 12-305C<br>◎ ◎ |
| 12-6C | 12-206C<br>◎ ◎ | 12-306C<br>◎ ◎ |

TABLE C 16A-continued

| Amorphous layer (II) preparation condition | Sample No./ evaluation | |
|---|---|---|
| 12-7C | 12-207C<br>o o | 12-307C<br>o o |
| 12-8C | 12-208C<br>o o | 12-308C<br>o o |

| | Sample No. | |
|---|---|---|
| | Overall image quality evaluation | Durability evaluation |

Evaluation standards:
◎ . . . Excellent
o . . . Good

TABLE C17

| Sample No. | 1701C | 1702C | 1703C | 1704C | 1705C | 1706C | 1707C |
|---|---|---|---|---|---|---|---|
| Si: C target (area ratio) | 9:1 | 6.5:3.5 | 4:6 | 2:8 | 1:9 | 0.5:9.5 | 0.2:9.8 |
| Si: C (content ratio) | 9.7:0.3 | 8.8:1.2 | 7.3:2.7 | 4.8:5.2 | 3:7 | 2:8 | 0.8:9.2 |
| Image quality evaluation | Δ | o | ◎ | ◎ | o | Δ | X |

◎: Very good
o: Good
Δ: Practically satisfactory
X: Image defect formed

TABLE C18

| Sample No. | 1801C | 1802C | 1803C | 1804C | 1805C | 1806C | 1807C | 1808C |
|---|---|---|---|---|---|---|---|---|
| $SiH_4:C_2H_4$ (flow rate ratio) | 9:1 | 6:4 | 4:6 | 2:8 | 1:9 | 0.5:9.5 | 0.35:9.65 | 0.2:9.8 |
| Si: C (content ratio) | 9:1 | 7:3 | 5.5:4.5 | 4:6 | 3:7 | 2:8 | 1.2:8.8 | 0.8:9.2 |

TABLE C18-continued

| Sample No. | 1801C | 1802C | 1803C | 1804C | 1805C | 1806C | 1807C | 1808C |
|---|---|---|---|---|---|---|---|---|
| Image quality evaluation | Δ | o | ◎ | ◎ | ◎ | o | Δ | X |

◎: Very good
o: Good
Δ: Practically satisfactory
X: Image defect formed

TABLE C19

| Sample No. | 1901C | 1902C | 1903C | 1904C | 1905C | 1906C | 1907C | 1908C |
|---|---|---|---|---|---|---|---|---|
| $SiH_4$:$SiF_4$:$C_2H_4$ (flow rate ratio) | 5:4:1 | 3:3.5:3.5 | 2:2:6 | 1:1:8 | 0.6:0.4:9 | 0.2:0.3:9.5 | 0.2:0.15:9.65 | 0.1:0.1:9.8 |
| Si: C (content ratio) | 9:1 | 7:3 | 5.5:4.5 | 4:6 | 3:7 | 2:8 | 1.2:8.8 | 0.8:9.2 |
| Image quality evaluation | Δ | o | ◎ | ◎ | ◎ | o | Δ | X |

◎: Very good
o: Good
ΔPractically satisfactory
X: Image defect formed

TABLE C20

| Sample No. | Thickness of amorphous layer (II) (μ) | Results |
|---|---|---|
| 2001C | 0.001 | Image defect liable to occur |
| 2002C | 0.02 | No image defect during 20,000 repetitions |

TABLE C20-continued

| Sample No. | Thickness of amorphous layer (II) (μ) | Results |
|---|---|---|
| 2003C | 0.05 | Stable for 50,000 repetitions or more |
| 2004C | 1 | Stable for 200,000 repetitions or more |

TABLE D1

| Layer constitution | | Gases employed | Flow rate (SCCM) | Flow rate ratio | Discharging power (W/cm²) | Layer formation speed (Å/sec) | Layer thickness (μ) |
|---|---|---|---|---|---|---|---|
| Amorphous layer (I) | First layer | $SiH_4$/He = 0.05<br>$GeH_4$/He = 0.05 | $SiH_4$ + $GeH_4$ = 50 | $GeH_4/SiH_4$ = 1~0 | 0.18 | 5 | 10 |
| | Second layer | $SiH_4$/He = 0.5 | $SiH_4$ = 200 | | 0.18 | 15 | 10 |
| Amorphous layer (II) | | $SiH_4$/He = 0.5<br>$C_2H_4$ | $SiH_4$ = 100 | $SiH_4/C_2H_4$ = 3/7 | 0.18 | 10 | 0.5 |

TABLE D2

| Layer constitution | | Gases employed | Flow rate (SCCM) | Flow rate ratio | Discharging power (W/cm²) | Layer formation speed (Å/sec) | Layer thickness (μ) |
|---|---|---|---|---|---|---|---|
| Amorphous layer (I) | First layer | $SiH_4$/He = 0.05<br>$GeH_4$/He = 0.05 | $SiH_4$ + $GeH_4$ = 50 | $GeH_4/SiH_4$ = 1/10~0 | 0.18 | 5 | 8 |
| | Second layer | $SiH_4$He = 0.5 | $SiH_4$ = 200 | | 0.18 | 15 | 10 |

TABLE D3

| Layer constitution | | Gases employed | Flow rate (SCCM) | Flow rate ratio | Discharging power (W/cm²) | Layer formation speed (Å/sec) | Layer thickness (μ) |
|---|---|---|---|---|---|---|---|
| Amorphous layer (I) | First layer | $SiH_4$/He = 0.05<br>$GeH_4$/He = 0.05 | $SiH_4$ + $GeH_4$ = 50 | $GeH_4/SiH_4$ = 4/10~2/1000 | 0.18 | 5 | 2.0 |
| | Second layer | $SiH_4$/He = 0.5 | $SiH_4$ = 200 | | 0.18 | 15 | 20 |

TABLE D4

| Layer constitution | | Gases employed | Flow rate (SCCM) | Flow rate ratio | Discharging power ($W/cm^2$) | Layer formation speed (A/sec) | Layer thickness ($\mu$) |
|---|---|---|---|---|---|---|---|
| Amorphous layer (I) | First layer | $SiH_4/He = 0.05$<br>$GeH_4/He = 0.05$ | $SiH_4 + GeH_4 = 50$ | $GeH_4/SiH_4 = 3/10 \sim 0$ | 0.18 | 5 | 2.0 |
| | Second layer | $SiH_4/He = 0.5$ | $SiH_4 = 200$ | | 0.18 | 15 | 15 |

TABLE D5

| Layer constitution | | Gases employed | Flow rate (SCCM) | Flow rate ratio | Discharging power ($W/cm^2$) | Layer formation speed (A/sec) | Layer thickness ($\mu$) |
|---|---|---|---|---|---|---|---|
| Amorphous layer (I) | First layer | $SiH_4/He = 0.05$<br>$GeH_4/He = 0.05$ | $SiH_4 + GeH_4 = 50$ | $GeH_4/SiH_4 = 8/10 \sim 0$ | 0.18 | 5 | 0.8 |
| | Second layer | $SiH_4/He = 0.5$ | $SiH_4 = 200$ | | 0.18 | 15 | 20 |

TABLE D6

| Layer constitution | | Gases employed | Flow rate (SCCM) | Flow rate ratio | Discharging power ($W/cm^2$) | Layer formation speed (A/sec) | Layer thickness ($\mu$) |
|---|---|---|---|---|---|---|---|
| Amorphous layer (I) | First layer | $SiH_4/He = 0.05$<br>$GeH_4/He = 0.5$ | $SiH_4 + GeH_4 = 50$ | $GeH_4/SiH_4 = 1 \sim 0$ | 0.18 | 5 | 8 |
| | Second layer | $SiH_4/He = 0.5$ | $SiH_4 = 200$ | | 0.18 | 15 | 15 |

TABLE D7

| Layer constitution | | Gases employed | Flow rate (SCCM) | Flow rate ratio | Dis-charging power ($W/cm^2$) | Layer formation speed (A/sec) | Layer thickness ($\mu$) |
|---|---|---|---|---|---|---|---|
| Amorphous layer (I) | First layer | $SiH_4/He = 0.05$<br>$GeH_4/He = 0.05$ | $SiH_4 + GeH_4 = 50$ | $GeH_4/SiH_4 = 1/10 \sim 0$ | 0.18 | 5 | 8 |
| | Second layer | $SiH_4/He = 0.5$ | $SiH_4 = 200$ | | 0.18 | 15 | 10 |

TABLE D8

| Layer constitution | | Gases employed | Flow rate (SCCM) | Flow rate ratio | Discharging power ($W/cm^2$) | Layer formation speed (A/sec) | Layer thickness ($\mu$) |
|---|---|---|---|---|---|---|---|
| Amorphous layer (I) | First layer | $Si_2H_6/He = 0.05$<br>$GeH_4/He = 0.05$ | $Si_2H_6 + GeH_4 = 50$ | $GeH_4/Si_2H_6 = 1 \sim 0$ | 0.18 | 5 | 10 |
| | Second layer | $SiH_4/He = 0.5$ | $SiH_4 = 200$ | | 0.18 | 15 | 10 |

TABLE D9

| Layer constitution | | Gases employed | Flow rate (SCCM) | Flow rate ratio | Discharging power ($W/cm^2$) | Layer formation speed (A/sec) | Layer thickness ($\mu$) |
|---|---|---|---|---|---|---|---|
| Amorphous layer (I) | First layer | $SiF_4/He = 0.05$<br>$GeH_4/He = 0.05$ | $SiF_4 + GeH_4 = 50$ | $GeH_4/SiF_4 = 1 \sim 0$ | 0.18 | 5 | 10 |
| | Second layer | $SiH_4/He = 0.5$ | $SiH_4 = 200$ | | 0.18 | 15 | 10 |

TABLE D10

| Layer constitution | | Gases employed | Flow rate (SCCM) | Flow rate ratio | Discharging power ($W/cm^2$) | Layer formation speed (A/sec) | Layer thickness ($\mu$) |
|---|---|---|---|---|---|---|---|
| Amorphous layer (I) | First layer | $SiH_4/He = 0.05$<br>$SiF_4/He = 0.05$<br>$GeH_4/He = 0.05$ | $SiH_4 + SiF_4 + GeH_4 = 50$ | $GeH_4/(SiH_4 + SiF_4) = 1 \sim 0$ | 0.18 | 5 | 10 |

TABLE D10-continued

| Layer constitution | Gases employed | Flow rate (SCCM) | Flow rate ratio | Discharging power ($W/cm^2$) | Layer formation speed (A/sec) | Layer thickness ($\mu$) |
|---|---|---|---|---|---|---|
| Second layer | $SiH_4/He = 0.5$ | $SiH_4 = 200$ | | 0.18 | 15 | 10 |

TABLE D11

| Layer constitution | Gases employed | Flow rate (SCCM) | Flow rate ratio | Discharging power ($W/cm^2$) | Layer forma-speed (A/sec) |
|---|---|---|---|---|---|
| Second layer | $SiH_4/He = 0.5$<br>$B_2H_6/He = 10^{-3}$ | $SiH_4 = 200$ | $B_2H_6/SiH_4 = 2 \times 10^{-5}$ | 0.18 | 15 |

TABLE D11A

| Sample No. | 1101D | 1102D | 1103D | 1104D | 1105D | 1106D | 1107D | 1108D | 1109D | 1110D |
|---|---|---|---|---|---|---|---|---|---|---|
| First layer | Example 1 | Example 2 | Example 3 | Example 4 | Example 5 | Example 6 | Example 7 | Example 8 | Example 9 | Example 10 |
| Layer thickness of second layer ($\mu$) | 10 | 10 | 20 | 15 | 20 | 15 | 10 | 10 | 10 | 10 |
| Evaluation | o | o | ◎ | ◎ | ◎ | ◎ | o | o | o | o |

◎: Excellent
o: Good

TABLE D12

| Layer constitution | Gases employed | Flow rate (SCCM) | Flow rate ratio | Discharging power ($W/cm^2$) | Layer forma-tion speed (Å/sec) |
|---|---|---|---|---|---|
| Second layer | $SiH_4/He = 0.5$<br>$PH_3/He = 10^{-3}$ | $SiH_4 = 200$ | $PH_3/SiH_4 = 1 \times 10^{-7}$ | 0.18 | 15 |

TABLE D12A

| Sample No. | 1201D | 1202D | 1203D | 1204D | 1205D | 1206D | 1207D | 1208D | 1209D | 1210D |
|---|---|---|---|---|---|---|---|---|---|---|
| First layer | Example 1 | Example 2 | Example 3 | Example 4 | Example 5 | Example 6 | Example 7 | Example 8 | Example 9 | Example 10 |
| Layer thickness of second layer ($\mu$) | 10 | 10 | 20 | 15 | 20 | 15 | 10 | 10 | 10 | 10 |
| Evaluation | o | o | ◎ | ◎ | ◎ | ◎ | o | o | o | o |

◎: Excellent
o: Good

TABLE D13

| Condition | Gases employed | Flow rate (SCCM) | Flow rate ratio or area ratio | Discharging power ($W/cm^2$) | Layer thickness ($\mu$) |
|---|---|---|---|---|---|
| 12-1D | Ar | 200 | Si wafer:Graphite = 1.5:8.5 | 0.3 | 0.5 |
| 12-2D | Ar | 200 | Si wafer:Graphite = 0.5:9.5 | 0.3 | 0.3 |
| 12-3D | Ar | 200 | Si wafer:Graphite = 6:4 | 0.3 | 1.0 |
| 12-4D | $SiH_4/He = 1$<br>$C_2H_4$ | $SiH_4 = 15$ | $SiH_4:C_2H_4 = 0.4:9.6$ | 0.18 | 0.3 |
| 12-5D | $SiH_4/He = 0.5$<br>$C_2H_4$ | $SiH_4 = 100$ | $SiH_4:C_2H_4 = 5:5$ | 0.18 | 1.5 |
| 12-6D | $SiH_4/He = 0.5$<br>$SiF_4/He = 0.5$<br>$C_2H_4$ | $SiH_4 + SiF_4 = 150$ | $SiH_4:SiF_4:C_2H_4 = 1.5:1.5:7$ | 0.18 | 0.5 |
| 12-7D | $SiH_4/He = 0.5$<br>$SiF_4/He = 0.5$<br>$C_2H_4$ | $SiH_4 + SiF_4 = 15$ | $SiH_4:SiF_4:C_2H_4 = 0.3:0.1:9.6$ | 0.18 | 0.3 |
| 12-8D | $SiH_4/He = 0.5$<br>$SiF_4/He = 0.5$<br>$C_2H_4$ | $SiH_4 + SiF_4 = 150$ | $SiH_4:SiF_4:C_2H_4 = 3:3:4$ | 0.18 | 1.5 |

TABLE D13A

Amorphous layer
(II) preparation

TABLE D13A-continued

| condition | Sample No./Evaluation | | | | | | | | |
|---|---|---|---|---|---|---|---|---|---|
| 12-1D | 12-201D | 12-301D | 12-401D | 12-501D | 12-601D | 12-701D | 12-801D | 12-901D | 12-1001D |
| | o o | o o | o o | o o | o o | o o | o o | o o | o o |
| 12-2D | 12-202D | 12-302D | 12-402D | 12-502D | 12-602D | 12-702D | 12-802D | 12-902D | 12-1002D |
| | o o | o o | o o | o o | o o | o o | o o | o o | o o |
| 12-3D | 12-203D | 12-303D | 12-403D | 12-503D | 12-603D | 12-703D | 12-803D | 12-903D | 12-1003D |
| | o o | o o | o o | o o | o o | o o | o o | o o | o o |
| 12-4D | 12-204D | 12-304D | 12-404D | 12-504D | 12-604D | 12-704D | 12-804D | 12-904D | 12-1004D |
| | ◎ ◎ | ◎ ◎ | ◎ ◎ | ◎ ◎ | ◎ ◎ | ◎ ◎ | ◎ ◎ | ◎ ◎ | ◎ ◎ |
| 12-5D | 12-205D | 12-305D | 12-405D | 12-505D | 12-605D | 12-705D | 12-805D | 12-905D | 12-1005D |
| | ◎ ◎ | ◎ ◎ | ◎ ◎ | ◎ ◎ | ◎ ◎ | ◎ ◎ | ◎ ◎ | ◎ ◎ | ◎ ◎ |
| 12-6D | 12-206D | 12-306D | 12-406D | 12-506D | 12-606D | 12-706D | 12-806D | 12-906D | 12-1006D |
| | ◎ ◎ | ◎ ◎ | ◎ ◎ | ◎ ◎ | ◎ ◎ | ◎ ◎ | ◎ ◎ | ◎ ◎ | ◎ ◎ |
| 12-7D | 12-207D | 12-307D | 12-407D | 12-507D | 12-607D | 12-707D | 12-807D | 12-907D | 12-1007D |
| | o o | o o | o o | o o | o o | o o | o o | o o | o o |
| 12-8D | 12-208D | 12-308D | 12-408D | 12-508D | 12-608D | 12-708D | 12-808D | 12-908D | 12-1008D |
| | o o | o o | o o | o o | o o | o o | o o | o o | o o |

Sample No./Evaluation

| Overall image quality evaluation | Durability evaluation |
|---|---|

Evaluation standards:
◎: Excellent
o: Good

TABLE D14

| Sample No. | 1301D | 1302D | 1303D | 1304D | 1305D | 1306D | 1307D |
|---|---|---|---|---|---|---|---|
| Si:C (area ratio) | 9:1 | 6.5:3.5 | 4:6 | 2:8 | 1:9 | 0.5:9.5 | 0.2:9.8 |
| Si:C (content ratio) | 9.7:0.3 | 8.8:1.2 | 7.3:2.7 | 4.8:5.2 | 3:7 | 2:8 | 0.8:9.2 |
| Image quality evaluation | Δ | o | ◎ | ◎ | o | Δ | X |

◎: Very good
o: Good
Δ: Practically satisfactory
X: Image defect formed

TABLE D15

| Sample No. | 1401D | 1402D | 1403D | 1404D | 1405D | 1406D | 1407D | 1408D |
|---|---|---|---|---|---|---|---|---|
| $SiH_4$:$C_2H_4$ (flow rate ratio) | 9:1 | 6:4 | 4:6 | 2:8 | 1:9 | 0.5:9.5 | 0.35:9.65 | 0.2:9.8 |
| Si:C (content ratio) | 9:1 | 7:3 | 5.5:4.5 | 4:6 | 3:7 | 2:8 | 1.2:8.8 | 0.8:9.2 |
| Image quality evaluation | Δ | o | ◎ | ◎ | ◎ | o | Δ | X |

◎: Very good
o: Good
Δ: Practically satisfactory
X: Image defect formed

TABLE D16

| Sample No. | 1501D | 1502D | 1503D | 1504D | 1505D | 1506D | 1507D | 1508D |
|---|---|---|---|---|---|---|---|---|
| $SiH_4$:$SiF_4$:$C_2H_4$ (flow rate ratio) | 5:4:1 | 3:3.5:3.5 | 2:2:6 | 1:1:8 | 0.6:0.4:9 | 0.2:0.3:9.5 | 0.2:0.15:9.65 | 0.1:0.1:9.8 |
| Si:C (content ratio) | 9:1 | 7:3 | 5.5:4.5 | 4:6 | 3:7 | 2:8 | 1.2:8.8 | 0.8:9.2 |
| Image quality evaluation | Δ | o | ◎ | ◎ | ◎ | o | Δ | X |

◎: Very good
o: Good
Δ: Practically satisfactory
X: Image defect formed

TABLE D17

| Sample No. | Thickness of amorphous layer (II) (μ) | Results |
|---|---|---|
| 1601D | 0.001 | Image defect liable to occur |
| 1602D | 0.02 | No image defect during 20,000 repetitions |

TABLE D17-continued

| Sample No. | Thickness of amorphous layer (II) (μ) | Results |
|---|---|---|
| 1603D | 0.05 | Stable for 50,000 repetitions or more |
| 1604D | 1 | Stable for 200,000 repetitions or more |

TABLE E1

| Layer constitution | | Gases employed | Flow rate (SCCM) | Flow rate ratio | Discharging power (W/cm$^2$) | Layer formation speed (Å/sec) | Layer thickness (μ) |
|---|---|---|---|---|---|---|---|
| Amorphous layer (I) | First layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 3/10$<br>$B_2H_6/(GeH_4 + SiH_4) = 3 \times 10^{-3}$ | 0.18 | 5 | 1 |
| | Second layer | $SiH_4/He = 0.5$ | $SiH_4 = 200$ | | 0.18 | 15 | 20 |
| Amorphous layer (II) | | $SiH_4/He = 0.5$<br>$C_2H_4$ | $SiH_4 = 100$ | $SiH_4:C_2H_4 = 3:7$ | 0.18 | 10 | 0.5 |

TABLE E2

| Layer constitution | | Gases employed | Flow rate (SCCM) | Flow rate ratio | Discharging power (W/cm$^2$) | Layer formation speed (Å/sec) | Layer thickness (μ) |
|---|---|---|---|---|---|---|---|
| Amorphous layer (I) | First layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 1/10$<br>$B_2H_6/(GeH_4 + SiH_4) = 3 \times 10^{-3}$ | 0.18 | 5 | 1 |
| | Second layer | $SiH_4/He = 0.05$<br>$GeH_4/He = 0.05$ | $SiH_4 + GeH_4 = 50$ | $GeH_4/SiH_4 = 1/10$ | 0.18 | 5 | 19 |
| | Third layer | $SiH_4/He = 0.5$ | $SiH_4 = 200$ | | 0.18 | 15 | 5 |

TABLE E3

| Layer constitution | | Gases employed | Flow rate (SCCM) | Flow rate ratio | Discharging power (W/cm$^2$) | Layer formation speed (Å/sec) | Layer thickness (μ) |
|---|---|---|---|---|---|---|---|
| Amorphous layer (I) | First layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 3/10$<br>$B_2H_6/(GeH_4 + SiH_4) = 5 \times 10^{-3}$ | 0.18 | 5 | 2 |
| | Second layer | $SiH_4/He = 0.5$<br>$B_2H_6/He = 10^{-3}$ | $SiH_4 = 200$ | $B_2H_6/SiH_4 = 2 \times 10^{-4}$ | 0.18 | 15 | 20 |

TABLE E4

| Sample No. | 401E | 402E | 403E | 404E | 405E | 406E | 407E | 408E |
|---|---|---|---|---|---|---|---|---|
| $GeH_4/SiH_4$ Flow rate ratio | 5/100 | 1/10 | 2/10 | 4/10 | 5/10 | 7/10 | 8/10 | 1/1 |
| Ge content (atomic %) | 4.3 | 8.4 | 15.4 | 26.7 | 32.3 | 38.9 | 42 | 47.6 |
| Evaluation | ◎ | ◎ | ◎ | ◎ | ◎ | o | o | o |

◎: Excellent
o: Good

TABLE E5

| Sample No. | 501E | 502E | 503E | 504E | 505E | 506E | 507E | 508E |
|---|---|---|---|---|---|---|---|---|
| Layer thickness | 30Å | 500Å | 0.1μ | 0.3μ | 0.8μ | 3μ | 4μ | 5μ |
| Evaluation | Δ | o | ◎ | ◎ | ◎ | o | o | Δ |

◎: Excellent
o: Good
Δ: Practically satisfactory

TABLE E6

| Layer constitution | | Gases employed | Flow rate (SCCM) | Flow rate ratio | Discharging power (W/cm$^2$) | Layer formation speed (Å/sec) | Layer thickness (μ) |
|---|---|---|---|---|---|---|---|
| Amorphous layer (I) | First layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 5/10$<br>$B_2H_6/(GeH_4 + SiH_4) = 5 \times 10^{-3}$ | 0.18 | 5 | 2 |
| | Second layer | $SiH_4/He = 0.5$<br>$PH_3/He = 10^{-3}$ | $SiH_4 = 200$ | $PH_3/SiH_4 = 9 \times 10^{-5}$ | 0.18 | 15 | 20 |

TABLE E7

| Layer constitution | | Gases employed | Flow rate (SCCM) | Flow rate ratio | Discharging power ($W/cm^2$) | Layer formation speed (Å/sec) | Layer thickness ($\mu$) |
|---|---|---|---|---|---|---|---|
| Amorphous layer (I) | First layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 5/10$<br>$B_2H_6/(GeH_4 + SiH_4) = 8 \times 10^{-4}$ | 0.18 | 5 | 15 |
| | Second layer | $SiH_4/He = 0.5$<br>$PH_3/He = 10^{-3}$ | $SiH_4 = 200$ | $PH_3/SiH_4 = 1 \times 10^{-5}$ | 0.18 | 15 | 5 |

TABLE E8

| Layer constitution | | Gases employed | Flow rate (SCCM) | Flow rate ratio | Discharging power ($W/cm^2$) | Layer formation speed (Å/sec) | Layer thickness ($\mu$) |
|---|---|---|---|---|---|---|---|
| Amorphous layer (I) | First layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 3/10$<br>$B_2H_6/(GeH_4 + SiH_4) = 9 \times 10^{-4}$ | 0.18 | 5 | 1 |
| | Second layer | $SiH_4/He = 0.5$<br>$B_2H_6/He = 10^{-3}$ | $SiH_4 = 200$ | $B_2H_6/SiH_4 = 9 \times 10^{-4}$ | 0.18 | 15 | 15 |

TABLE E9

| Layer constitution | | Gases employed | Flow rate (SCCM) | Flow rate ratio | Discharging power (W/cm) | Layer formation speed (Å/sec) | Layer thickness ($\mu$) |
|---|---|---|---|---|---|---|---|
| Amorphous layer (I) | First layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 1/10$<br>$B_2H_6/(GeH_4 + SiH_4) = 9 \times 10^{-4}$ | 0.18 | 5 | 15 |
| | Second layer | $SiH_4/He = 0.5$<br>$B_2H_6/He = 10^{-3}$ | $SiH_4 = 200$ | $B_2H_6/SiH_4 = 9 \times 10^{-4}$ | 0.18 | 15 | 5 |

TABLE E10

| Layer constitution | | Gases employed | Flow rate (SCCM) | Flow rate ratio | Discharging power ($W/cm^2$) | Layer formation speed (Å/sec) | Layer thickness ($\mu$) |
|---|---|---|---|---|---|---|---|
| Amorphous layer (I) | First layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 3/10$<br>$B_2H_6/(GeH_4 + SiH_4) = 2 \times 10^{-4}$ | 0.18 | 5 | 2 |
| | Second layer | $SiH_4/He = 0.5$<br>$B_2H_6/He = 10^{-3}$ | $SiH_4 = 200$ | $B_2H_6/SiH_4 = 2 \times 10^{-4}$ | 0.18 | 15 | 20 |

TABLE E11

| Condition | Gases employed | Flow rate (SCCM) | Flow rate ratio or area ratio | Discharging power ($W/cm^2$) | Layer thickness ($\mu$) |
|---|---|---|---|---|---|
| 12-1E | Ar | 200 | Si wafer:Graphite = 1.5:8.5 | 0.3 | 0.5 |
| 12-2E | Ar | 200 | Si wafer:Graphite = 0.5:9.5 | 0.3 | 0.3 |
| 12-3E | Ar | 200 | Si wafer:Graphite = 6:4 | 0.3 | 1.0 |
| 12-4E | $SiH_4/He = 1$<br>$C_2H_4$ | $SiH_4 = 15$ | $SiH_4:C_2H_4 = 0.4:9.6$ | 0.18 | 0.3 |
| 12-5E | $SiH_4/He = 0.5$<br>$C_2H_4$ | $SiH_4 = 100$ | $SiH_4:C_2H_4 = 5:5$ | 0.18 | 1.5 |
| 12-6E | $SiH_4/He = 0.5$<br>$SiF_4/He = 0.5$<br>$C_2H_4$ | $SiH_4 + SiF_4 = 150$ | $SiH_4:SiF_4:C_2H_4 = 1.5:1.5:7$ | 0.18 | 0.5 |
| 12-7E | $SiH_4/He = 0.5$<br>$SiF_4/He = 0.5$<br>$C_2H_4$ | $SiH_4 + SiF_4 = 15$ | $SiH_4:SiF_4:C_2H_4 = 0.3:0.1:9.6$ | 0.18 | 0.3 |
| 12-8E | $SiH_4/He = 0.5$<br>$SiF_4/He = 0.5$<br>$C_2H_4$ | $SiH_4 + SiF_4 = 150$ | $SiH_4:SiF_4:C_2H_4 = 3:3:4$ | 0.18 | 1.5 |

TABLE E12

| Amorphous layer (II) preparation condition | Sample No./Evaluation |
|---|---|

TABLE E12-continued

| | | | | | | | |
|---|---|---|---|---|---|---|---|
| 12-1E | 12-201E | 12-301E | 12-601E | 12-701E | 12-801E | 12-901E | 12-1001E |
| | o o | o o | o o | o o | o o | o o | o o |
| 12-2E | 12-202E | 12-302E | 12-602E | 12-702E | 12-802E | 12-902E | 12-1002E |
| | o o | o o | o o | o o | o o | o o | o o |
| 12-3E | 12-203E | 12-303E | 12-603E | 12-703E | 12-803E | 12-903E | 12-1003E |
| | o o | o o | o o | o o | o o | o o | o o |
| 12-4E | 12-204E | 12-304E | 12-604E | 12-704E | 12-804E | 12-904E | 12-1004E |
| | ◎ ◎ | ◎ ◎ | ◎ ◎ | ◎ ◎ | ◎ ◎ | ◎ ◎ | ◎ ◎ |
| 12-5E | 12-205E | 12-305E | 12-605E | 12-705E | 12-805E | 12-905E | 12-1005E |
| | ◎ ◎ | ◎ ◎ | ◎ ◎ | ◎ ◎ | ◎ ◎ | ◎ ◎ | ◎ ◎ |
| 12-6E | 12-206E | 12-306E | 12-606E | 12-706E | 12-806E | 12-906E | 12-1006E |
| | ◎ ◎ | ◎ ◎ | ◎ ◎ | ◎ ◎ | ◎ ◎ | ◎ ◎ | ◎ ◎ |
| 12-7E | 12-207E | 12-307E | 12-607E | 12-707E | 12-807E | 12-907E | 12-1007E |
| | o o | o o | o o | o o | o o | o o | o o |
| 12-8E | 12-208E | 12-308E | 12-608E | 12-708E | 12-808E | 12-908E | 12-1008E |
| | o o | o o | o o | o o | o o | o o | o o |

Sample No./Evaluation

Overall image quality evaluation — Durability evaluation

Evaluation standards:
◎: Excellent
o: Good

TABLE E13

| Sample No. | 1301E | 1302E | 1303E | 1304E | 1305E | 1306E | 1307E |
|---|---|---|---|---|---|---|---|
| Si:C target (area ratio) | 9:1 | 6.5:3.5 | 4:6 | 2:8 | 1:9 | 0.5:9.5 | 0.2:9.8 |
| Si:C (content ratio) | 9.7:0.3 | 8.8:1.2 | 7.3:2.7 | 4.8:5.2 | 3:7 | 2:8 | 0.8:9.2 |
| Image quality evaluation | Δ | o | ◎ | ◎ | o | Δ | X |

◎: Very good
o: Good
Δ: Practically satisfactory
X: Image defect formed

TABLE E14

| Sample No. | 1401E | 1402E | 1403E | 1404E | 1405E | 1406E | 1407E | 1408E |
|---|---|---|---|---|---|---|---|---|
| $SiH_4$:$C_2H_4$ (flow rate ratio) | 9:1 | 6:4 | 4:6 | 2:8 | 1:9 | 0.5:9.5 | 0.35:9.65 | 0.2:9.8 |
| Si:C (content ratio) | 9:1 | 7:3 | 5.5:4.5 | 4:6 | 3:7 | 2:8 | 1.2:8.8 | 0.8:9.2 |
| Image quality evaluation | Δ | o | ◎ | ◎ | ◎ | o | Δ | X |

◎: Very good
o: Good
Δ: Practically satisfactory
X: Image defect formed

TABLE E15

| Sample No. | 1501E | 1502E | 1503E | 1504E | 1505E | 1506E | 1507E | 1508E |
|---|---|---|---|---|---|---|---|---|
| $SiH_4$:$SiF_4$:$C_2H_4$ (flow rate ratio) | 5:4:1 | 3:3.5:3.5 | 2:2:6 | 1:1:8 | 0.6:0.4:9 | 0.2:0.3:9.5 | 0.2:0.15:9.65 | 0.1:0.1:9.8 |
| Si:C (content ratio) | 9:1 | 7:3 | 5.5:4.5 | 4:6 | 3:7 | 2:8 | 1.2:8.8 | 0.8:9.2 |
| Image quality evaluation | Δ | o | ◎ | ◎ | ◎ | o | Δ | X |

◎: Very good
o: Good
Δ: Practically satisfactory
X: Image defect formed

TABLE E16

| Sample No. | Thickness of amorphous layer (II) (μ) | Results |
|---|---|---|
| 1601E | 0.001 | Image defect liable to occur |
| 1602E | 0.02 | No image defect during 20.000 repetitions |

TABLE E16-continued

| Sample No. | Thickness of amorphous layer (II) (μ) | Results |
|---|---|---|
| 1063E | 0.05 | Stable for 50.000 repetitions or more |
| 1604E | 1 | Stable for 200.000 repetitions or more |

TABLE F1

| Layer constitution | | Gases employed | Flow rate (SCCM) | Flow rate ratio | Discharging power ($W/cm^2$) | Layer formation speed (Å/sec) | Layer thickness ($\mu$) |
|---|---|---|---|---|---|---|---|
| Amorphous layer (I) | First layer | $SiH_4/He = 0.05$<br>$GeH_4/He = 0.05$<br>NO | $SiH_4 + GeH_4 = 50$ | $GeH_4/SiH_4 = 4/10 \sim 3/100$<br>$NO/(GeH_4 + SiH_4) = 3/100$ | 0.18 | 5 | 2 |
| | Second layer | $SiH_4/He = 0.05$<br>$GeH_4He = 0.05$ | $SiH_4 + GeH_4 = 50$ | $GeH_4/SiH_4 = 3/100 \sim 0$ | 0.18 | 5 | 8 |
| | Third layer | $SiH_4/He = 0.5$ | $SiH_4 = 200$ | | 0.18 | 15 | 10 |
| Amorphous layer (II) | | $SiH_4/He = 0.5$<br>$C_2H_4$ | $SiH_4 = 100$ | $SiH_4:C_2H_4 = 3:7$ | 0.18 | 10 | 0.5 |

TABLE F2

| Layer constitution | | Gases employed | Flow rate (SCCM) | Flow rate ratio | Discharging power ($W/cm^2$) | Layer formation speed (Å/sec) | Layer thickness ($\mu$) |
|---|---|---|---|---|---|---|---|
| Amorphous layer (I) | First layer | $SiH_4/He = 0.05$<br>$GeH_4/He = 0.05$<br>NO | $SiH_4 + GeH_4 = 50$ | $GeH_4/SiH_4 = 1/10 \sim 4/100$<br>$NO/(GeH_4 + SiH_4) = 3/100$ | 0.18 | 5 | 5 |
| | Second layer | $SiH_4/He = 0.05$<br>$GeH_4/He = 0.05$ | $SiH_4 + GeH_4 = 50$ | $GeH_4/SiH_4 = 4/100 \sim 0$ | 0.18 | 5 | 3 |
| | Third layer | $SiH_4/He = 0.5$ | $SiH_4 = 200$ | | 0.18 | 15 | 10 |

TABLE F3

| Layer constitution | | Gases employed | Flow rate (SCCM) | Flow rate ratio | Discharging power ($W/cm^2$) | Layer formation speed (Å/sec) | Layer thickness ($\mu$) |
|---|---|---|---|---|---|---|---|
| Amorphous layer (I) | First layer | $SiH_4/He = 0.05$<br>$GeH_4/He = 0.05$<br>NO | $SiH_4 + GeH_4 = 50$ | $GeH_4/SiH_4 = 4/10 \sim 4/100$<br>$NO/(GeH_4 + SiH_4) = 3/100$ | 0.18 | 5 | 1 |
| | Second layer | $SiH_4/He = 0.05$<br>$GeH_4/He = 0.05$ | $SiH_4 + GeH_4 = 50$ | $GeH_4/SiH_4 = 4/100$ | 0.18 | 5 | 1 |
| | Third layer | $SiH_4/He = 0.5$ | $SiH_4 = 200$ | | 0.18 | 15 | 15 |

TABLE F4

| Layer constitution | | Gases employed | Flow rate (SCCM) | Flow rate ratio | Discharging power ($W/cm^2$) | Layer formation speed (Å/sec) | Layer thickness ($\mu$) |
|---|---|---|---|---|---|---|---|
| Amorphous layer (I) | First layer | $SiH_4/He = 0.05$<br>$GeH_4/He = 0.05$<br>NO | $SiH_4 + GeH_4 = 50$ | $GeH_4/SiH_4 = 15/100 \sim 1/100$<br>$NO/(GeH_4 + SiH_4) = 3/100$ | 0.18 | 5 | 0.4 |
| | Second layer | $SiH_4/He = 0.05$<br>$GeH_4/He = 0.05$ | $SiH_4 + GeH_4 = 50$ | $GeH_4/SiH_4 = 1/100 \sim 0$ | 0.18 | 5 | 0.6 |
| | Third layer | $SiH_4/He = 0.5$ | $SiH_4 = 200$ | | 0.18 | 15 | 20 |

TABLE F5

| Layer constitution | | Gases employed | Flow rate (SCCM) | Flow rate ratio | Discharging power ($W/cm^2$) | Layer formation speed (A/sec) | Layer thickness ($\mu$) |
|---|---|---|---|---|---|---|---|
| Amorphous layer (I) | First layer | $SiH_4/He = 0.05$<br>$GeH_4/He = 0.05$<br>NO | $SiH_4 + GeH_4 = 50$ | $GeH_4/SiH_4 = 1/1 \sim 14/100$<br>$NO/(GeH_4 + SiH_4) = 3/100$ | 0.18 | 5 | 0.2 |
| | Second layer | $SiH_4/He = 0.05$<br>$GeH_4/He = 0.05$ | $SiH_4 + GeH_4 = 50$ | $GeH_4/SiH_4 = 14/100 \sim 0$ | 0.18 | 5 | 0.8 |
| | Third layer | $SiH_4/He = 0.5$ | $SiH_4 = 200$ | | 0.18 | 15 | 20 |

TABLE F6

| Layer constitution | | Gases employed | Flow rate (SCCM) | Flow rate ratio | Discharging power ($W/cm^2$) | Layer formation speed (Å/sec) | Layer thickness ($\mu$) |
|---|---|---|---|---|---|---|---|
| Amorphous layer (I) | First layer | $SiH_4/He = 0.05$<br>$GeH_4/He = 0.05$<br>NO | $SiH_4 + GeH_4 = 50$ | $GeH_4/SiH_4 = 2/10 \sim 45/1000$<br>$NO/(GeH_4 + SiH_4) = 1/100$ | 0.18 | 5 | 2 |
| | Second layer | $SiH_4/He = 0.05$<br>$GeH_4/He = 0.05$ | $SiH_4 + GeH_4 = 50$ | $GeH_4/SiH_4 = 45/1000 \sim 0$ | 0.18 | 5 | 6 |
| | Third layer | $SiH_4/He = 0.5$ | $SiH_4 = 200$ | | 0.18 | 15 | 10 |

TABLE F7

| Layer constitution | | Gases employed | Flow rate (SCCM) | Flow rate ratio | Discharging power ($W/cm^2$) | Layer formation speed (Å/sec) | Layer thickness ($\mu$) |
|---|---|---|---|---|---|---|---|
| Amorphous layer (I) | First layer | $SiH_4/He = 0.05$<br>$GeH_4/He = 0.05$<br>NO | $SiH_4 + GeH_4 = 50$ | $GeH_4/SiH_4 = 1/10 \sim 45/1000$<br>$NO/(GeH_4 + SiH_4) = 1/100$ | 0.18 | 5 | 4 |
| | Second layer | $SiH_4/He = 0.05$<br>$GeH_4/He = 0.05$ | $SiH_4 + GeH_4 = 50$ | $GeH_4/SiH_4 = 45/1000 \sim 0$ | 0.18 | 5 | 4 |
| | Third layer | $SiH_4/He = 0.5$ | $SiH_4 = 200$ | | 0.18 | 15 | 10 |

TABLE F8

| Layer constitution | | Gases employed | Flow rate (SCCM) | Flow rate ratio | Discharging power ($W/cm^2$) | Layer formation speed (Å/sec) | Layer thickness ($\mu$) |
|---|---|---|---|---|---|---|---|
| Amorphous layer (I) | First layer | $Si_2H_6/He = 0.05$<br>$GeH_4/He = 0.05$<br>NO | $Si_2H_6 + GeH_4 = 50$ | $GeH_4/Si_2H_6 = 4/10 \sim 3/100$<br>$NO/(GeH_4 + Si_2H_6) = 3/100$ | 0.18 | 5 | 2 |
| | Second layer | $Si_2H_6/He = 0.05$<br>$GeH_4/He = 0.05$ | $Si_2H_6 + GeH_4 = 50$ | $GeH_4/Si_2H_6 = 3/100 \sim 0$ | 0.18 | 5 | 8 |
| | Third layer | $Si_2H_6/He = 0.5$ | $Si_2H_6 = 200$ | | 0.18 | 15 | 10 |

TABLE F9

| Layer constitution | | Gases employed | Flow rate (SCCM) | Flow rate ratio | Discharging power ($W/cm^2$) | Layer formation speed (Å/sec) | Layer thickness ($\mu$) |
|---|---|---|---|---|---|---|---|
| Amorphous layer (I) | First layer | $SiF_4/He = 0.05$<br>$GeH_4/He = 0.05$<br>NO | $SiF_4 + GeH_4 = 50$ | $GeH_4/SiF_4 = 4/10 \sim 3/100$<br>$NO/(GeH_4 + SiF_4) = 3/100$ | 0.18 | 5 | 2 |
| | Second layer | $SiF_4/He = 0.05$<br>$GeH_4/He = 0.05$ | $SiF_4 + GeH_4 = 50$ | $GeH_4/SiF_4 = 3/100 \sim 0$ | 0.18 | 5 | 8 |
| | Third layer | $SiF_4/He = 0.5$ | $SiF_4 = 200$ | | 0.18 | 15 | 10 |

TABLE F10

| Layer constitution | | Gases employed | Flow rate (SCCM) | Flow rate ratio | Discharging power ($W/cm^2$) | Layer formation speed (Å/sec) | Layer thickness ($\mu$) |
|---|---|---|---|---|---|---|---|
| Amphorous layer (I) | First layer | $SiH_4/He = 0.05$<br>$SiF_4/He = 0.05$<br>$GeH_4/He = 0.05$<br>NO | $SiH_4 + SiF_4 + GeH_4 = 50$ | $GeH_4/(SiH_4 + SiF_4) = 4/10 \sim 3/100$<br>$NO/(GeH_4 + SiH_4 + SiF_4) = 3/100$ | 0.18 | 5 | 2 |
| | Second layer | $SiH_4/He = 0.05$<br>$SiF_4/He = 0.05$<br>$GeH_4/He = 0.05$ | $SiH_4 + SiF_4 + GeH_4 = 50$ | $GeH_4/(SiH_4 + SiF_4) = 3/100 \sim 0$ | 0.18 | 5 | 8 |
| | Third layer | $SiH_4/He = 0.5$<br>$SiF_4/He = 0.5$ | $SiH_4 + SiF_4 = 50$ | | 0.18 | 15 | 10 |

TABLE F11

| Layer constitution | Gases employed | Flow rate (SCCM) | Flow rate ratio | Discharging power (W/cm²) | Layer formation speed (A/sec) |
|---|---|---|---|---|---|
| Third layer | $SiH_4$/He = 0.5<br>$B_2H_6$/He = $10^{-3}$ | $SiH_4$ = 200 | $B_2H_6$/$SiH_4$ = $4 \times 10^{-4}$ | 0.18 | 15 |

TABLE F12

| Layer constitution | Gases employed | Flow rate (SCCM) | Flow rate ratio | Discharging power (W/cm²) | Layer formation speed (A/sec) |
|---|---|---|---|---|---|
| Third layer | $SiH_4$/He = 0.5<br>$PH_3$/He = $10^{-3}$ | $SiH_4$ = 200 | $PH_3$/$SiH_4$ = $2 \times 10^{-5}$ | 0.18 | 15 |

TABLE F11A

| Sample No. | 1101F | 1102F | 1103F | 1104F | 1105F | 1106F | 1107F | 1108F | 1109F | 1110F |
|---|---|---|---|---|---|---|---|---|---|---|
| First layer | Example 164 | Example 165 | Example 166 | Example 167 | Example 168 | Example 169 | Example 170 | Example 171 | Example 172 | Example 173 |
| Layer thickness of third layer (μ) | 10 | 10 | 15 | 20 | 20 | 10 | 10 | 10 | 10 | 10 |
| Evaluation | o | o | ◎ | ◎ | ◎ | ◎ | o | o | o | o |

◎: Excellent
o: Good

TABLE F12A

| Sample No. | 1201F | 1202F | 1203F | 1204F | 1205F | 1206F | 1207F | 1208F | 1209F | 1210F |
|---|---|---|---|---|---|---|---|---|---|---|
| First layer | Example 64 | Example 65 | Example 66 | Example 67 | Example 68 | Example 69 | Example 70 | Example 71 | Example 72 | Example 73 |
| Layer thickness of third layer (μ) | 10 | 10 | 15 | 20 | 20 | 10 | 10 | 10 | 10 | 10 |
| Evaluation | o | o | ◎ | ◎ | ◎ | ◎ | o | o | o | o |

◎ : Excellent
o: Good

TABLE F13

| Layer constitution | | Gases employed | Flow rate (SCCM) | Flow rate ratio | Discharging power (W/cm²) | Layer formation speed (A/sec) | Layer thickness (μ) |
|---|---|---|---|---|---|---|---|
| Amorphous layer (I) | First layer | $SiH_4$/He = 0.05<br>$GeH_4$/He = 0.05<br>NO | $SiH_4$ + $GeH_4$ = 50 | $GeH_4$/$SiH_4$ = 3/10~0<br>NO/$SiH_4$ = 4/10~2/100 | 0.18 | 5 | 2 |
| | Second layer | $SiH_4$/He = 0.5<br>NO | $SiH_4$ = 200 | NO/$SiH_4$ = 2/100~0 | 0.18 | 15 | 2 |
| | Third layer | $SiH_4$/He = 0.5 | $SiH_4$ = 200 | | 0.18 | 15 | 15 |

TABLE F14

| Layer constitution | | Gases employed | Flow rate (SCCM) | Flow rate ratio | Discharging power (W/cm²) | Layer formation speed (A/sec) | Layer thickness (μ) |
|---|---|---|---|---|---|---|---|
| Amorphous layer (I) | First layer | $SiH_4$/He = 0.05<br>$GeH_4$/He = 0.05<br>NO | $SiH_4$ + $GeH_4$ = 50 | $GeH_4$/$SiH_4$ = 3/10~0<br>NO/$SiH_4$ = 1/10~5/100 | 0.18 | 5 | 1 |
| | Second layer | $SiH_4$/He = 0.5<br>NO | $SiH_4$ = 200 | NO/$SiH_4$ = 5/100~0 | 0.18 | 15 | 1 |
| | Third layer | $SiH_4$/He = 0.5 | $SiH_4$ = 200 | | 0.18 | 15 | 18 |

TABLE F15

| Condition | Gases employed | Flow rate (SCCM) | Flow rate ratio or area ratio | Discharging power (W/cm²) | Layer thickness (μ) |
|---|---|---|---|---|---|
| 12-1F | Ar | 200 | Si wafer:Graphite = 1.5:8.5 | 0.3 | 0.5 |
| 12-2F | Ar | 200 | Si wafer:Graphite = 0.5:9.5 | 0.3 | 0.3 |
| 13-3F | Ar | 200 | Si wafer:Graphite = 6:4 | 0.3 | 1.0 |
| 12-4F | $SiH_4$/He = 1<br>$C_2H_4$ | $SiH_4$ = 15 | $SiH_4$:$C_2H_4$ = 0.4:9.6 | 0.18 | 0.3 |

TABLE F15-continued

| Condition | Gases employed | Flow rate (SCCM) | Flow rate ratio or area ratio | Discharging power ($W/cm^2$) | Layer thickness ($\mu$) |
|---|---|---|---|---|---|
| 12-5F | $SiH_4/He = 0.5$ $C_2H_4$ | $SiH_4 = 100$ | $SiH_4:C_2H_4 = 5:5$ | 0.18 | 1.5 |
| 12-6F | $SiH_4/He = 0.5$ $SiF_4/He = 0.5$ $C_2H_4$ | $SiH_4 + SiF_4 = 150$ | $SiH_4:SiF_4:C_2H_4 = 1.5:1.5:7$ | 0.18 | 0.5 |
| 12-7F | $SiH_4/He = 0.5$ $SiF_4/He = 0.5$ $C_2H_4$ | $SiH_4 + SiF_4 = 15$ | $SiH_4:SiF_4:C_2H_4 = 0.3:0.1:9.6$ | 0.18 | 0.3 |
| 12-8F | $SiH_4/He = 0.5$ $SiF_4/He = 0.5$ $C_2H_4$ | $SiH_4 + SiF_4 = 150$ | $SiH_4:SiF_4:C_2H_4 = 3:3:4$ | 0.18 | 1.5 |

TABLE F15A

| Amorphous layer (II) preparation condition | Sample No./Evaluation | | | | | | | | |
|---|---|---|---|---|---|---|---|---|---|
| 12-1F | 12-201F | 12-301F | 12-401F | 12-501F | 12-601F | 12-701F | 12-801F | 12-901F | 12-1001F |
| | o o | o o | o o | o o | o o | o o | o o | o o | o o |
| 12-2F | 12-202F | 12-302F | 12-402F | 12-502F | 12-602F | 12-702F | 12-802F | 12-902F | 12-1002F |
| | o o | o o | o o | o o | o o | o o | o o | o o | o o |
| 12-3F | 12-203F | 12-303F | 12-403F | 12-503F | 12-603F | 12-703F | 12-803F | 12-903F | 12-1003F |
| | o o | o o | o o | o o | o o | o o | o o | o o | o o |
| 12-4F | 12-204F | 12-304F | 12-404F | 12-504F | 12-604F | 12-704F | 12-804F | 12-904F | 12-1004F |
| | ◎ ◎ | ◎ ◎ | ◎ ◎ | ◎ ◎ | ◎ ◎ | ◎ ◎ | ◎ ◎ | ◎ ◎ | ◎ ◎ |
| 12-5F | 12-205F | 12-305F | 12-405F | 12-505F | 12-605F | 12-705F | 12-805F | 12-905F | 12-1005F |
| | ◎ ◎ | ◎ ◎ | ◎ ◎ | ◎ ◎ | ◎ ◎ | ◎ ◎ | ◎ ◎ | ◎ ◎ | ◎ ◎ |
| 12-6F | 12-206F | 12-306F | 12-406F | 12-506F | 12-606F | 12-706F | 12-806F | 12-906F | 12-1006F |
| | ◎ ◎ | ◎ ◎ | ◎ ◎ | ◎ ◎ | ◎ ◎ | ◎ ◎ | ◎ ◎ | ◎ ◎ | ◎ ◎ |
| 12-7F | 12-207F | 12-307F | 12-407F | 12-507F | 12-607F | 12-707F | 12-807F | 12-907F | 12-1007F |
| | o o | o o | o o | o o | o o | o o | o o | o o | o o |
| 12-8F | 12-208F | 12-308F | 12-408F | 12-508F | 12-608F | 12-708F | 12-808F | 12-908F | 12-1008F |
| | o o | o o | o o | o o | o o | o o | o o | o o | o o |

| | Sample No./Evaluation | |
|---|---|---|
| | Overall image quality evaluation | Durability evaluation |

Evaluation standards:
◎: Excellent
o: Good

TABLE F16

| Sample No. | 1601F | 1602F | 1603F | 1604F | 1605F | 1606F | 1607F |
|---|---|---|---|---|---|---|---|
| Si:C target (area ratio) | 9:1 | 6.5:3.5 | 4:6 | 2:8 | 1:9 | 0.5:9.5 | 0.2:9.8 |
| Si:C (content ratio) | 9.7:0.3 | 8.8:1.2 | 7.3:2.7 | 4.8:5.2 | 3:7 | 2:8 | 0.8:9.2 |
| Image quality evaluation | Δ | o | ◎ | ◎ | o | Δ | X |

◎: Very good
o: Good
Δ: Practically satisfactory
X: Image defect formed

TABLE F17

| Sample No. | 1701F | 1702F | 1703F | 1704F | 1705F | 1706F | 1707F | 1708F |
|---|---|---|---|---|---|---|---|---|
| $SiH_4:C_2H_4$ (Flow rate ratio) | 9:1 | 6:4 | 4:6 | 2:8 | 1:9 | 0.5:9.5 | 0.35:9.65 | 0.2:9.8 |
| Si:C (content ratio) | 9:1 | 7:3 | 5.5:4.5 | 4:6 | 3:7 | 2:8 | 1.2:8.8 | 0.8:9.2 |
| Image quality evaluation | Δ | o | ◎ | ◎ | ◎ | o | Δ | X |

◎: Very good
o: Good
Δ: Practically satisfactory
X: Image defect formed

TABLE F18

| Sample No. | 1801F | 1802F | 1803F | 1804F | 1805F | 1806F | 1807F | 1808F |
|---|---|---|---|---|---|---|---|---|
| $SiH_4:SiF_4:C_2H_4$ (flow rate | 5:4:1 | 3:3.5:3.5 | 2:2:6 | 1:1:8 | 0.6:0.4:9 | 0.2:0.3:9.5 | 0.2:0.15:9-.65 | 0.1:0.1:9.8 |

TABLE F18-continued

| Sample No. | 1801F | 1802F | 1803F | 1804F | 1805F | 1806F | 1807F | 1808F |
|---|---|---|---|---|---|---|---|---|
| ratio) | | | | | | | | |
| Si:C (content ratio) | 9:1 | 7:3 | 5.5:4.5 | 4:6 | 3:7 | 2:8 | 1.2:8.8 | 0.8:9.2 |
| Image quality evaluation | Δ | o | ◎ | ◎ | ◎ | o | Δ | X |

◎: Very good
o: Good
Δ: Practically satisfactory
X: Image defect formed

TABLE F19

| Sample No. | Thickness of amorphous layer (II) (μ) | Results |
|---|---|---|
| 1901F | 0.001 | Image defect liable to occur |
| 1902F | 0.02 | No image defect during 20.000 repetitions |

TABLE F19-continued

| Sample No. | Thickness of amorphous layer (II) (μ) | Results |
|---|---|---|
| 1903F | 0.05 | Stable for 50.000 repetitions or more |
| 1904F | 1 | Stable for 200.000 repetitions or more |

TABLE G1

| Layer constitution | | Gases employed | Flow rate (SCCM) | Flow rate ratio | Discharging power ($W/cm^2$) | Layer formation speed (Å/sec) | Layer thickness (μ) |
|---|---|---|---|---|---|---|---|
| Amorphous layer (I) | First layer | $SiH_4/He = 0.5$<br>$GeH_4/He = 00.5$<br>$B_2H_6/He = 10^{-3}$<br>NO | $SiH_4 + GeH_4 = 50$ | $GeH_4/SiH_4 = 4/10 \sim 0$<br>$B_2H_6/(GeH_4 + SiH_4) = 3 \times 10^{-3}$<br>$NO/(GeH_4 + SiH_4) = 3/100$ | 0.18 | 5 | 1 |
| | Second layer | $SiH_4/He = 0.5$ | $SiH_4 = 200$ | | 0.18 | 15 | 19 |
| Amorphous layer (II) | | $SiH_4/He = 0.5$<br>$C_2H_4$ | $SiH_4 = 100$ | $SiH_4:C_2H_4 = 3:7$ | 0.18 | 10 | 0.5 |

TABLE G2

| Layer constitution | | Gases employed | Flow rate (SCCM) | Flow rate ratio | Discharging power ($W/cm^2$) | Layer formation speed (Å/sec) | Layer thickness (μ) |
|---|---|---|---|---|---|---|---|
| Amorphous layer (I) | First layer | $SiH_4/He = 0.05$<br>$GeH_4/He = 0.05$<br>$B_2H_6/He = 10^{-3}$<br>NO | $SiH_4 + GeH_4 = 50$ | $GeH_4/SiH_4 = 1/10 \sim 0$<br>$B_2H_6/(GeH_4 + SiH_4) = 1 \times 10^{-3}$<br>$NO/(GeH_4 + SiH_4) = 1/100$ | 0.18 | 5 | 2 |
| | Second layer | $SiH_4/He = 0.5$ | $SiH_4 = 200$ | | 0.18 | 15 | 15 |

TABLE G3

| Layer constitution | | Gases employed | Flow rate (SCCM) | Flow rate ratio | Discharging power ($W/cm^2$) | Layer formation speed (A/sec) | thickness (μ) |
|---|---|---|---|---|---|---|---|
| Amorphous layer (I) | First layer | $SiH_4/He = 0.05$<br>$GeH_4/He = 0.05$<br>$B_2Hhd\ 6/He = 10^{-3}$<br>NO | $SiH_4 + GeH_4 = 50$ | $GeH_4/SiH_4 = 4/10 \sim 2/1000$<br>$B_2H_6/(GeH_4 + SiH_4) = 1 \times 10^{-3}$<br>$NO/(GeH_4 + SiH_4) = 1/100$ | 0.18 | 5 | 2 |
| | Second layer | $SiH_4/He = 0.5$ | $SiH_4 = 200$ | | 0.18 | 15 | 15 |

TABLE G4

| Layer constitution | | Gases employed | Flow rate (SCCM) | Flow rate ratio | Discharging power ($W/cm^2$) | Layer formation speed (A/sec) | Layer thickness (μ) |
|---|---|---|---|---|---|---|---|
| Amorphous layer (I) | First layer | $SiH_4/He = 0.05$<br>$GeH_4/He = 0.05$<br>$B_2H_6/He = 10^{-3}$<br>NO | $SiH_4 + GeH_4 = 50$ | $GeH_4/SiH_4 = 15/100 \sim 0$<br>$B_2H_6/(GeH_4 + SiH_4) = 3 \times 10^{-3}$<br>$NO/(GeH_4 + SiH_4) = 2/100$ | 0.18 | 5 | 1 |

TABLE G4-continued

| Layer constitution | | Gases employed | Flow rate (SCCM) | Flow rate ratio | Discharging power (W/cm²) | Layer formation speed (A/sec) | Layer thickness (μ) |
|---|---|---|---|---|---|---|---|
| | Second layer | $SiH_4/He = 0.5$ | $SiH_4 = 0\ 200$ | | 0.18 | 15 | 15 |

TABLE G5

| Layer constitution | | Gases employed | Flow rate (SCCM) | Flow rate ratio | Dis-charging power (W/cm²) | Layer formation speed (A/sec) | Layer thick-ness (μ) |
|---|---|---|---|---|---|---|---|
| Amorphous layer (1) | First layer | $SiH_4/He = 0.05$<br>$GeH_4He = 0.05$<br>$B_2H_6/He = 10^{-3}$<br>NO | $SiH_4 + GeH_4 = 50$ | $GeH_4/SiH_4 = 1/1 \sim 5/100$<br>$B_2H_6/(GeH_4 + SiH_4) = 3 \times 10^{-3}$<br>$NO/(GeH_4 + SiH_4) = 2/100$ | 0.18 | 5 | 1 |
| | Second layer | $SiH_4/He = 0.5$ | $SiH_4 = 200$ | | 0.18 | 15 | 15 |

TABLE G6

| Layer constitution | | Gases employed | Flow rate (SCCM) | Flow rate ratio | Dis-charging power (W/cm²) | Layer formation speed (A/sec) | Layer thick-ness (μ) |
|---|---|---|---|---|---|---|---|
| Amorphous layer (I) | First layer | $SiH_4/He = 0.05$<br>$GeH_4/He = 0.05$<br>$B_2H_6/He = 10^{-3}$<br>NO | $SiH_4 + GeH_4\ 32\ 50$ | $GeH_4/SiH_4 = 2/10 \sim 0$<br>$B_2H_6/(GeH_4 + SiH_4) = 3 \times 10^{-3}$<br>$NO/(GeH_4 + SiH_4) = 2/100$ | 0.18 | 5 | 1 |
| | Second layer | $SiH_4/He = 0.5$ | $SiH_4 = 200$ | | 0.18 | 15 | 15 |

TABLE G7

| Layer constitution | | Gases employed | Flow rate (SCCM) | Flow rate ratio | Dis-charging power (W/cm²) | Layer formation speed (Å/sec) | Layer thick-ness (μ) |
|---|---|---|---|---|---|---|---|
| Amorphous layer (I) | First layer | $SiH_4/He = 0.05$<br>$GeH_4/He = 0.05$<br>$B_2H_6/He = 10^{-3}$<br>NO | $SiH_4 + GeH_4$ | $GeH_4/SiH_4 = 1/10 \sim 0$<br>$B_2H_6/(GeH_4 + 0\ SiH_4) = 3 \times 10^{-3}$<br>$NO/(GeH_4 + SiH_4) = 2/100$ | 0.18 | 5 | 1 |
| | Second layer | $SiH_4/He = 0.5$ | $SiH_4 = 200$ | | 0.18 | 15 | 15 |

TABLE G8

| Layer constitution | | Gases employed | Flow rate (SCCM) | Flow rate ratio | Dis-charging power (W/cm²) | Layer formation speed (Å/sec) | Layer thick-ness (μ) |
|---|---|---|---|---|---|---|---|
| Amorphous layer (I) | First layer | $Si_2H_6/He = 0.05$<br>$GeH_4/He = 0.05$<br>$B_2H_6/He = 10^{-3}$<br>NO | $Si_2H_6 + GeH_4 = 50$ | $GeH_4/Si_2H_6 = 4/10 \sim 0$<br>$B_2H_6/(GeH_4 + Si_2H_6) = 3 \times 10^{-3}$<br>$NO/(GeH_4 + Si_2H_6) = 2/100$ | 0.18 | 5 | 1 |
| | Second layer | $Si_2H_6/He = 0.5$ | $Si_2H_6 = 200$ | | 0.18 | 15 | 19 |

TABLE G9

| Layer constitution | | Gases employed | Flow rate (SCCM) | Flow rate ratio | Dis-charging power (W/cm²) | Layer formation speed (Å/sec) | Layer thick-ness (μ) |
|---|---|---|---|---|---|---|---|
| Amorphous layer (I) | First layer | $SiF_4/He = 0.05$<br>$GeH_4/He = 0.05$<br>$B_2H_6/He = 10^{-3}$<br>NO | $SiF_4 + GeH_4 = 50$ | $GeH_4/SiF_4 = 4/10 \sim 0$<br>$B_2H_6/(GeH_4 + SiF_4) = 3 \times 10^{-3}$<br>$NO/(GeH_4 + SiF_4) = 1/100$ | 0.18 | 5 | 1 |
| | Second layer | $SiF_4/He = 0.05$ | $SiF_4 = 200$ | | 0.18 | 5 | 19 |

TABLE G10

| Layer constitution | | Gases employed | Flow rate (SCCM) | Flow rate ratio | Dis-charging power ($W/cm^2$) | Layer formation speed (A/sec) | Layer thick-ness (μ) |
|---|---|---|---|---|---|---|---|
| Amorphous layer I | First layer | $SiH_4/He = 0.05$<br>$SiF_4/He = 0.05$<br>$GeH_4/He = 0.05$<br>$B_2H_6/He = 10^{-3}$<br>NO | $SiH_4 + SiF_4 + GeH_4 = 50$ | $GeH_4/(SiH_4 + SiF_4) = 4/10 \sim 0$<br>$B_2H_6/(GeH_4 + SiH_4 + SiF_4) = 3 \times 10^{-3}$<br>$NO/(GeH_4 + SiH_4 + SiF_4) = 1/100$ | 0.18 | 5 | 1 |
| | Second layer | $SiH_4/He = 0.5$<br>$SiF_4/He = 0.5$ | $SiH_4 + SiF_4 = 200$ | | 0.18 | 5 | 19 |

TABLE G11

| Layer constitution | | Gases employed | Flow rate (SCCM) | Flow rate ratio | Dis-charging power ($W/cm^2$) | Layer formation speed (Å/sec) | Layer thick-ness (μ) |
|---|---|---|---|---|---|---|---|
| Amorphous layer I | First layer | $SiH_4/He = 0.05$<br>$GeH_4/He = 0.05$<br>$B_2H_6/He = 10^{-3}$<br>NO | $SiH_4 + GeH_4 = 50$ | $GeH_4/SiH_4 = 4/10 \sim 0$<br>$B_2H_6/(GeH_4 + SiH_4) = 3 \times 10^{-3}$<br>$NO/(GeH_4 + SiH_4) = 3/100$ | 0.18 | 5 | 1 |
| | Second layer | $SiH_4/He = 0.5$<br>$B_2H_6/He = 10^{-3}$ | $SiH_4 = 200$ | $B_2H_6/SiH_4 = 3 \times 10^{-3}$ | 0.18 | 15 | 19 |

TABLE G12

| Sample No. | 1201G | 1202G | 1203G | 1204G | 1205G | 1206G | 1207G | 1208G |
|---|---|---|---|---|---|---|---|---|
| $B_2H_6/(SiH_4 + GeH_4)$ Flow rate ratio | $1 \times 10^{-2}$ | $5 \times 10^{-3}$ | $2 \times 10^{-3}$ | $1 \times 10^{-3}$ | $8 \times 10^{-4}$ | $5 \times 10^{-4}$ | $3 \times 10^{-4}$ | $1 \times 10^{-4}$ |
| B content (atomic ppm) | $1 \times 10^4$ | $6 \times 10^3$ | $2.5 \times 10^3$ | $1 \times 10^3$ | 800 | 500 | 300 | 100 |
| Evaluation | o | ◎ | ◎ | ◎ | ◎ | o | o | o |

◎: Excellent
o: Good

TABLE G13

| Layer consti-tution | Gases employed | Flow rate (SCCM) | Flow rate ratio | Dis-charging power ($W/cm^2$) | Layer formation speed (Å/sec) |
|---|---|---|---|---|---|
| Second layer | $SiH_4/He = 0.5$<br>$B_2H_6/He = 10^{-3}$ | SiH = 200 | $B_2H_6/SiH_4 = 8 \times 10^{-5}$ | 0.18 | 15 |

TABLE G14

| Layer consti-tution | Gases employed | Flow rate (SCCM) | Flow rate ratio | Dis-charging power ($W/cm^2$) | Layer formation speed (Å/sec) |
|---|---|---|---|---|---|
| Second layer | $SiH_4/He = 0.5$<br>$PH_3/He = 10^{-3}$ | $SiH_4 = 200$ | $PH_3/SiH_4 = 1 \times 10^{-5}$ | 0.18 | 15 |

TABLE G13A

| Sample No. | 1301G | 1302G | 1303G | 1304G | 1305G | 1306G | 1307G | 1308G | 1309G | 1310G |
|---|---|---|---|---|---|---|---|---|---|---|
| First layer | Example 184 | Example 185 | Example 186 | Example 187 | Example 188 | Example 189 | Example 190 | Example 191 | Example 192 | Example 193 |
| Layer thickness of second layer (μ) | 10 | 10 | 20 | 15 | 20 | 15 | 10 | 10 | 10 | 10 |
| Evaluation | o | o | ◎ | ◎ | ◎ | ◎ | o | o | o | o |

◎: Excellent
o: Good

TABLE G14A

| Sample No. | 1401G | 1402G | 1403G | 1404G | 105G | 1406G | 1407G | 1408G | 14019G | 1410G |
|---|---|---|---|---|---|---|---|---|---|---|
| First layer | Example 1 | Example 2 | Example 3 | Example 4 | Example 5 | Example 6 | Example 7 | Example 8 | Example 9 | Example 10 |
| Layer thickness of second layer (μ) | 10 | 10 | 20 | 15 | 20 | 15 | 10 | 10 | 10 | 10 |
| Evaluation | o | o | ◎ | ◎ | ◎ | ◎ | o | o | o | o |

◎: Excellent
o: Good

TABLE 15G

| Condition | Gases employed | Flow rate (SCCM) | Flow rate ratio or area ratio | Discharging power ($W/cm^2$) | Layer thickness ($\mu$) |
|---|---|---|---|---|---|
| 12-1G | Ar | 200 | Si wafer:Graphite = 1.5:8.5 | 0.3 | 0.5 |
| 12-2G | Ar | 200 | Si wafer:Graphite = 0.5:9.5 | 0.3 | 0.3 |
| 12-3G | Ar | 200 | Si wafer:Graphite = 6:4 | 0.3 | 1.0 |
| 12-4G | $SiH_4$/He = 1<br>$C_2H_4$ | $SiH_4$ = 15 | $SiH_4$:$C_2H_4$ = 0.4:9.6 | 0.18 | 0.3 |
| 12-5G | $SiH_4$/He = 0.5<br>$C_2H_4$ | $SiH_4$ = 100 | $SiH_4$:$C_2H_4$ = 5:5 | 0.18 | 1.5 |
| 12-6G | $SiH_4$/He = 0.5<br>$SiF_4$/He = 0.5<br>$C_2H_4$ | $SiH_4$ + $SiF_4$ = 150 | $SiH_4$:$SiF_4$:$C_2H_4$ = 1.5:1.5:7 | 0.18 | 0.5 |
| 12-7G | $SiH_4$/He = 0.5<br>$SiF_4$/He = 0.5<br>$C_2H_4$ | $SiH_4$ + $SiF_4$ = 15 | $SiH_4$:$SiF_4$:$C_2H_4$ = 0.3:0.1:9.6 | 0.18 | 0.3 |
| 12-8G | $SiH_4$/He = 0.5<br>$SiF_4$/He = 0.5<br>$C_2H_4$ | $SiH_4$ + $SiF_4$ = 150 | $SiH_4$:$SiF_4$:$C_2H_4$ = 3:3:3 | 0.18 | 1.5 |

TABLE G 15A

| Amorphous layer (II) preparation condition | Sample No./Evaluation | | | | | | | | |
|---|---|---|---|---|---|---|---|---|---|
| 12-1G | 12-201G<br>o o | 12-301G<br>o o | 12-401G<br>o o | 12-501G<br>o o | 12-601G<br>o o | 12-701G<br>o o | 12-801G<br>o o | 12-901G<br>o o | 12-100G<br>o o |
| 12-2G | 12-202G<br>o o | 12-302G<br>o o | 12-402G<br>o o | 12-502G<br>o o | 12-602G<br>o o | 12-702G<br>o o | 12-802G<br>o o | 12-902G<br>o o | 12-1002G<br>o o |
| 12-3G | 12-203G<br>o o | 12-303G<br>o o | 12-403G<br>o o | 12-503G<br>o o | 12-603G<br>o o | 12-703G<br>o o | 12-803G<br>o o | 12-903G<br>o o | 12-1003G<br>o o |
| 12-4G | 12-204G<br>◎ ◎ | 12-304G<br>◎ ◎ | 12-404G<br>◎ ◎ | 12-504G<br>◎ ◎ | 12-604G<br>◎ ◎ | 12-704G<br>◎ ◎ | 12-804G<br>◎ ◎ | 12-904G<br>◎ ◎ | 12-1004<br>◎ ◎ |
| 12-5G | 12-205G<br>◎ ◎ | 12-305G<br>◎ ◎ | 12-405G<br>◎ ◎ | 12-505G<br>◎ ◎ | 12-605G<br>◎ ◎ | 12-705G<br>◎ ◎ | 12-805G<br>◎ ◎ | 12-905G<br>◎ ◎ | 12-1005G<br>◎ ◎ |
| 12-6G | 12-206G<br>◎ ◎ | 12-306G<br>◎ ◎ | 12-406G<br>◎ ◎ | 12-506G<br>◎ ◎ | 12-606G<br>◎ ◎ | 12-706G<br>◎ ◎ | 12-806G<br>◎ ◎ | 12-906G<br>◎ ◎ | 12-1006G<br>◎ ◎ |
| 12-7G | 12-207G<br>o o | 12-307G<br>o o | 12-407G<br>o o | 12-507G<br>o o | 12-607G<br>o o | 12-707G<br>o o | 12-807G<br>o o | 12-907G<br>o o | 12-1007G<br>o o |
| 12-8G | 12-208G<br>o o | 12-308G<br>o o | 12-408G<br>o o | 12-508G<br>o o | 12-608G<br>o o | 12-708G<br>o o | 12-808G<br>o o | 12-908G<br>o o | 12-1008G<br>o o |
| | Sample No./Evaluation<br>Overall image quality evaluation | Durability evaluation | | | | | | | |

Evaluation standards:
◎ : Excellent
o: Good

TABLE G16

| Sample No. | 1601G | 1602G | 1603G | 1604G | 1605G | 1606G | 1607G |
|---|---|---|---|---|---|---|---|
| Si:C Target (Area ratio) | 9:1 | 6.5:3.5 | 4:6 | 2:8 | 1:9 | 0.5:9.5 | 0.2:9.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | o | ◎ | ◎ | o | Δ | X |

◎: Very good
o: Good
Δ: Practically satisfactory
X: Image defect formed

TABLE G17

| Sample No. | 1701G | 1702G | 1703G | 1704G | 1705G | 1706G | 1707G | 1708G |
|---|---|---|---|---|---|---|---|---|
| $SiH_4$:$C_2H_4$ (flow rate ratio) | 9:1 | 6:4 | 4:6 | 2:8 | 1:9 | 0.5:9.5 | 0.35:9.65 | 0.2:9.8 |
| Si:C (content ratio) | 9:1 | 7:3 | 5.5:4.5 | 4:6 | 3:7 | 2:8 | 1.2:8.8 | 0.8:9.2 |
| Image quality evaluation | Δ | o | ◎ | ◎ | ◎ | o | Δ | X |

◎: Very good
o: Good
Δ: Practically satisfactory
X: Image defect formed

TABLE G18

| Sample No. | 1081G | 1802G | 1803G | 1804G | 1805G | 1806G | 1807G | 1808G |
|---|---|---|---|---|---|---|---|---|
| $SiH_4$:$SiF_4$:$C_2H_4$ (flow rate ratio) | 5:4:1 | 3:4.5:3.5 | 2:2:6 | 1:1:8 | 0.6:0.4:9 | 0.2:0.3:9.5 | 0.2:0.15:9.65 | 0.1:0.1:9.8 |
| Si:C (content ratio) | 9:1 | 7:3 | 5.5:4.5 | 4:6 | 3:7 | 2:8 | 1.2:8.8 | 0.8:9.2 |
| Image quality evaluation | Δ | o | ◎ | ◎ | ◎ | o | Δ | X |

◎: Very good
o: Good
Δ: Practically satisfactory
X: Image defect formed

TABLE G19

| Sample No. | Thickness of amorphous layer (II) (μ) | Results |
|---|---|---|
| 1901G | 0.001 | Image defect liable to occur |
| 1902G | 0.02 | No image defect during 20,000 repetitions |
| 1903G | 0.05 | Stable for 50,000 repetitions or more |

TABLE G19-continued

| Sample No. | Thickness of amorphous layer (II) (μ) | Results |
|---|---|---|
| 1904G | 1 | Stable for 200,000 repetitions or more |

TABLE H1

| Layer constitution | | Gases employed | Flow rate (SCCM) | Flow rate ratio | Discharging power ($W/cm^2$) | Layer formation speed (A/sec) | Layer thickness (μ) |
|---|---|---|---|---|---|---|---|
| Amorphous layer (I) | First layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 4/10 \sim 0$<br>$B_2H_6/(GeH_4 + SiH_4) = 3 \times 10^{-3}$ | 0.18 | 5 | 1 |
| | Second layer | $SiH_4/He = 0.5$ | $SiH_4 = 200$ | | 0.18 | 15 | 19 |
| Amorphous layer (II) | | $SiH_4/He = 0.5$<br>$C_2H_4$ | $SiH_4 = 100$ | $SiH_4$:$C_2H_4$ = 3:7 | 0.18 | 10 | 0.5 |

TABLE H2

| Layer constitution | | Gases employed | Flow rate (SCCM) | Flow rate ratio | Discharging power ($W/cm^2$) | Layer formation speed (A/sec) | Layer thickness (μ) |
|---|---|---|---|---|---|---|---|
| Amorphous layer (I) | First layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 1/10 \sim 0$<br>$B_2H_6/(GeH_4 + SiH_4) = 1 \times 10^{-3}$ | 0.18 | 5 | 2 |
| | Second layer | $SiH_4/He = 0.5$ | $SiH_4 = 200$ | | 0.18 | 15 | 15 |

TABLE H3

| Layer constitution | | Gases employed | Flow rate (SCCM) | Flow rate ratio | Discharging power ($W/cm^2$) | Layer formation speed (A/sec) | Layer thickness (μ) |
|---|---|---|---|---|---|---|---|
| Amorphous layer (I) | First layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 4/10 \sim 2/1000$<br>$B_2H_6/(GeH_4 + SiH_4) = 1 \times 10^{-3}$ | 0.18 | 5 | 2 |
| | Second layer | $SiH_4/He = 0.5$ | $SiH_4 = 200$ | | 0.18 | 15 | 15 |

TABLE H4

| Layer constitution | | Gases employed | Flow rate (SCCM) | Flow rate ratio | Discharging power ($W/cm^2$) | Layer formation speed (A/sec) | Layer thickness (μ) |
|---|---|---|---|---|---|---|---|
| Amorphous layer (I) | First layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 15/100 \sim 0$<br>$B_2H_6/GeH_4 + SiH_4) = 3 \times 10^{-3}$ | 0.18 | 5 | 1 |
| | Second layer | $SiH_4/He = 0.5$ | $SiH_4 = 200$ | | 0.18 | 15 | 15 |

TABLE H5

| Layer constitution | | Gases employed | Flow rate (SCCM) | Flow rate ratio | Discharging power (W/cm²) | Layer formation speed (Å/sec) | Layer thickness (μ) |
|---|---|---|---|---|---|---|---|
| Amorphous layer (I) | First layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 1 \sim 5/100$<br>$B_2H_6/(GeH_4 + SiH_4) = 3 \times 10^{-4}$ | 0.18 | 5 | 1 |
| | Second layer | $SiH_4/He = 0.5$ | $SiH_4 = 200$ | | 0.18 | 15 | 15 |

TABLE H6

| Layer constitution | | Gases employed | Flow rate (SCCM) | Flow rate ratio | Discharging power (W/cm²) | Layer formation speed (Å/sec) | Layer thickness (μ) |
|---|---|---|---|---|---|---|---|
| Amorphous layer (I) | First layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 2/10 \sim 0$<br>$B_2H_6/(GeH_4 + SiH_4) = 3 \times 10^{-3}$ | 0.18 | 5 | 1 |
| | Second layer | $SiH_4/He = 0.5$ | $SiH_4 = 200$ | | 0.18 | 15 | 15 |

TABLE H7

| Layer constitution | | Gases employed | Flow rate (SCCM) | Flow rate ratio | Discharging power (W/cm²) | Layer formation speed (Å/sec) | Layer thickness (μ) |
|---|---|---|---|---|---|---|---|
| Amorphous layer (I) | First layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 1/10 \sim 0$<br>$B_2H_6/(GeH_4 + SiH_4) = 1 \times 10^{-3}$ | 0.18 | 5 | 1 |
| | Second layer | $SiH_4/He = 0.5$ | $SiH_4 = 200$ | | 0.18 | 15 | 15 |

TABLE H8

| Layer constitution | | Gases employed | Flow rate (SCCM) | Flow rate ratio | Discharging power (W/cm²) | Layer formation speed (Å/sec) | Layer thickness (μ) |
|---|---|---|---|---|---|---|---|
| Amorphous layer (I) | First layer | $Si_2H_6/He = 0.05$<br>$GeH_4/He = 0.05$<br>$B_2H_6/He = 10^{-3}$ | $Si_2H_6 + GeH_4 = 50$ | $GeH_4/Si_2H_6 = 4/10 \sim 0$<br>$B_2H_6/(GeH_4 + Si_2H_6) = 3 \times 10^{-3}$ | 0.18 | 5 | 1 |
| | Second layer | $Si_2H_6/He = 0.5$ | $Si_2H_6 = 200$ | | 0.18 | 15 | 19 |

TABLE H9

| Layer constitution | | Gases employed | Flow rate (SCCM) | Flow rate ratio | Discharging power (W/cm²) | Layer formation speed (Å/sec) | Layer thickness (μ) |
|---|---|---|---|---|---|---|---|
| Amorphous layer (I) | First layer | $SiF_4/He = 0.05$<br>$GeH_4/He = 0.05$<br>$B_2H_6/He = 10^{-3}$ | $SiF_4 + GeH_4 = 50$ | $GeH_4/SiF_4 = 4/10 \sim 0$<br>$B_2H_6/(GeH_4 + SiF_4) = 1 \times 10^{-3}$ | 0.18 | 5 | 1 |
| | Second layer | $SiF_4/He = 0.5$ | $SiF_4 = 200$ | | 0.18 | 15 | 19 |

TABLE H10

| Layer constitution | | Gases employed | Flow rate (SCCM) | Flow rate ratio | Discharging power (W/cm²) | Layer formation speed (Å/sec) | Layer thickness (μ) |
|---|---|---|---|---|---|---|---|
| Amorphous layer (I) | First layer | $SiH_4/He = 0.05$<br>$SiF_4/He = 0.05$<br>$GeH_4/He = 0.05$<br>$B_2H_6/He = 10^{-3}$ | $SiH_4 + SiF_4 + GeH_4 = 50$ | $GeH_4/(SiH_4 + SiF_4) = 4/10 \sim 0$<br>$B_2H_6/(GeH_4 + SiH_4 + SiF_4) = 3 \times 10^{-3}$ | 0.18 | 5 | 1 |
| | Second layer | $SiH_4/He = 0.5$<br>$SiF_4/He = 0.5$ | $SiH_4 + SiF_4 = 200$ | | 0.18 | 15 | 19 |

TABLE H11

| Layer constitution | | Gases employed | Flow rate (SCCM) | Flow rate ratio | Discharging power (W/cm$^2$) | Layer formation speed (A/sec) | Layer thickness (μ) |
|---|---|---|---|---|---|---|---|
| Amorphous layer (I) | First layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 4/10 \sim 0$<br>$B_2H_6/(GeH_4 + SiH_4) = 5 \times 10^{-4}$ | 0.18 | 5 | 1 |
| | Second layer | $SiH_4/He = 0.5$<br>$B_2H_6/He = 10^{-3}$ | $SiH_4 = 200$ | $B_2H_6/SiH_4 = 5 \times 10^{-4}$ | 0.18 | 15 | 15 |

TABLE H12

| Layer constitution | | Gases employed | Flow rate (SCCM) | Flow rate ratio | Discharging power (W/cm$^2$) | Layer formation speed (Å/sec) | Layer thickness (μ) |
|---|---|---|---|---|---|---|---|
| Amorphous layer (I) | First layer | $SiH_4/He = 0.05$<br>$GeH_4/He = 0.05$<br>$B_2H_6/He = 10^{-3}$ | $SiH_4 + GeH_4 = 50$ | $GeH_4/SiH_4 = 4/10 \sim 0$<br>$B_2H_6/(GeH_4 + SiH_4) = 3 \times 10^{-3}$ | 0.18 | 5 | 1 |
| | Second layer | $SiH_4/He = 0.5$<br>$B_2H_6/He = 10^{-3}$ | $SiH_4 = 200$ | $B_2H_6/SiH_4 = 2 \times 10^{-4}$ | 0.18 | 15 | 15 |

TABLE H13

| Layer constitution | Gases employed | Flow rate (SCCM) | Flow rate ratio | Discharging power (W/cm$^2$) | Layer formation speed (Å/sec) |
|---|---|---|---|---|---|
| Second layer | $SiH_4/He = 0.5$<br>$B_2H_6/He = 10^{-3}$ | $SiH_4 = 200$ | $B_2H_6/SiH_4 = 1 \times 10^{-4}$ | 0.18 | 15 |

TABLE H13A

| Sample No. | 1301H | 1302H | 1303H | 1304H | 1305H | 1306H | 1307H | 1308H | 1309H | 1310H |
|---|---|---|---|---|---|---|---|---|---|---|
| First layer | Example 203 | Example 204 | Example 205 | Example 206 | Example 207 | Example 208 | Example 209 | Example 210 | Example 211 | Example 212 |
| Layer thickness of second layer (μ) | 19 | 15 | 15 | 15 | 15 | 15 | 15 | 19 | 19 | 19 |
| Evaluation | o | o | ◎ | ◎ | ◎ | ◎ | o | o | o | o |

◎: Excellent
o: Good

TABLE H14

| Layer constitution | Gases employed | Flow rate (SCCM) | Flow rate ratio | Discharging power (W/cm$^2$) | Layer formation speed (Å/sec) |
|---|---|---|---|---|---|
| Second layer | $SiH_4/He = 0.5$<br>$PH_3/He = 10^{-3}$ | $SiH_4 = 200$ | $PH_3/SiH_4 = 9 \times 10^{-5}$ | 0.18 | 15 |

TABLE H14A

| Sample No. | 1401H | 1402H | 1403H | 1404H | 1405H | 1406H | 1407H | 1408H | 1409H | 1410H |
|---|---|---|---|---|---|---|---|---|---|---|
| First layer | Example 203 | Example 204 | Example 205 | Example 206 | Example 207 | Example 208 | Example 209 | Example 210 | Example 211 | Example 212 |
| Layer thickness of second layer (μ) | 19 | 15 | 15 | 15 | 15 | 15 | 15 | 19 | 19 | 19 |
| Evaluation | o | o | ◎ | ◎ | ◎ | ◎ | o | o | o | o |

◎: Excellent
o: Good

TABLE H15

| Condition | Gases employed | Flow rate (SCCM) | Flow rate ratio or area ratio | Discharging power (W/cm$^2$) | Layer thickness (μ) |
|---|---|---|---|---|---|
| 12-1H | Ar | 200 | Si wafer:Graphite = 1.5:8.5 | 0.3 | 0.5 |
| 12-2H | Ar | 200 | Si wafer:Graphite = 0.5:9.5 | 0.3 | 0.3 |
| 12-3H | Ar | 200 | Si wafer:Graphite = 6:4 | 0.3 | 1.0 |
| 12-4H | $SiH_4/He = 1$<br>$C_2H_4$ | $SiH_4 = 15$ | $SiH_4:C_2H_4 = 0.4:9.6$ | 0.18 | 0.3 |
| 12-5H | $SiH_4/He = 0.5$<br>$C_2H_4$ | $SiH_4 = 100$ | $SiH_4:C_2H_4 = 5:5$ | 0.18 | 1.5 |
| 12-6H | $SiH_4/He = 0.5$ | $SiH_4 + SiF_4 =$ | $SiH_4:SiF_4:C_2H_4 = 1.5:1.5:7$ | 0.18 | 0.5 |

TABLE H15-continued

| Condition | Gases employed | Flow rate (SCCM) | Flow rate ratio or area ratio | Discharging power ($W/cm^2$) | Layer thickness ($\mu$) |
|---|---|---|---|---|---|
| | $SiF_4/He = 0.5$ $C_2H_4$ | 150 | | | |
| 12-7H | $SiH_4/He = 0.5$ $SiF_4/He = 0.5$ $C_2H_4$ | $SiH_4 + SiF_4 =$ 15 | $SiH_4:SiF_4:C_2H_4 = 0.3:0.1:9.6$ | 0.18 | 0.3 |
| 12-8H | $SiH_4/He = 0.5$ $SiF_4/He = 0.5$ $C_2H_4$ | $SiH_4 + SiF_4 =$ 150 | $SiH_4:SiF_4:C_2H_4 = 3:3:4$ | 0.18 | 1.5 |

TABLE H16

| Amorphous layer (II) preparation condition | Sample No./Evaluation | | | | | | | | |
|---|---|---|---|---|---|---|---|---|---|
| 12-1H | 12-201H o o | 12-301H o o | 12-401H o o | 12-501H o o | 12-601H o o | 12-701H o o | 12-801H o o | 12-901H o o | 12-1001H o o |
| 12-2H | 12-202H o o | 12-302H o o | 12-402H o o | 12-502H o o | 12-602H o o | 12-702H o o | 12-802H o o | 12-902H o o | 12-1002H o o |
| 12-3H | 12-203H o o | 12-303H o o | 12-403H o o | 12-503H o o | 12-603H o o | 12-703H o o | 12-803H o o | 12-903H o o | 12-1003H o o |
| 12-4H | 12-204H ◎ ◎ | 12-304H ◎ ◎ | 12-404H ◎ ◎ | 12-504H ◎ ◎ | 12-604H ◎ ◎ | 12-704H ◎ ◎ | 12-804H ◎ ◎ | 12-904H ◎ ◎ | 12-1004H ◎ ◎ |
| 12-5H | 12-205H ◎ ◎ | 12-305H ◎ ◎ | 12-405H ◎ ◎ | 12-505H ◎ ◎ | 12-605H ◎ ◎ | 12-705H ◎ ◎ | 12-805H ◎ ◎ | 12-905H ◎ ◎ | 12-1005H ◎ ◎ |
| 12-6H | 12-206H ◎ ◎ | 12-306H ◎ ◎ | 12-406H ◎ ◎ | 12-506H ◎ ◎ | 12-606H ◎ ◎ | 12-706H ◎ ◎ | 12-806H ◎ ◎ | 12-906H ◎ ◎ | 12-1006H ◎ ◎ |
| 12-7H | 12-207H o o | 12-307H o o | 12-407H o o | 12-507H o o | 12-607H o o | 12-707H o o | 12-807H o o | 12-907H o o | 12-1007H o o |
| 12-8H | 12-208H o o | 12-308H o o | 12-408H o o | 12-508H o o | 12-608H o o | 12-708H o o | 12-808H o o | 12-908H o o | 12-1008H o o |

Sample No.

Overall image quality evaluation — Durability evaluation

Evaluation standards:
◎: Excellent
o: Good

TABLE H17

| Sample No. | 1301H | 1302H | 1303H | 1304H | 1305H | 1306H | 1307H |
|---|---|---|---|---|---|---|---|
| Si:C target (area ratio) | 9:1 | 6.5:3.5 | 4:6 | 2:8 | 1:9 | 0.5:9.5 | 0.2:9.8 |
| Si:C (content ratio) | 9.7:0.3 | 8.8:1.2 | 7.3:2.7 | 4.8:5.2 | 3:7 | 2:8 | 0.8:9.2 |
| Image quality evaluation | Δ | o | ◎ | ◎ | o | Δ | X |

◎: Very good
o: Good
Δ: Practically satisfactory
X: Image defect formed

TABLE H18

| Sample No. | 1401H | 1402H | 1403H | 1404H | 1405H | 1406H | 1407H | 1408H |
|---|---|---|---|---|---|---|---|---|
| $SiH_4:C_2H_4$ (flow rate ratio) | 9:1 | 6:4 | 4:6 | 2:8 | 1:9 | 0.5:9.5 | 0.35:9.65 | 0.2:9.8 |
| Si:C (content ratio) | 9:1 | 7:3 | 5.5:4.5 | 4:6 | 3:7 | 2:8 | 1.2:8.8 | 0.8:9.2 |
| Image quality evaluation | Δ | o | ◎ | ◎ | ◎ | o | Δ | X |

◎: Very good
o: Good
Δ: Practically satisfactory
X: Image defect formed

TABLE H19

| Sample No. | 1501H | 1502H | 1503H | 1504H | 1505H | 1506H | 1507H | 1508H |
|---|---|---|---|---|---|---|---|---|
| $SiH_4:SiF_4:C_2H_4$ (flow rate ratio) | 5:4:1 | 3:3.5:3.5 | 2:2:6 | 1:1:8 | 0.6:0.4:9 | 0.2:0.3:9.5 | 0.2:0.15:9.65 | 0.1:0.1:9.8 |
| Si:C (content ratio) | 9:1 | 7:3 | 5.5:4.5 | 4:6 | 3:7 | 2:8 | 1.2:8.8 | 0.8:9.2 |
| Image quality | Δ | o | ◎ | ◎ | ◎ | o | Δ | X |

TABLE H19-continued

| Sample No. | 1501H | 1502H | 1503H | 1504H | 1505H | 1506H | 1507H | 1508H |
|---|---|---|---|---|---|---|---|---|
| evaluation | | | | | | | | |

◎: Very good
o: Good
Δ: Practically satisfactory
X: Image defect formed

TABLE H20

| Sample No. | Thickness of amorphous layer (II) (μ) | Results |
|---|---|---|
| 1601H | 0.001 | Image defect liable to occur |
| 1602H | 0.02 | No image defect during 20,000 repetitions |
| 1603H | 0.05 | Stable for 50,000 repetitions or more |
| 1604H | 1 | Stable for 200,000 repetitions or more |

We claim:

1. A photoconductive member comprising a support for a photoconductive member, a first amorphous layer having a layer constitution comprising a first layer region comprising an amorphous material containing silicon atoms and 1 to $9.5\times10^5$ atomic ppm of germanium atoms and 0.01 to 40 atomic % of at least one of hydrogen atoms and halogen atoms, and a second layer region comprising an amorphous material containing silicon atoms and exhibiting photoconductivity, said first and second layer regions being provided successively from the side of said support; and a second amorphous layer comprising an amorphous material containing silicon atoms and carbon atoms.

2. A photoconductive member according to claim 1, wherein hydrogen atoms are contained in the second layer region.

3. A photoconductive member according to claim 1, wherein halogen atoms are contained in the second layer region.

4. A photoconductive member according to claim 1, wherein the germanium atoms are contained in a distribution state ununiform in the direction of layer thickness.

5. A photoconductive member according to claim 1, wherein the first layer region contains a substance for controlling the conduction characteristics.

6. A photoconductive member according to claim 5, wherein the substance for controlling the conduction characteristics is an atom belonging to the group III of the periodic table.

7. A photoconductive member according to claim 6, wherein the atom belonging to the group III of the periodic table is selected from the group consisting of B, Al, Ga, In and Tl.

8. A photoconductive member according to claim 5, wherein the substance for controlling the conduction characteristics is a P-type impurity.

9. A photoconductive member according to claim 5, wherein the substance for controlling the conduction characteristics is an atom belonging to the group V of the periodic table.

10. A photoconductive member according to claim 9, wherein the atom belonging to the group V of the periodic table is selected from the group consisting of P, As, Sb and Bi.

11. A photoconductive member according to claim 5, wherein the substance for controlling the conduction characteristics is an N-type impurity.

12. A photoconductive member according to claim 1, wherein the first amorphous layer contains a substance for controlling the conduction characteristics.

13. A photoconductive member according to claim 12, wherein the substance for controlling the conduction characteristics is a P-type impurity.

14. A photoconductive member according to claim 12, wherein the substance for controlling the conduction characteristics is an N-type impurity.

15. A photoconductive member according to claim 12, wherein the substance for controlling the conduction characteristics is an atom belonging to the group III of the periodic table.

16. A photoconductive member according to claim 15, wherein the atom belonging to the group III of the periodic table is selected from the group consisting of B, Al, Ga, In and Tl.

17. A photoconductive member according to claim 15, wherein the substance for controlling the conduction characteristics is an atom belonging to the group V of the periodic table.

18. A photoconductive member according to claim 17, wherein the atom belonging to the group V of the periodic table is selected from the group consisting of P, As, Sb and Bi.

19. A photoconductive member according to claim 12, wherein the first amorphous layer has a layer region (P) containing a P-type impurity and a layer region (N) containing an N-type impurity.

20. A photoconductive member according to claim 19, wherein the layer region (P) and the layer region (N) are contacted with each other.

21. A photoconductive member according to claim 20, wherein the layer region (P) is provided as end portion layer region on the support side of the first amorphous layer.

22. A photoconductive member according to claim 1, wherein the first amorphous layer has a layer region containing a P-type impurity in the end portion layer region on the support side.

23. A photoconductive member according to claim 1, wherein the layer thickness $T_B$ of the first layer region and the layer thickness T of the second layer region has the following relation:

$$T_B/T \leqq 1.$$

24. A photoconductive member according to claim 1, wherein the first amorphous layer contains at least one of hydrogen atoms and halogen atoms.

25. A photoconductive member according to claim 1, wherein the first amorphous layer contains oxygen atoms.

26. A photoconductive member according to claim 25, wherein the oxygen atoms are contained in a distribution state ununiform in the direction of layer thickness.

27. A photoconductive member according to claim 26, wherein the oxygen atoms are contained in a distribution more enriched toward the support side.

28. A photoconductive member according to claim 1, wherein the first amorphous layer contains oxygen atoms in the end portion layer region on the support side.

29. A photoconductive member according to claim 1, wherein the second amorphous layer contains at least one of hydrogen atoms and halogen atoms.

30. A photoconductive member according to claim 2, wherein halogen atoms are contained in the second layer region.

31. A photoconductive member according to claim 1, wherein the second layer region contains 1–40 atomic % of hydrogen atoms.

32. A photoconductive member according to claim 1, wherein the second layer region contains 1–40 atomic % of halogen atoms.

33. A photoconductive member according to claim 32, wherein the halogen atom is selected from the group consisting of F, Cl, Br and I.

34. A photoconductive member according to claim 23, wherein the layer thickness T is 30 Å–50μ.

35. A photoconductive member according to claim 23, wherein the layer thickness T is 0.5–90μ.

36. A photoconductive member according to claim 23, wherein $(T_B+T)$ is 1–100μ.

37. A photoconductive member according to claim 1, wherein the first amorphous layer has region (O) containing oxygen atoms.

38. A photoconductive member according to claim 37, wherein the amount of the oxygen atoms in the layer region (O) is 0.001–50 atomic %.

39. A photoconductive member according to claim 37, wherein the ratio of the layer thickness $T_O$ of the layer region (O) relative to the layer thickness of the first amorphous layer is 2/5 or higher.

40. A photoconductive member according to claim 39, wherein the upper limit of the content of oxygen atoms in the layer region (O) is 30 atomic % or less.

41. A photoconductive member according to claim 1, wherein the first layer region has a layer region (PN) containing a substance for controlling the conduction characteristics.

42. A photoconductive member according to claim 41, wherein the amount of said substance in the layer region (PN) is $0.01-5\times10^4$ atomic ppm.

43. A photoconductive member according to claim 1, wherein the first amorphous layer has a layer region (PN) containing a substance for controlling the conduction characteristics.

44. A photoconductive member according to claim 1, wherein the second amorphous layer comprises an amorphous material represented by the formula:

$$a\text{-}Si_aC_{1-a}\ (0.1\leqq a\leqq 0.99999),$$

$$a\text{-}(Si_bC_{1-b})_cH_{1-c}\ (0.1\leqq b\leqq 0.99999)\ (0.6\leqq c\leqq 0.99),$$

or $$a\text{-}(Si_dC_{1-d})_e(H,X)_{1-e}\ (0.1\leqq d\leqq 0.99999)\ (0.8\leqq e\leqq 0.99)$$

wherein Si is silicon atom; C is carbon atom; H is hydrogen atom; and X is halogen atom.

45. A photoconductive member according to claim 1, wherein the layer thickness of the second amorphous layer is 0.003–30μ.

* * * * *

UNITED STATES PATENT AND TRADEMARK OFFICE

CERTIFICATE OF CORRECTION

PATENT NO. : 4,517,269

DATED : May 14, 1985

INVENTOR(S) : Shimizu, et al.

It is certified that error appears in the above-identified patent and that said Letters Patent is hereby corrected as shown below:

Col. 1, line 45, "the" should be --to--.
Col. 2, line 11, delete ",".
Col. 2, lines 36-37, "surpass" should be --surpasses--.
Col. 2, line 43, "SUMAMRY" should be --SUMMARY--.
Col. 2, line 57, "region," should be --regions,--.
Col. 3, line 28, after "10" insert --show--.
Col. 3, line 31, after "11" insert --shows--.
Col. 4, line 53, "while" should be --with--.
Col. 6, line 45, "nemely" should be --namely--.
Col. 7, line 46, delete "of".
Col. 7, line 67, delete "of".
Col. 8, line 40, delete "be", second occurrence.
Col. 8, line 68, "a" should be --an--.
Col. 10, line 11, delete second "of".
Col. 10, line 30, "another" should be --other--.
Col. 10, line 32, "another" should be --other--.
Col. 10, line 45, after "desirably" insert --to--.
Col. 10, line 47, "the" (first occurrence) should be --in--.
Col. 11, line 15, after "concentration" add --is--.
Col. 16, line 16, "phlyethylene" should be --polyethylene--.
Col. 21, line 27, after "from" insert --an--.
Col. 22, line 17, "regin" should be --region--.
Col. 22, line 40, "have" should be --has--.
Col. 24, line 63, "tone" should be --toner--.
Col. 27, line 43, "image" should be --images--.
Col. 29, line 62, "member" should be --members--.
Col. 34, line 42, "12-1009D" should be --12-1008D--.
Col. 38, line 14, "image" should be --images--.
Col. 41, line 33, "charged" should be --changed--.
Col. 42, line 52, "12-1009F" should be --12-1008--.
Col. 43, line 27, insert --the-- after "for each of".
Col. 46, line 45, "image" should be --images--.
Col. 47, line 10, "12-1009G" should be --12-1008G--.

UNITED STATES PATENT AND TRADEMARK OFFICE

CERTIFICATE OF CORRECTION

PATENT NO. : 4,517,269

DATED : May 14, 1985

INVENTOR(S) : Shimizu, et al.

It is certified that error appears in the above-identified patent and that said Letters Patent is hereby corrected as shown below:

Col. 50, line 53, "122," should be --123,--.
Col. 52, line 49, "as" should be --are--.
TABLE B3, "First $SiH_4$/He=0.5" should be --First $SiH_4$/He=0.05--.
TABLE B8, after "12-6B", "12-2-6B" should be --12-206B--.
TABLE C1, "layer(ii)" should be --layer (II)--.
TABLE C11-continued, under "Flow rates ratio", "NO/$GeH_4$" should be --NO/($GeH_4$--
TABLE F10, "Amphorous" should be --Amorphous--.
TABLE G1, "$GeH_4$/He=00.5" should be --$GeH_4$/He=0.05--.
TABLE G3, "$B_2$Hhd6/He=" should be --$B_2$H 6/He=--.
TABLE G6, under "Flow rate", "$SiH_4$+ $GeH_4$3250" should be --$SiH_4$+$GeH_4$=50--.
TABLE G13, under "Flow rate", "SiH" should be --$SiH_4$--.
TABLE G14A, "105G" should be --1405G--.
TABLE G14A, "14019G" should be --1409G--.
"Table 15G" should be --Table G15--.
TABLE G15A, "12100G" should be --12001G--.
TABLE G18, "1081G" should be --1801G--.
TABLE G18, line 5 under "1802G", "3:4.5:3.5" should be --3:3.5:3.5--.

Signed and Sealed this

Twenty-fifth Day of November, 1986

*Attest:*

DONALD J. QUIGG

*Attesting Officer* *Commissioner of Patents and Trademarks*